US007532209B2

(12) United States Patent
Kimura

(10) Patent No.: US 7,532,209 B2
(45) **Date of Patent: *May 12, 2009**

(54) DISPLAY APPARATUS AND DRIVING METHOD THEREOF

(75) Inventor: Hajime Kimura, Atsugi (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 282 days.

This patent is subject to a terminal disclaimer.

(21) Appl. No.: 10/439,045

(22) Filed: May 16, 2003

(65) Prior Publication Data

US 2003/0214465 A1 Nov. 20, 2003

(30) Foreign Application Priority Data

May 17, 2002 (JP) ..... 2002-143885
Aug. 8, 2002 (JP) ..... 2002-231534

(51) Int. Cl.
*G09G 5/00* (2006.01)

(52) U.S. Cl. ..... 345/205; 345/204; 345/206; 345/207; 345/211

(58) Field of Classification Search ..... 345/76, 345/83, 204, 211, 206, 87–100, 82, 55, 42, 345/164, 167, 207, 77, 74.1; 315/169.1–169.3, 315/200 A, 241 S; 257/72, 64; 399/184
See application file for complete search history.

(56) References Cited

U.S. PATENT DOCUMENTS 4,685,794 A * 8/1987 Watanabe ..... 399/184
4,996,523 A * 2/1991 Bell et al. ..... 345/77
5,396,133 A 3/1995 Zhang
5,504,444 A 4/1996 Neugebauer
5,526,058 A 6/1996 Sano et al.
5,548,238 A 8/1996 Zhang et al.

(Continued)

FOREIGN PATENT DOCUMENTS

| | | |
|---|---|---|
| EP | 1 049 360 | 11/2000 |
| EP | 1061497 | 12/2000 |
| EP | 1 102 234 | 5/2001 |
| EP | 1130565 | 9/2001 |
| JP | 08-054835 | 2/1996 |

(Continued)

OTHER PUBLICATIONS

International Preliminary Examination Report dated Jun. 17, 2004 for Application No. PCT/JP2002/009354, which was filed Sep. 12, 2002.

(Continued)

*Primary Examiner*—Prabodh M. Dharia
(74) *Attorney, Agent, or Firm*—Eric J. Robinson; Robinson Intellectual Property Law Office, P.C.

(57) ABSTRACT

A plurality of pairs of switch parts and current source circuits are disposed in each pixel. Switching of each of a plurality of the switch parts is controlled by a digital video signal. When the switch part is turned ON, by a current supplied from the current source circuit making a pair with the switch part, the light emitting element emits light. A current which is supplied from one current source circuit to the light emitting element is constant. A value of a current flowing through the light emitting element is comparable to a value of added currents which are supplied to the light emitting element from respective all current source circuits making pairs with the switch parts which are in the conductive states.

24 Claims, 44 Drawing Sheets

U.S. PATENT DOCUMENTS 5,561,548 A * 10/1996 Engle ..... 359/292
5,714,968 A 2/1998 Ikeda
5,856,812 A 1/1999 Hush et al.
5,894,201 A * 4/1999 Wong ..... 315/241 S
5,923,309 A * 7/1999 Ishizuka et al. ..... 345/82
5,940,053 A 8/1999 Ikeda
5,969,479 A * 10/1999 Wong ..... 315/200 A
6,011,529 A 1/2000 Ikeda
6,091,203 A 7/2000 Kawashima et al.
6,169,528 B1 1/2001 Oguchi et al.
6,229,506 B1 5/2001 Dawson et al.
6,266,000 B1 7/2001 Jusuf et al.
6,339,414 B1 1/2002 Todokoro et al.
6,341,275 B1 1/2002 Shi et al.
6,373,454 B1 4/2002 Knapp et al.
6,380,913 B1 4/2002 Hush et al.
6,411,159 B1 6/2002 Callahan, Jr.
6,429,600 B1 * 8/2002 Fujita et al. ..... 315/169.3
6,445,367 B1 9/2002 Suzuki et al.
6,466,189 B1 10/2002 Albu et al.
6,486,607 B1 * 11/2002 Yeuan ..... 315/169.1
6,498,596 B1 * 12/2002 Nakamura et al. ..... 345/98
6,501,466 B1 12/2002 Yamagishi et al.
6,507,328 B1 1/2003 Lee
6,507,381 B1 1/2003 Katsuya et al.
6,528,951 B2 3/2003 Yamazaki et al.
6,580,408 B1 6/2003 Bae et al.
6,580,657 B2 6/2003 Sanford et al.
6,583,775 B1 6/2003 Sekiya et al.
6,608,326 B1 * 8/2003 Shinagawa et al. ..... 257/64
6,617,801 B2 * 9/2003 Ishizuka et al. ..... 315/169.3
6,650,060 B2 * 11/2003 Okuda ..... 315/169.1
6,690,033 B2 * 2/2004 Yamazaki et al. ..... 257/72
6,744,414 B2 6/2004 Lee et al.
6,747,638 B2 * 6/2004 Yamazaki et al. ..... 345/207
6,753,654 B2 6/2004 Koyama
6,760,004 B2 * 7/2004 Koyama ..... 345/98
6,777,712 B2 8/2004 Sanford et al.
6,798,148 B2 * 9/2004 Inukai ..... 315/169.3
6,853,370 B2 * 2/2005 Numao ..... 345/204
6,859,193 B1 2/2005 Yumoto
6,864,863 B2 3/2005 Kasai
6,876,350 B2 * 4/2005 Koyama ..... 345/92
6,919,868 B2 * 7/2005 Tam ..... 345/76
6,919,870 B2 7/2005 Fukuda
6,960,889 B2 11/2005 Park et al.
6,963,336 B2 * 11/2005 Kimura ..... 345/204
7,050,024 B2 * 5/2006 LeChevalier ..... 345/84
7,138,967 B2 11/2006 Kimura
7,148,865 B2 * 12/2006 Tamaki ..... 345/82
7,170,479 B2 * 1/2007 Kimura ..... 345/82
7,176,912 B2 2/2007 Kota et al.
7,184,034 B2 2/2007 Kimura
7,193,591 B2 3/2007 Yumoto
2001/0038367 A1 11/2001 Inukai
2002/0003507 A1 1/2002 Dodge
2002/0011972 A1 * 1/2002 Yamazaki et al. ..... 345/74.1
2002/0014628 A1 * 2/2002 Koyama ..... 257/72
2002/0033718 A1 3/2002 Tam
2002/0089496 A1 * 7/2002 Numao ..... 345/204
2002/0135309 A1 * 9/2002 Okuda ..... 315/169.1
2002/0175634 A1 * 11/2002 Ishizuka et al. ..... 315/169.1
2002/0180369 A1 * 12/2002 Koyama ..... 315/169.1
2002/0180719 A1 * 12/2002 Nagai et al. ..... 345/206
2002/0190177 A1 * 12/2002 Nielsen ..... 248/339
2003/0016191 A1 1/2003 Nakamura et al.
2003/0016198 A1 * 1/2003 Nagai et al. ..... 345/83
2003/0043090 A1 * 3/2003 Yazawa et al. ..... 345/76
2003/0048669 A1 3/2003 Abe
2003/0063081 A1 * 4/2003 Kimura et al. ..... 345/211
2003/0090447 A1 5/2003 Kimura
2003/0117352 A1 * 6/2003 Kimura ..... 345/87
2003/0137474 A1 7/2003 Lee
2003/0214465 A1 11/2003 Kimura
2003/0214466 A1 11/2003 Kimura
2003/0214522 A1 11/2003 Kageyama et al.
2003/0218584 A1 11/2003 Kimura
2004/0008166 A1 1/2004 Kimura
2004/0041752 A1 3/2004 Kimura
2004/0100202 A1 * 5/2004 Koyama ..... 315/169.3
2004/0183769 A1 * 9/2004 Schreyer et al. ..... 345/99
2004/0207615 A1 * 10/2004 Yumoto ..... 345/211
2004/0222749 A1 * 11/2004 Koyama ..... 315/169.3
2005/0024298 A1 2/2005 Tam
2005/0099371 A1 * 5/2005 Koyama ..... 345/76
2005/0190177 A1 * 9/2005 Yumoto ..... 345/211
2007/0052635 A1 3/2007 Kimura
2007/0103409 A1 5/2007 Kimura
2007/0146250 A1 6/2007 Kimura

FOREIGN PATENT DOCUMENTS

JP 08-129359 5/1996
JP 11-212493 8/1999
JP 11-282419 10/1999
JP 2000-284751 10/2000
JP 2001-042822 2/2001
JP 2001-060076 3/2001
JP 2001-147659 5/2001
JP 2002-514320 5/2002
JP 2002-517806 6/2002
JP 2002-278497 9/2002
JP 2003-066909 3/2003
JP 2003-330416 11/2003
WO WO 98/48403 10/1998
WO WO 99/65011 12/1999
WO WO-01/06484 1/2001
WO WO 01/73741 10/2001

OTHER PUBLICATIONS

Search Report for Singapore Patent Application No. 200302785-1, Intellectual Property Office of Singapore, Dec. 17, 2004.

M.T. Johnson et al., *Active Matrix PolyLED Displays*, Proceedings of the Seventh International Display Workshops, IDW '00, pp. 235-238, Nov. 19, 2000.

* cited by examiner

W
Wco
Sb Sa
Ga
RGa
Gb
RGb
Gai
RGai
Gbi
RGbi
Gai-1
Gbi-1
A
B
C
D
101a
101b
102a
102b
106
301
302
303
304

Fig. 9A
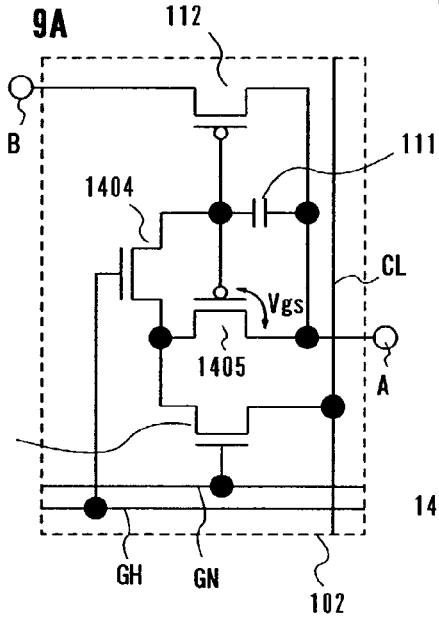
Fig. 9B
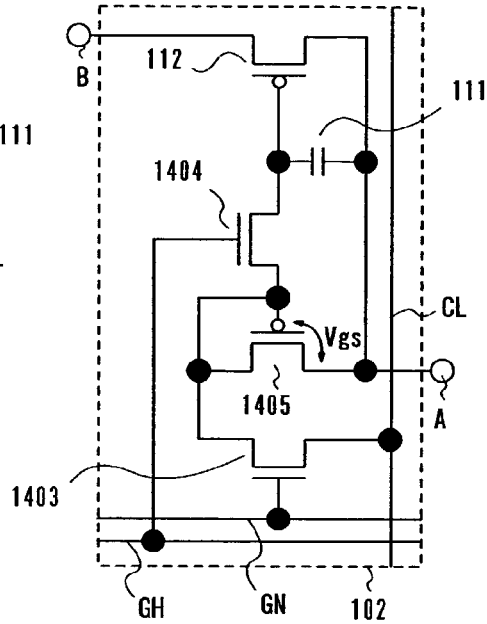
Fig. 9C (TD1)
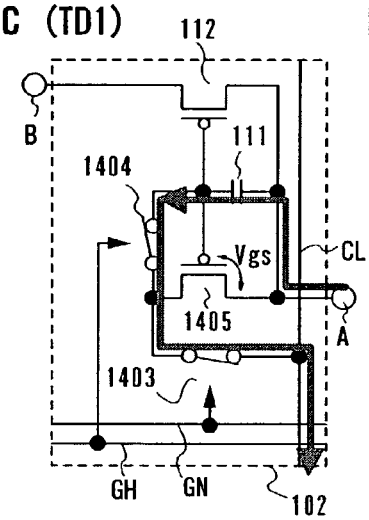
Fig. 9D (TD2)
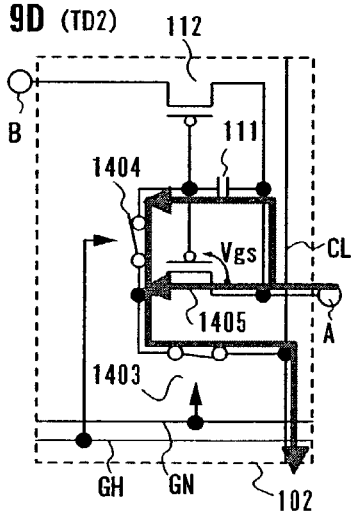
Fig. 9E (TD3)
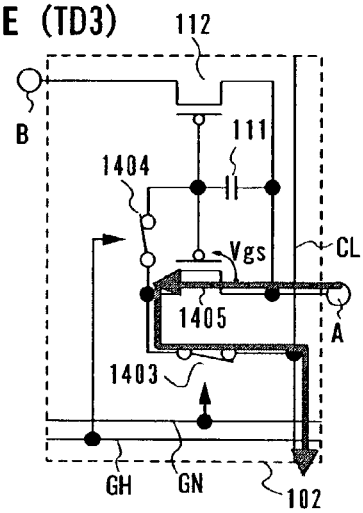
Fig. 9F (TD4)
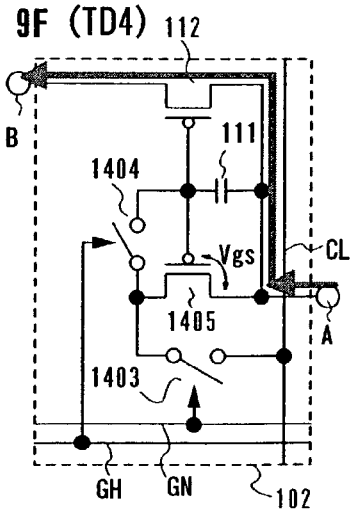

Fig. 10A
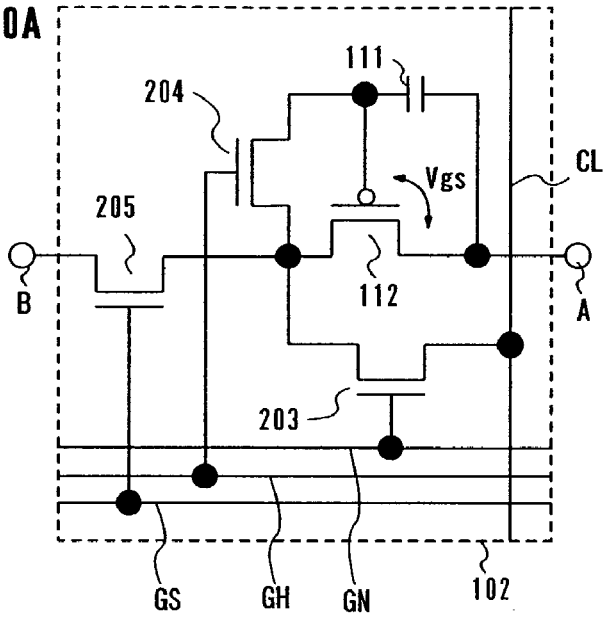
Fig. 10B (TD1)
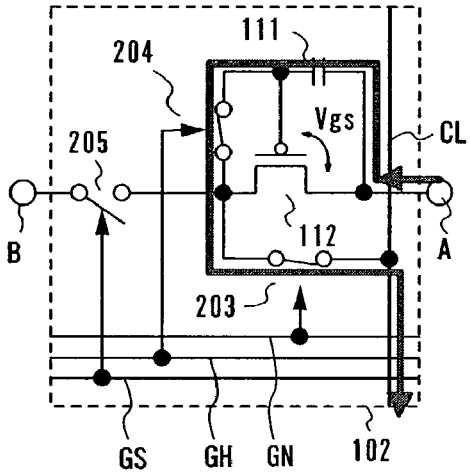
Fig. 10C (TD2)
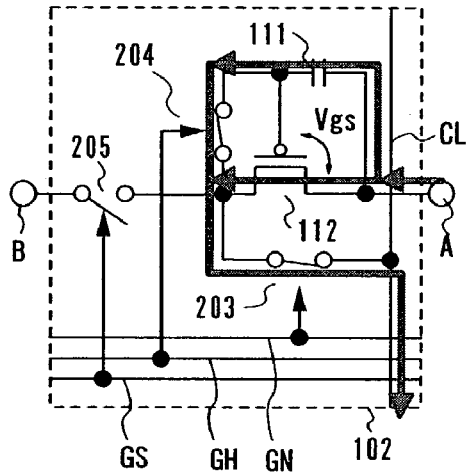
Fig. 10D (TD3)
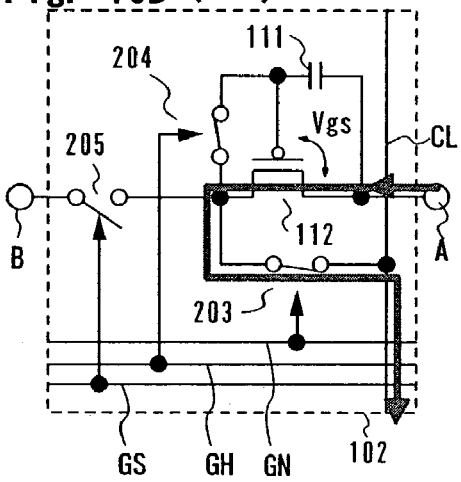
Fig. 10E (TD4)
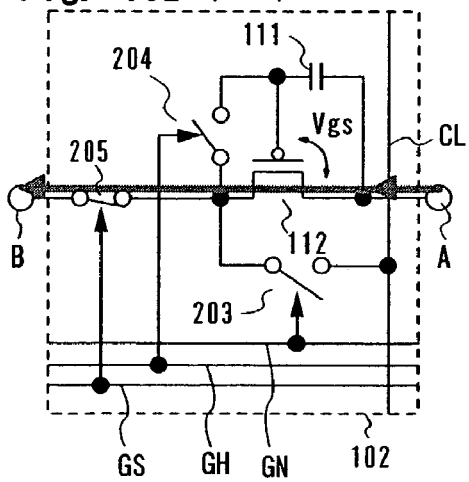

Fig. 11A
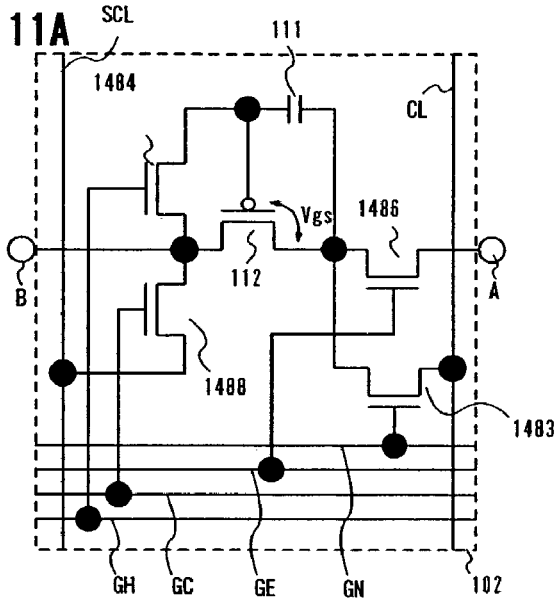
Fig. 11B (TD1)
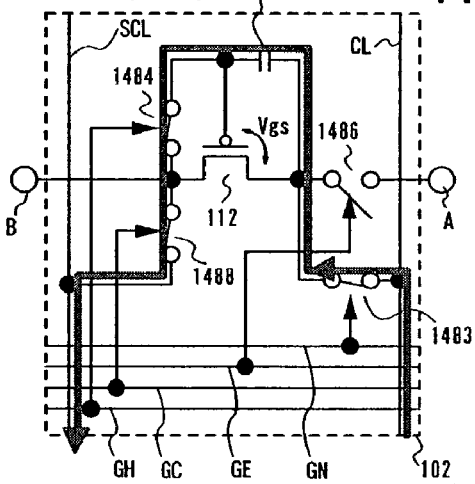
Fig. 11C (TD2)
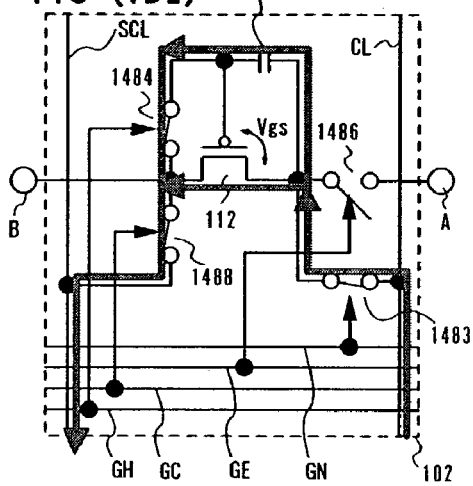
Fig. 11D (TD3)
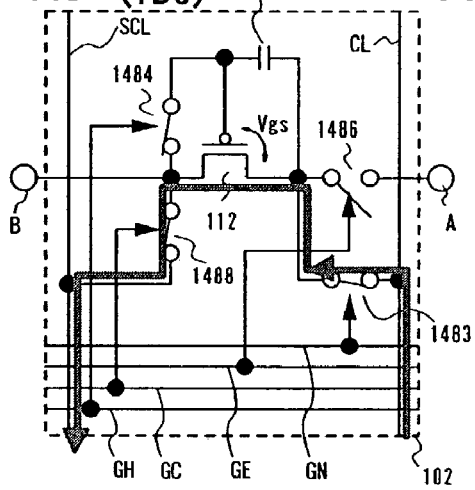
Fig. 11E (TD4)
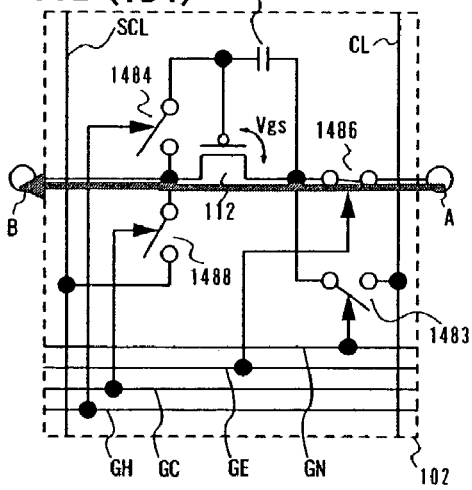

Fig. 12A
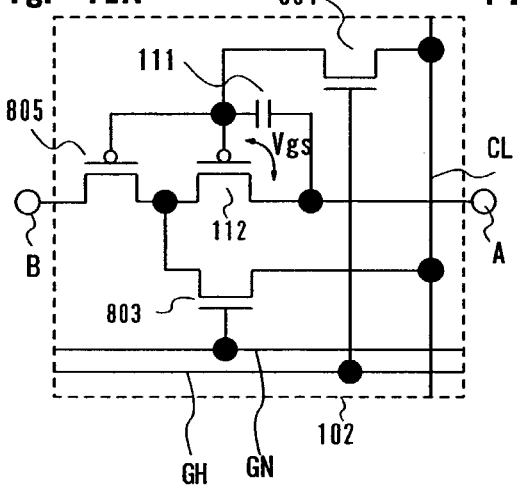
Fig. 12B
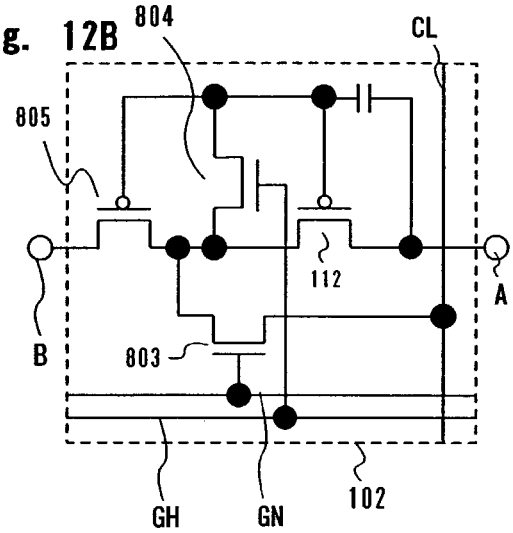
Fig. 12C (TD1)
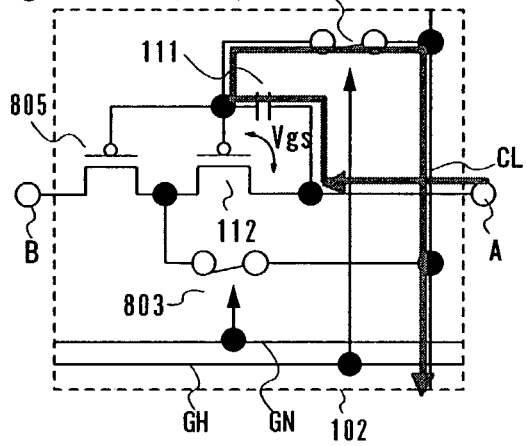
Fig. 12D (TD2)
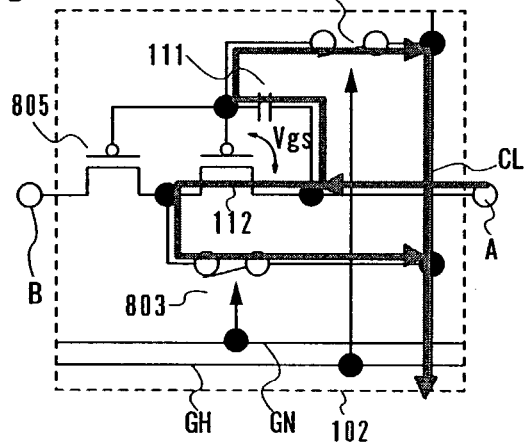
Fig. 12E (TD3)
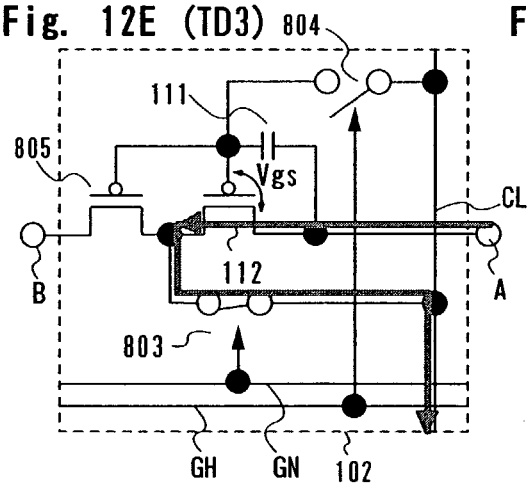
Fig. 12F (TD4)
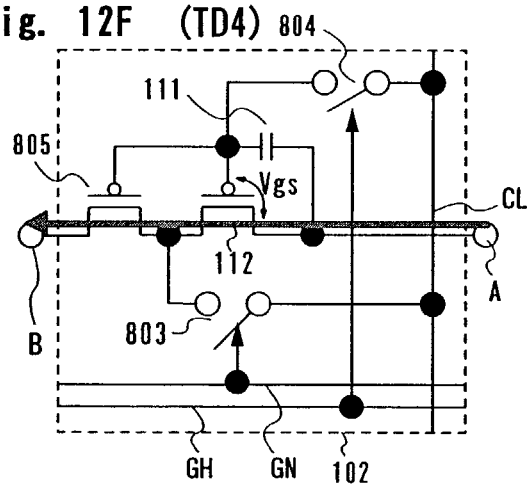

Fig. 13A
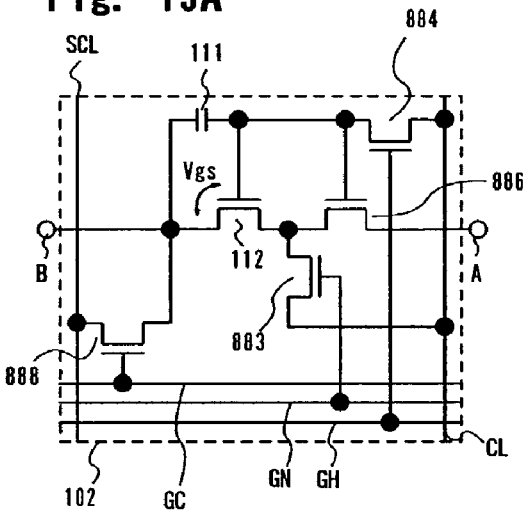
Fig. 13B
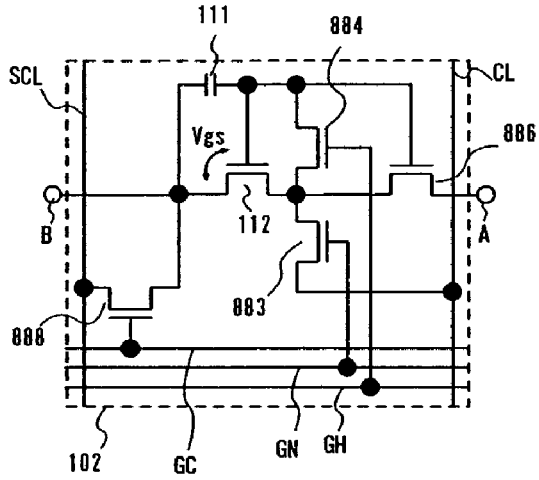
Fig. 13C (TD1)
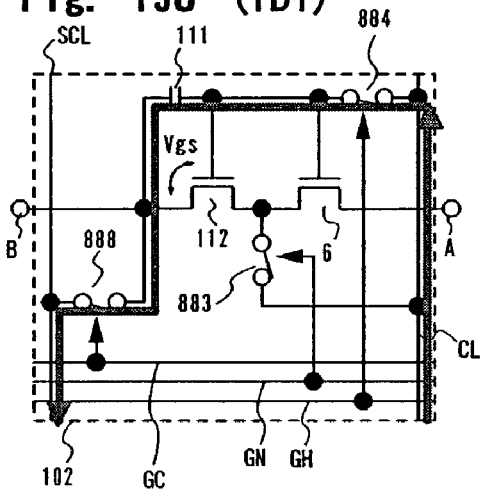
Fig. 13D (TD2)
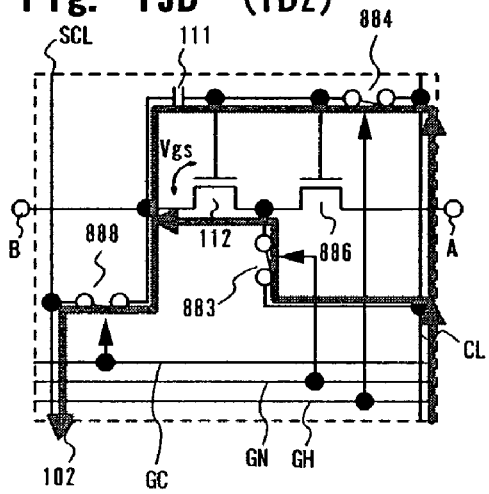
Fig. 13E (TD3)
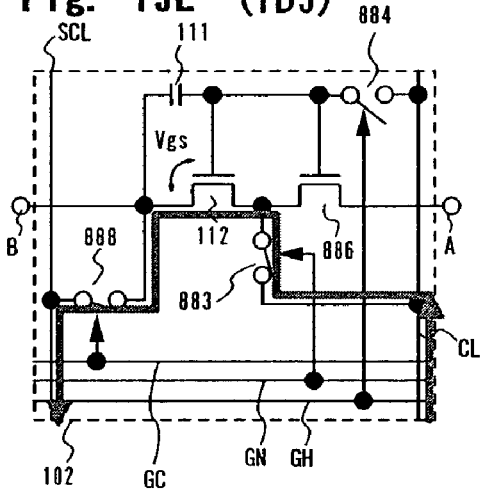
Fig. 13F (TD4)
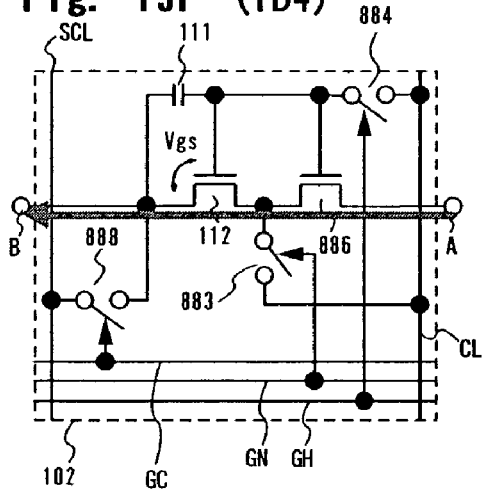

PRIOR ART

PRIOR ART

PRIOR ART (TA1) Fig. 29A
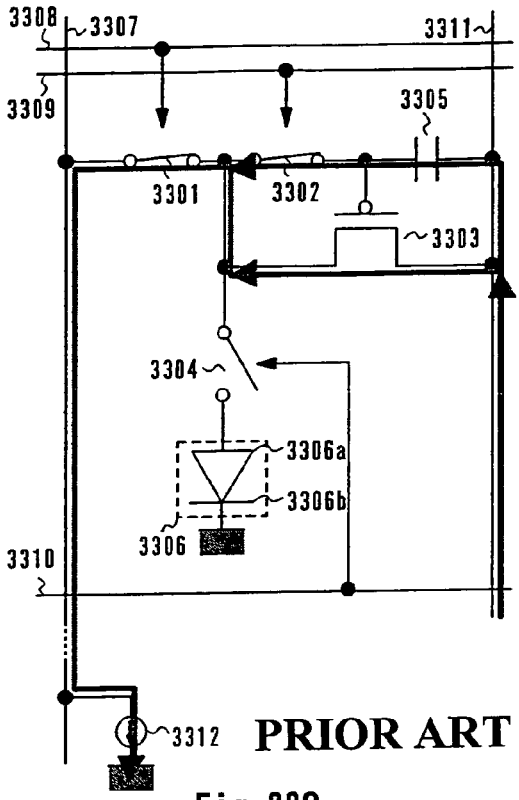
PRIOR ART
(TA2) Fig. 29B
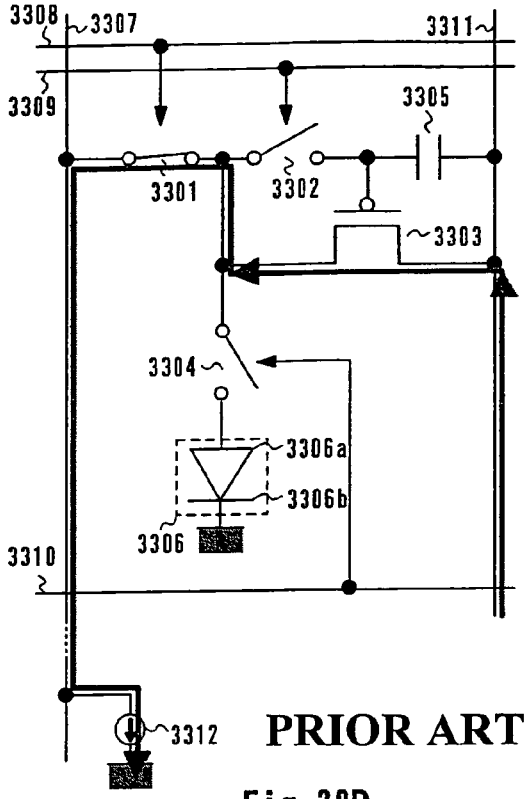
PRIOR ART
(TA3) Fig. 29C
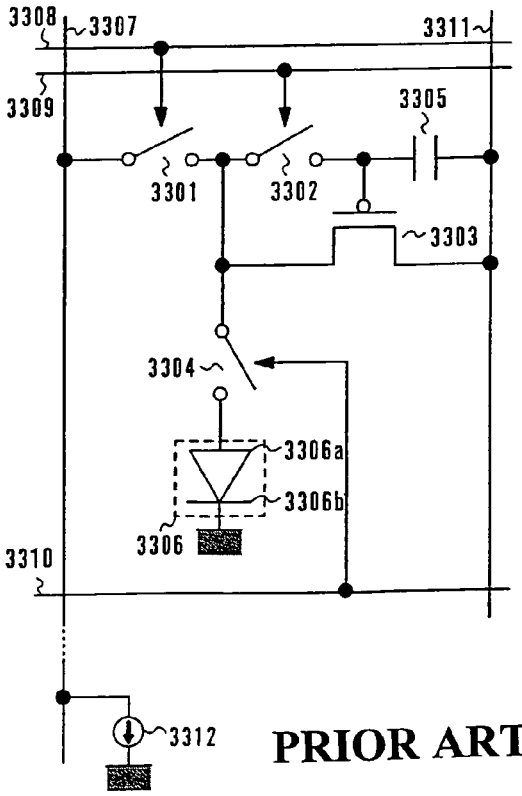
PRIOR ART
(TA4) Fig. 29D
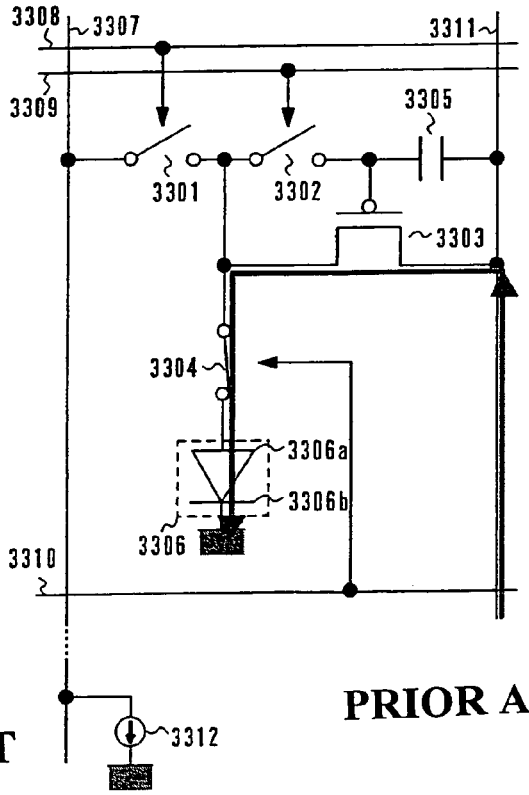
PRIOR ART

PRIOR ART

PRIOR ART

PRIOR ART

DISPLAY APPARATUS AND DRIVING METHOD THEREOF

BACKGROUND OF THE INVENTION

1. Field of the Invention

This invention relates to a display device using a light emitting element and a driving method thereof. More particularly, it relates to an active matrix type display device in which a light emitting element is disposed in each pixel and a transistor for controlling light emission of the light emitting element is provided and a driving method thereof.

2. Description of the Related Art

Development of a display device having a light emitting element has been put forward in these years. In particular, development of an active matrix type display device in which a light emitting element and a transistor for controlling light emission of the light emitting element are disposed in each pixel has been put forward.

In the active matrix type display device, either a technique in which an input of luminance information to each pixel is carried out by a voltage signal or a technique in which it is carried out by a current signal is mainly used. The former is called as a voltage writing type, and the latter is called as a current writing type. These structures and driving methods will be, hereinafter, described in detail.

Firstly, one example of a pixel of the voltage writing type is shown in FIG. 26 and its structure and driving method will be described. In each pixel, two TFT(a switching TFT 3001 and a driving TFT 3004) and a holding capacitor 3007 and an EL element 3006 are disposed. Here, a first electrode 3006*a* of the EL element 3006 is called as a pixel electrode, and a second electrode 3006*b* is called as a counter electrode.

A driving method of the above-described pixel will be described. When the switching TFT 3001 is turned ON by a signal which is inputted to a gate signal line 3002, an electric charge is stored and held in the holding capacitor 3007 by a voltage of a video signal which is inputted to a source signal line 3003. A current which amount corresponds to the electric charge held in the holding capacitor 3007 flows from a power supply line 3005 to the EL element 3006 through the driving TFT 3004 so that the EL element 3006 emits light.

In pixels of the voltage writing type, the video signal which is inputted to the source signal line 3003 may be of an analog system or may be of a digital system. Driving in a case that the analog system video signal was used is called as the analog system, and driving in a case that the digital system video signal is used is called as the digital system.

In the voltage writing type analog system, a gate voltage (a voltage between a gate and a source) of each pixel of the driving TFT 3004 is controlled by the analog video signal. And, by the drain current with a value comparable to the gate voltage flowing through the EL element 3006, luminance is controlled and gray scale is displayed. On this account, generally in the voltage writing type analog system, in order to display halftone gray scale level, the driving TFT 3004 is made to operate in such an area that change of the drain current is larger relative to that of the gate voltage.

On the other hand, in the voltage writing type digital system, periods of light emission is controlled and gray scales are displayed by selecting using digital signals whether the EL element 3006 is made to emit light or not. In short, the driving TFT 3004 takes a function as a switch. On this account, generally in the voltage writing type digital system, on the occasion that the EL element 3006 is made to emit light, the driving TFT 3004 is made to operate in a linear region, more closely, particularly an area in which an absolute value of the gate voltage is large in the linear region.

The operation area of the driving TFT in the voltage writing type digital system and the voltage writing type analog system will be described by use of FIGS. 27A and 27B. FIG. 27A is a view, for the purpose of simplicity, showing only the driving TFT 3004, the power supply line 3005 and the EL element 3006 in the pixel shown in FIG. 26. Curves 3101*a* and 3101*b* in FIG. 27B shows a value of the drain current $I_d$ corresponding to the gate voltage $V_{gs}$ of the driving TFT 3004, respectively. The curve 3101*b* shows a characteristic in a case that a threshold voltage of the driving TFT 3004 is changed from that in case of the curve 3101*a*.

In the voltage writing analog system, the driving TFT 3004 operates in an operation area shown by (1) in FIG. 27B. In the operation area (1), when a gate voltage $V_{gs1}$ is applied, if a current characteristic of the driving TFT 3004 varies from 3101*a* to 3101*b*, the drain current changes from $I_{d1}$ to $I_{d2}$. In short, in the voltage writing type analog system, when the current characteristic of the driving TFT 3004 varies, the drain current varies and therefore, there is a problem that luminance of the EL element 3006 varies among pixels.

On the other hand, the driving TFT in the voltage writing type digital system operates in an operation area shown by (2) in the figure. The operation area (2) corresponds to the linear region. The driving TFT 3004 which operates in the linear region, in case that the same gate voltage $V_{gs2}$ is applied, have substantially a constant current $I_{d3}$ flown since variation of the drain current resulting from variation of the characteristic such as mobility and threshold voltage is small. Thus, in the voltage writing type digital system in which the driving TFT 3004 operates in the operation area (2), even if the current characteristic of the driving TFT 3004 varies from 3101*a* to 3101*b*, it is hard for the current flowing through the EL element 3006 to vary, and it is possible to suppress variation of light emission luminance.

Thus, it can be said that as to the variation of luminance of the EL element resulting from the variation of the current characteristic of the driving TFT 3004, that of the voltage writing type digital system is smaller than that of the voltage writing type analog system.

Then, a structure and a driving method of the pixel of the current writing type will be described.

In a display device of the current writing type, a current of the video signal (signal current) is inputted from the source signal line to each pixel. The signal current has a current value which linearly corresponds to luminance information. The signal current which was inputted becomes a drain current of a TFT included in a pixel. A gate voltage of the TFT is held in a capacitance part included in a pixel. Even after input of the signal current is terminated, the drain current of TFT is maintained to be constant by the held gate voltage, and by inputting the drain current to the EL element, the EL element emits light. In this manner, in the current writing type display device, a current flowing through the EL element is made to be changed by changing magnitude of the signal current so that the light emission luminance of the EL element is controlled and gray scale is displayed.

Hereinafter, two structures of the pixels of the current writing type are illustrated for example, and those structures and driving methods thereof will be described in detail.

FIG. 28 shows a structure of a pixel which is described in a patent document 1(JP-T-2002-517806) and a non patent document 1(IDW'00 p235-p238: Active Matrix PolyLED Displays). The pixel shown in FIG. 28 has an EL element 3306, a switching TFT 3301, a driving TFT 3303, a holding capacitor 3305, a holding TFT 3302, and a light emitting TFT 3304. Also, 3307 designates a source signal line, and 3308 designates a first gate signal line, and 3309 designates a second gate signal line, and 3310 designates a third gate signal line, and 3311 designates a power supply line. A current value of the signal current which is inputted to the source signal line 3307 is controlled by a video signal input current source 3312.

A driving method of the pixel of FIG. 28 will be described by use of FIGS. 29A to 29D. In addition, in FIGS. 29A to 29D, the switching TFT 3301, the holding TFT 3302 and the light emitting TFT 3304 are shown as switches.

In a period of TA1, the switching TFT 3301 and the holding TFT 3302 are turned ON. In this moment, the power supply line 3311 is connected to the source signal line 3307 through the driving TFT 3303 and the holding capacitor 3305. Through the source signal line 3307, a current amount $I_{video}$ defined by a video signal input current source 3312 flows. Therefore, when time passes and it becomes a stable state, the drain current of the driving TFT 3303 becomes $I_{video}$. Also, the gate voltage corresponding to the drain current $I_{video}$ is held in the holding capacitor 3305 (FIG. 29A). After the drain current of the driving TFT 3303 is settled to be $I_{video}$, a period of TA2 is initiated, and the holding TFT 3302 is turned OFF.

Next, a period of TA3 is initiated, the switching TFT 3301 is turned OFF (FIG. 29C). Further, in a period of TA4, when the light emitting TFT 3304 is turned ON, the signal current $I_{video}$ is inputted from the power supply line 3311 to the EL element 3306 through the driving TFT 3303. By this means, the EL element 3306 emits light with luminance corresponding to the signal current $I_{video}$. In the pixel shown in FIG. 28, by analogously changing the signal current $I_{video}$, it is possible to express the gray scale.

In the above-described current writing type display device, the drain current of the driving TFT 3303 is determined by the signal current which is inputted from the source signal line 3307, and still further, the driving TFT 3303 operates in a saturation region. Therefore, even if there is variation of the characteristic of the driving TFT 3303, the gate voltage of the driving TFT 3303 automatically changes in such a manner that a constant drain current flows through the light emitting element. In this manner, in the current writing type display device, even if the characteristic of TFTs varies, it is possible to suppress variation of a current flowing through the EL element. As a result, it is possible to suppress the variation of the light emission luminance.

Next, another example of the current writing type pixel which is different from FIG. 28 will be described. FIG. 30A shows a pixel which is described in a patent document 2(JP-A-2001-147659).

A pixel shown in FIG. 30A is configured by an EL element 2906, a switching TFT 2901, a driving TFT 2903, a current TFT 2904, a holding capacitor 2905, a holding TFT 2902, a source signal line 2907, a first gate signal line 2908, a second gate signal line 2909,and a power supply line 2911. It is necessary for the driving TFT 2903 and the current TFT 2904 to have the same polarity. Here, for the purpose of simplicity, it is assumed that an $I_d$-$V_{gs}$ characteristic (a relation of the drain current and the voltage between gate and drain) of the driving TFT 2903 is the same as that of the current TFT 2904. Also, a current value of the signal current which is inputted to the source signal line 2907 is controlled by the video signal input current source 2912.

A driving method of the pixel shown in FIG. 30A will be described by use of FIGS. 30B to 30D. In addition, in FIGS. 30B to 30D, the switching TFT 2901 and the holding TFT 2902 are shown as switches.

In the period of TA1, when the switching TFT 2901 and the holding TFT 2902 are turned ON, the power supply line 2911 is connected to the source signal line 2907 through the current TFT 2904, the switching TFT 2901, the holding TFT 2902 and the holding capacitor 2905. Through the source signal line 2907, the current amount $I_{video}$ which is defined by the video signal input current source 2912 flows. Therefore, when sufficient time passes and it becomes a stable state, the drain current of the current TFT 2904 becomes $I_{video}$, and the gate voltage corresponding to the drain current $I_{video}$ is held in the holding capacitor 2905.

After the drain current of the current TFT 2904 is settled to be $I_{video}$, the period of TA2 is initiated, and the holding TFT 2902 is turned OFF. In this moment, through the driving TFT 2903, the drain current of $I_{video}$ flows. In this manner, the signal current $I_{video}$ is inputted from the power supply line 2911 to the EL element 2906 through the driving TFT 2903. The EL element 2906 emits light with luminance in response to the signal current $I_{video}$.

Next, when the period of TA3 is initiated, the switching TFT 2901 is turned OFF. Even after the switching TFT 2901 is turned OFF, the signal current $I_{video}$ continues to be inputted from the power supply line 2911 to the EL element 2906 through the driving TFT 2903, and the EL element 2906 continues to emit light. The pixel shown in FIG. 30A can express gray scale by analogously changing the signal current $I_{video}$.

In the pixel shown in FIG. 30A, the driving TFT 2903 operates in the saturation region. The drain current of the driving TFT 2903 is determined by the signal current which is inputted from the source signal line 2907. Therefore, if the current characteristics of the driving TFT 2903 and the current TFT 2904 in the same pixel are equivalent, even if there is variation of the characteristics of the driving TFTs 2903, the gate voltage of the driving TFT 2903 automatically changes in such a manner that a constant drain current is made to flow through the light emitting element.

In the EL element, a relation of a voltage between both electrodes thereof and a flowing current amount (I-V characteristic) changes due to influence of ambient temperature, deterioration over time and so on. Therefore, in a display device in which the driving TFT is operated in the linear region like the above-described voltage writing type digital system, even if a voltage value between both electrodes of the EL element is the same, the current amount flowing between both electrodes of the EL element is changed.

In the voltage writing type digital system, FIGS. 31A and 31B are views showing a change of an operating point in a case that the I-V characteristic of the EL element is changed due to deterioration etc. In addition, in FIGS. 31A and 31B, same reference numerals are given to those portions which are the same as the corresponding portions of FIGS. 27A and 27B.

FIG. 31A is a view, for the purpose of simplicity, showing only the driving TFT 3004 and the EL element 3006 in FIG. 26. A voltage between a source and a drain of the driving TFT 3004 is represented by $V_{ds}$. A voltage between both electrode of the EL element 3006 is shown by $V_{EL}$. A current flowing through the EL element 3006 is shown by IEL. The current IEL equals to the drain current Id of the driving TFT 3004. An electric potential of the power supply line 3005 is shown by $V_{dd}$. Also, an electric potential of a counter electrode of the EL element 3006 is assumed to be 0(V).

In FIG. 31B, 3202*a* designates a curve which shows the relation of the voltage $V_{EL}$ and the current amount $I_{EL}$ of the EL element 3006 before deterioration (I-V characteristic). On the other hand, 3202*b* designates a curve which shows I-V characteristic of the EL element 3006 after deterioration. 3201 designates a curve which shows the relation of the voltage between source and drain $V_{ds}$ and the drain current $I_d(I_{EL})$ of the driving TFT 3004 in a case that the gate voltage in FIG. 27B is $V_{gs2}$. Operating conditions (operating points) of the driving TFT 3004 and the EL element 3006 are determined by an intersection point of these two curves. In short, by the intersection point 3203*a* of the curve 3202*a* and the curve 3201 in the linear region shown in the figure, the operating conditions of the driving TFT 3004 and the EL element 3006 before deterioration of the EL element 3006 are determined. Also, by the intersection point 3203*b* of the curve 3202*b* and the curve 3201 in the linear region shown in the figure, the operating conditions of the driving TFT 3004 and the EL element 3006 after deterioration of the EL element 3006 are determined. The operating points 3203*a* and 3203*b* will be compared to each other.

In the pixel which was selected to be in a light emitting state, the driving TFT 3004 is in a state of ON. In this moment, a voltage between both electrodes of the EL element 3006 is $V_{A1}$. When the EL element 3006 is deteriorated and its I-V characteristic is changed, even if the voltage between both electrodes of the EL element 3006 is substantially the same as VA1, a flowing current is changed from $I_{EL1}$ to $I_{EL2}$. In short, since the current flowing through the EL element 3006 is changed from $I_{EL1}$ to $I_{EL2}$ by a level of deterioration of the EL element 3006 of each pixel, the light emission luminance is varied.

As a result, in a display device having a pixel of such a type that the driving TFT is made to be operated in the linear region, burn-in of an image tends to occur.

On the other hand, in the pixels of the current writing type shown in FIGS. 28 and 30A to 30D, the above-described burn-in of the image is reduced. This is because, in the pixel of the current writing type, the driving TFT operates so as to always flow substantially a constant current.

In the pixel of the current writing type, change of the operating point in a case that the I-V characteristic of the EL element, in the current writing type, is changed due to deterioration etc. will be described by use of the pixel of FIG. 28 as an example. FIG. 32 is a view showing the change of the operating point in the case that the I-V characteristic of the EL element is changed due to deterioration etc. In addition, in FIG. 32, same reference numerals are given to those portions which are the same as the corresponding portions of FIG. 28.

FIG. 32A is a view, for the purpose of simplicity, showing only the driving TFT 3303 and the EL element 3306 in FIG. 28. A voltage between a source and a drain of the driving TFT 3303 is shown by $V_{ds}$. A voltage between a cathode and an anode of the EL element 3306 is shown by $V_{EL}$. A current flowing through the EL element 3306 is shown by $I_{EL}$. The current $I_{EL}$ equals to the drain current $I_d$ of the driving TFT 3303. An electric potential of the power supply line 3005 is shown by $V_{dd}$. Also, an electric potential of a counter electrode of the EL element 3306 is assumed to be 0(V).

In FIG. 32B, 3701 designates a curve which shows the relation of the voltage between source and drain and the drain current of the driving TFT 3303. 3702*a* designates a curve which shows the I-V characteristic of the EL element 3306 before deterioration. On the other hand, 3702*b* designates a curve which shows the I-V characteristic of the EL element 3306 after deterioration. Operating conditions of the driving TFT 3004 and the EL element 3006 before deterioration of the EL element 3306 are determined by an intersection point 3703*a* of the curves 3702*a* and 3701. Operating conditions of the driving TFT 3303 and the EL element 3306 after deterioration of the EL element 3306 are determined by an intersection point 3703*b* of the curves 3702*b* and 3701. Here, the operating points 3703*a* and 3703*b* will be compared to each other.

In the pixel of the current writing type, the driving TFT 3303 operates in the saturation region. Before and after the EL element 3006 is deteriorated, the voltage between both electrodes of the EL element 3006 is changed from $V_{B1}$ to $V_{B2}$ but, the current flowing through the EL element 3006 is maintained to be $I_{EL1}$ which is substantially constant. In this manner, even if the EL element 3006 is deteriorated, the current flowing through the EL element 3006 is maintained to be substantially constant. Thus, the problem of the burn-in of the image is reduced.

However, in the conventional driving method of the current writing type, there is a necessity that electric charge corresponding to the signal current is held in the holding capacity of each pixel. The operation for holding a predetermined electric charge in the holding capacitor needs longer time as the signal current becomes smaller, because of an intersection capacitance etc. of a wiring through which the signal current flows. On that account, it is difficult to quickly write the signal current. Also, in case that the signal current is small, large is influence of a noise of a leak current etc. which occurs from a plurality of pixels connected to the same source signal line as that of the pixel to which writing of the signal current is carried out. Therefore, there is such a high risk that it is impossible for the pixel to emit light with accurate luminance.

Also, in the pixel having a current mirror circuit represented by the pixel shown in FIG. 30, it is desirable that a pair of TFTs which configure the current mirror circuit have same current characteristics. However, in reality, it is hard that the pair of these TFTs have completely the same current characteristics, and there occurs variation.

In the pixel shown in FIG. 30, threshold values of the driving TFT 2903 and the current TFT 2904 are $V_{tha}$, $V_{thb}$, respectively. When the threshold values $V_{tha}$, $V_{thb}$ of both transistors vary and an absolute value $|V_{tha}|$ of $V_{tha}$ has become smaller than an absolute value $|V_{thb}|$ of $V_{thb}$, a case of carrying out a black display will be considered. The drain current flowing through the current TFT 2903 is comparable to the current value $I_{video}$ determined by the video signal input current source 2912, and assumed to be 0. However, even if the drain current does not flow through the current TFT 2904, there is a possibility that a voltage of a level of slightly smaller than $|V_{thb}|$ is held in the holding capacitor 2905. Here, because of $|V_{thb}|>|V_{tha}|$, there is a possibility that the drain current of the driving TFT 2903 is not 0. Even in case that the black display is carried out, there is such a risk that the drain current flows through the driving TFT 2903 and the EL element 2906 emits light, and there occurs a problem that contrast comes down.

Further, in the conventional display device of the current writing type, the video signal input current source for inputting the signal current to each pixel is disposed with respect to each column (with respect to each pixel line). There is a necessity that current characteristics of those all video signal input current sources are made to be the same and a current value to be outputted is analogously changed with accuracy. However, in a transistor using polycrystalline semiconductors etc., since variation of characteristics of transistors is large, it is difficult to make the video signal input current source in which current characteristics are uniform. Thus, in the conventional display device of the current writing type, the video signal input current source is fabricated on a single crystalline IC substrate. On the other hand, it is general that as to a substrate on which the pixel is formed, it is fabricated on an insulation substrate such as glass etc. from the aspect of cost etc. Then, there is a necessity that a single crystalline IC substrate on which the video signal input current source is fabricated is attached over a substrate over which the pixel is formed. The display device of such structure has such problems that cost is high, and an area of a picture frame can not be reduced since large is an area which is required on the occasion of attachment of the single crystalline IC substrate.

In view of the above-described actual condition, the invention has a task to provide a display device in which a light emitting element can be made to emit light with constant luminance without coming under the influence of deterioration over time and a driving method thereof. Also, the invention provides a display device in which it is possible to carry out accurate gray scale expression, and also, it is possible to speed up writing of a video signal to each pixel, and influence of noise such as a leak current etc. is suppressed and a driving method thereof. Furthermore, the invention has a task to provide a display device which reduces an area of a picture frame and realizes miniaturization and a driving method thereof.

SUMMARY OF THE INVENTION

The invention took the following steps in order to solve the above-described tasks or problems.

Firstly, an out line of the invention will be described. Each pixel which is included in a display device of the invention has a plurality of switch parts and a plurality of current source circuits. One switch part and one current source circuit operates as a pair. Hereinafter, a set of one switch part and one current source circuit is called as PAIR. There exist a plurality of PAIRs in one pixel.

As to each of a plurality of the switch parts, ON or OFF thereof is selected by a digital video signal. When the switch part is turned ON (conductive), a current flows from the current source circuit which corresponds to the switch part to the light emitting element so that the light emitting element emits light. A current which is supplied from one current source circuit to the light emitting element is constant. According to the current rule of Kirchhoff, a value of a current which flows through the light emitting element is comparable to an added value of current values which are supplied from all current source circuits corresponding to the switch parts of conductive state to the light emitting element. In the pixel of the invention, the value of the current which flows through the light emitting element is changed by which switch part out of a plurality of the switch parts is turned conductive so that it is possible to express gray scale. On the other hand, the current source circuit is set to always output a constant current of a certain level. Therefore, it is possible to prevent variation of the current which flows through the light emitting element.

A structure of the pixel of the invention and its operation will be described by use of FIG. 1 which typically shows the structure of the pixel of the display device of the invention. In FIG. 1, the pixel has two current source circuits (in FIG. 1, a current source circuit a, a current source circuit b), two switch parts (in FIG. 1, a switch part a, a switch part b) and the light emitting element. In addition, FIG. 1 illustrates the example of the pixel in which there are two PAIRs of the switch part and the current source circuit in one pixel, but the number of pairs in one pixel may be the arbitrary number.

The switch part (switch part a, switch part b) has an input terminal and an out put terminal. To be conductive or non conductive between the input terminal and the output terminal of the switch part is controlled by the digital video signal. A state that the input terminal and the output terminal of the switch part are in a conductive state is called as that the switch part is turned ON. Also, a state that the input terminal and the output terminal of the switch part are in non conductive state is called as that the switch part is turned OFF. Each switch part is controlled with respect to ON state and OFF state by the corresponding digital video signal.

The current source circuit (current source circuit a, current source circuit b) has an input terminal and an output terminal, and has a function for having a constant current flowed between the input terminal and the output terminal. The current source circuit a is controlled to have the constant current $I_a$ flowed by a control signal a. Also, the current source circuit b is controlled to have the constant current $I_b$ flowed by a control signal b. The control signal may be a signal which is different from the video signal. Also, the control signal may be a current signal or may be a voltage signal. In this manner, an operation for determining a current which flows through the current source circuit by the control signal is called as a setting operation of a current source circuit or a setting operation of a pixel. Timing of carrying out the setting operation of the current source circuit may be synchronous with or may be asynchronous with the operation of the switch part, and can be set at arbitrary timing. Also, the setting operation may be carried out only to one current source circuit and information of the current source circuit to which the setting operation is carried out may be shared with other current source circuits. By the setting operation of the current source circuit, it is possible to suppress variation of current which the current source circuit outputs.

The light emitting element means an element which luminance is changed by current amount flowing between both electrodes thereof. As the light emitting element, cited are an EL (Electro-Luminescence) element, a FE(Field Emission) element and so on. But, even in case of using an arbitrary element which controls its state by a current, a voltage and so on, in lieu of the light emitting element, it is possible to apply the invention.

Out of two electrodes (anode and cathode) of the light emitting element gray scale electrode (first electrode) is electrically connected to the power supply line through the switch part a and the current source circuit a in sequence. Further, the first electrode is electrically connected to the power supply line thorough the switch part b and the current source circuit b in sequence. In addition, if it is such a circuit structure where a current defined by the current source circuit a does not flow between the light emitting elements, on the occasion that the switch part a is turned OFF, and a current defined by the current source circuit b does not flow between the light emitting elements, on the occasion of that the switch part b is turned OFF, the circuit structure is not limited to FIG. 1.

In the invention , one current source circuit and one switch part are paired up, and they are connected serially. In the pixel of FIG. 1, there are two sets of such pairs, and the two sets of pairs are connected in parallel with each other.

Then, an operation of the pixel shown in FIG. 1 will be described.

As shown in FIG. 1, in the pixel having two switch parts and two current source circuits, there exist three ways in total of paths of the current which is inputted to the light emitting element. A first path is a path through which a current supplied from either of two current source circuits is inputted to the light emitting element. A second path is a path through which a current supplied from another current source circuit being different from the current source circuit which supplies the current in the first path is inputted to the light emitting element. A third path is a path through which current is supplied from both two current source circuits to the light emitting element. In case of the third path, an added current of currents which are supplied from the respective current source circuits is to be inputted to the light emitting element.

Explaining more concretely, the first path is a path through which only the current $I_a$ flowing through the current source circuit a is inputted to the light emitting element. This path is selected in case that the switch part a is turned ON and the switch part b is turned OFF by the digital video signal a and the digital video signal b. The second path is a path through which only the current $I_b$ flowing through the current source circuit b is inputted to the light emitting element. This path is selected in case that the switch part a is turned OFF and the switch part b is turned ON by the digital video signal a and the digital video signal b. The third path is a path thorough which the added current $I_a+I_b$ of the current $I_a$ flowing through the current source circuit a and the current $I_b$ flowing through the current source circuit b is inputted to the light emitting element. This path is selected in case that both of the switch part a and the switch part b are turned ON by the digital video signal a and the digital video signal b. That is, since the current $I_a+I_b$ are made to flow through the light emitting element by the digital video signal a and the digital video signal b, it turns out that the pixel carries out the same operation as digital/analog conversion.

Subsequently, a basic technique for gray scale expression in the display device of the invention will be described. Firstly, a constant current which flows through each current source circuit is properly defined by the setting operation of the current source circuit. Each of the plurality of the current source circuits included in each pixel can set a current value different from those of the other current source circuits. Since the light emitting element emits light with luminance corresponding to a flowing current amount (current density), it is possible to set the luminance of the light emitting element by controlling which current source circuit the current is supplied from. Therefore, by selecting the path of the current which is inputted to the light emitting element, it is possible to select the luminance of the light emitting element from a plurality of luminance levels. In this manner, it is possible to select the luminance of the light emitting element of each pixel from a plurality of the luminance levels by the digital video signal. When all of the switch parts are turned OFF by the digital video signal, the luminance is regarded as to be 0 since no current is inputted to the light emitting element (which is hereinafter called as to select the non-light emitting state). In this manner, it is possible to express gray scale by changing the luminance of the light emitting element of each pixel.

However, only by the above-described method, there is a case that the number of gray scales is not sufficient. Then, in order to realize multiple gray scales, it is possible to combine it with other gray scale systems. Roughly categorizing, the there are two system.

A first one is a technique of combining with a time gray scale system. The time gray scale system is a method for expressing gray scale by controlling a period of light emission within a one frame period. The one frame period is comparable to a period for displaying one screen image. Concretely, one frame period is divided into a plurality of sub frame periods, and with respect to each sub frame period, a light emitting state or a non-light emitting state of each pixel is selected. In this manner, by the combination of the period in which the pixel emits light and the light emission luminance, the gray scale is expressed. A second one is a technique of combining with an area gray scale system. The area gray scale system is a method for expressing gray scale by changing an area of a light emitting portion in one pixel. For example, each pixel is configured by a plurality of sub pixels. Here, a structure of each sub pixel is the same as the pixel structure of the display device of the invention. In each sub pixel, the light emitting state or the non light emitting state is selected. In this matter, by the combination of the area of the light emitting portion of the pixel and the light emission luminance, the gray scale is expressed. In addition, the technique of combining with the time gray scale system and the technique of combining with the area gray scale system may be combined.

Then, an effective technique for further reducing the luminance variation in the above-described gray scale display technique will be shown. This is an effective technique in case that the luminance is varied due to, for example, noise etc. even when the same gray scale is intended to be expressed between the pixels.

Two or more current source circuits out of a plurality of current source circuits included in each pixel is set so as to output the same constant current. And, on the occasion of expressing the same gray scale, the current source circuits which output the same constant current are selectively used. In this case, even if the output current of the current source circuit is varied, the current flowing through the light emitting element is temporarily averaged. Therefore, it is possible to visually reduce the variation of the luminance due to the variation of the output currents of the current source circuits among respective pixels.

In the invention, since the current flowing through the light emitting element on the occasion of carrying out image display is maintained at a predetermined constant current, regardless of change of the current characteristic due to deterioration etc., it is possible to make the light emitting element emit light with constant luminance. Since ON or OFF state of the switch part is selected by the digital video signal and thereby, the light emitting state or the non light emitting state of each pixel is selected, it is possible to quicken the writing of the video signal to the pixel. In the pixel in which the non light emitting state is selected by the video signal, since the current to be inputted to the light emitting element is completely cut off by the switch part, it is possible to express accurate gray scale. In short, it is possible to solve the problem of contrast deterioration due to the leak current on the occasion of black display. Also, in the invention, since it is possible to set the current value of the constant current flowing through the current source circuit large to some extent, it is possible to reduce the influence of noise which occurs on the occasion of writing a small signal current. Further, since a driving circuit for changing current values flowing through the current source circuits disposed in each pixel is not necessary and an external driving circuit fabricated over a separate substrate such as a single crystalline IC substrate etc., it is possible to realize a lower cost and a smaller size.

BRIEF DESCRIPTION OF THE DRAWINGS

FIGS. 9A to 9F are views showing structures and driving methods of current source circuits of the pixels of the display device of the invention;

FIGS. 10A to 10E are views showing structures and driving methods of the current source circuits of the pixels of the display device of the invention;

FIGS. 11A to 11E are views showing structures and driving methods of the current source circuits of the pixels of the display device of the invention;

FIGS. 12A to 12F are views showing structures and driving methods of the current source circuits of the pixels of the display device of the invention;

FIGS. 13A to 13F are views showing structures and driving methods of the current source circuits of the pixels of the display device of the invention;

FIGS. 29A to 29D are views showing an operation of the pixel of the conventional display device;

DETAILED DESCRIPTION OF THE EMBODIMENTS

Embodiment 1

An embodiment of the invention will be described by use of FIG. 2. In this embodiment, a case that there are two PAIRs in one pixel will be described.

Figure 2A:
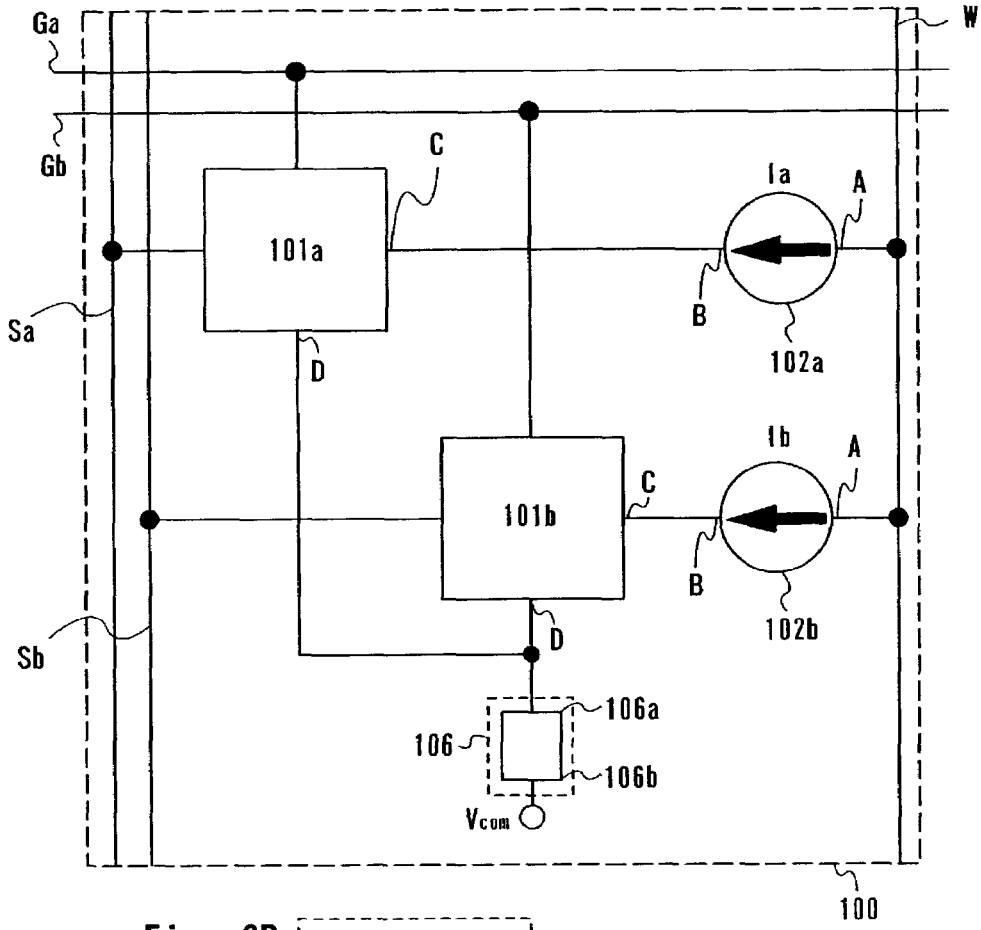
FIGS. 2A to 2C are schematic diagrams showing a structure of the pixel of the display device of the invention.

In FIG. 2A, each pixel 100 has switch parts 101*a* and 101*b*, current source circuits 102*a* and 102*b*, a light emitting element 106, video signal input lines Sa and Sb, scanning lines Ga and Gb, and a power supply line W. The switch part 101*a* and the current source circuit 102*a* are connected serially to form one PAIR. The switch part 102*b* and the current source circuit 102*b* are connected serially to form one pair. These two PAIRs are connected in parallel. Also, these two parallel circuits are serially connected to the light emitting element 106.

Figure 2B:
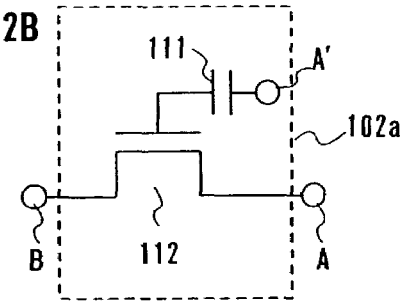

In the pixel shown in FIGS. 2A to 2C, two PAIRs are disposed but, hereinafter, paying attention to the PAIR of the switch part 101*a* and the current source circuit 102*a*, a structure of the current source circuit 102*a* and the switch part 101*a* will be described by use of FIGS. 2A to 2C.

Firstly, the current source circuit 102*a* will be described by use of FIG. 2A. In FIG. 2A, the current source circuit 102*a* is shown by a circle and an arrow in the circle. It is defined that a positive current flows in a direction of the arrow. Also, it is defined that an electric potential of a terminal A is higher than that of a terminal B. Then, a detail structure of the current source circuit 102*a* will be described by use of FIG. 2B. The current source circuit 102*a* has a current source transistor 112 and a current source capacitor 111. In addition, it is possible to omit the current source capacitor 111 by use of a gate capacitance of the current source transistor 112, etc. The gate capacitance is assumed to be a capacitance which is formed between a gate and a channel forming region of a transistor. A drain current of the current source transistor 112 becomes an output current of the current source circuit 102*a*. The current source capacitor 111 holds a gate electric potential of the current source transistor 112.

One of a source terminal and a drain terminal of the current source transistor 112 is electrically connected to a terminal A, and other is electrically connected to a terminal B. Also, a gate electrode of the current source transistor 112 is electrically connected to one electrode of the current source capacitor 111. The other electrode of the current source capacitor 111 is electrically connected to a terminal A'. In addition, the current source transistor 112 which configures the current source circuit 102*a* may be either of N channel type or of P channel type.

In case that a P channel type transistor is used as the current source transistor 112, its source terminal is electrically connected to the terminal A, and its drain terminal is electrically connected to the terminal B. Also, in order to hold a voltage between the gate and the source of the current source transistor 112, it is desirable that the terminal A' is electrically connected to the source terminal of the current source transistor 112. Thus, it is desirable that the terminal A' is electrically connected to the terminal A.

On the other hand, in case that an N channel type transistor is used as the current source transistor 112, the drain terminal of the current source terminal 112 is electrically connected to the terminal A, and the source terminal is electrically connected to the terminal B. Also, in order to hold the voltage between the gate and the source of the current source transistor 112, it is desirable that the terminal A' is electrically connected to the source terminal of the current source transistor 112. Thus, it is desirable that the terminal A' is electrically connected to the terminal B.

In addition, both in case that the P channel type transistor is used as the current source transistor 112 and in case that the N channel type transistor is used as the same, it is fine if the terminal A' is connected so that the electric potential of the gate electrode of the current source transistor 112 can be held. Thus, it may be fine even if the terminal A' is connected to a wiring which is held at a constant electric potential at least during a predetermined period. The predetermined period here means a period in which the current source circuit outputs a current, and a period in which the control current defining the current which is outputted by the current source circuit is inputted to the current source circuit.

In addition, in the embodiment 1, a case that the P channel type transistor is used as the current source transistor 112 will be described.

Subsequently, the switch part 101*a* will be described by use of FIG. 2A. The switch part 101*a* has a terminal C and a terminal D. The conductive state or the non conductive state between the terminal C and the terminal D is selected by the digital video signal. By selecting the conductive state or the non conductive state between the terminal C and the terminal D by the digital video signal, the current flowing through the light emitting element 106 is made to be changed. Here, to turn ON the switch part 101*a* means to select the conductive state between the terminal C and the terminal D. To turn OFF the switch part 101*a* means to select the non conductive state between the terminal C and the terminal D. Then, a detail structure of the switch part 101*a* will be described by use of FIG. 2C. The switch part 101*a* has a first switch 181, a second switch 182 and a holding unit 183.

Figure 2C:
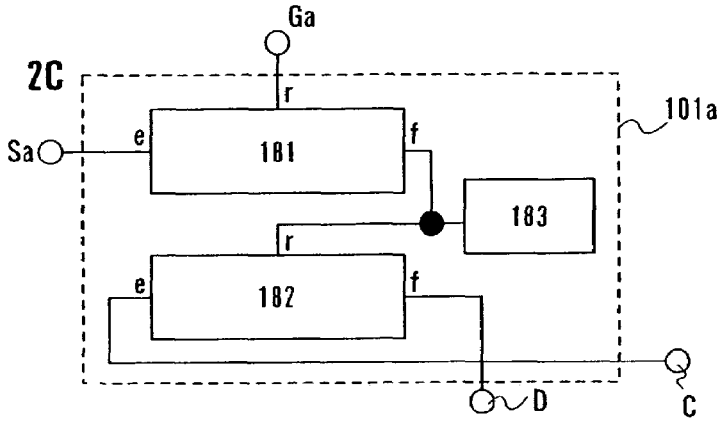

In FIG. 2C, the first switch 181 has a control terminal r, a terminal e, and a terminal f. In the first switch 181, by a signal which is inputted to the control terminal r, the conductive state or the non conductive state between the terminal e and the terminal f is selected. Here, a case that the terminal e and the terminal f are turned in the conductive state is called as that the first switch 181 is turned ON. Also, a case that the terminal e and the terminal f are turned in the non conductive state is called as that the first switch 181 is turned OFF. The same is applied to the second switch 182.

The first switch 181 controls an input of the digital video signal to the pixel. In short, by inputting a signal from the scanning line Ga to the control terminal r of the first switch 181, ON or OFF of the first switch 181 is selected.

When the first switch 181 is turned ON, the digital video signal is inputted from a video signal input line Sa to the pixel. The digital video signal inputted to the pixel is held in the holding unit 183. In addition, it is possible to omit the holding unit 183 by utilizing a gate capacitance etc. of a transistor which configures the second switch 182. Also, the digital video signal inputted to the pixel is inputted to the control terminal r of the second switch 182. In this manner, ON or OFF of the second switch 182 is selected. When the second switch 182 is turned ON, the terminal C and the terminal D are turned in the conductive state, and a current is supplied from the current source circuit 102*a* to the light emitting element 106. Even after the first switch 181 is turned OFF, the digital video signal continues to be held in the holding unit 183, and the ON state of the second switch 182 is held.

Then, a structure of the light emitting element 106 will be described. The light emitting element 106 has two electrodes (anode and cathode). The light emitting element 106 emits light with luminance corresponding to a current flowing between the two electrodes. Out of the two electrodes of the light emitting element 106, one is electrically connected to a power supply reference line (not shown). An electrode to which an electric potential Vcom is given by the power supply reference line is called as a counter electrode 106*b*, and the other electrode is called as a pixel electrode 106*a*.

As the light emitting element, an EL element which utilizes electroluminescence has been attracting much attention. The EL element is of a structure having an anode, a cathode, and an EL layer sandwiched between the anode and the cathode. By applying a voltage between the anode and the cathode, the EL element emits light. The EL layer may include an organic material, or may include an in organic material. Also, it may be formed by both of the organic material and the inorganic material. Also, it is assumed that the EL element includes one or both of an element utilizing light emission (fluorescence) from a singlet exciton and an element utilizing light emission (phosphorescence) from a triplet exciton.

Subsequently, a connecting relation of structural components of the pixel will be described by use of FIG. 2A. Again, the PAIR of the switch part 101*a* and the current source circuit 102*a* will be referred. The terminal A is electrically connected to the power supply line W, and the terminal B is electrically connected to the terminal C, and the terminal D is electrically connected to the pixel electrode 106*a* of the light emitting element 106. Through the light emitting element, a current flows in a direction from the pixel electrode 106*a* to the counter electrode 106*b*. The pixel electrode 106*a* is the anode, and the counter electrode 106*b* is the cathode. An electric potential of the power supply line W is set to be higher than the electric potential Vcom.

In addition, the connecting relation of the structural components of the pixel is not limited to the structure shown in FIG. 2A. It is fine if the switch part 110*a* and the current source circuit 102*a* are serially connected. Also, it is fine even if it is configured that the anode and the cathode of the light emitting element 106 are reversed. In short, it is fine even if it is configured that the pixel electrode 106*a* becomes the cathode and the counter electrode 106*b* becomes the anode. In addition, since it was defined that the positive current flows from the terminal A to the terminal B, in such the structure that the pixel electrode 106*a* is the cathode and the counter electrode 106*b* is the anode, realized is such a structure that the terminal A is counterchanged with the terminal B. That is, realized is such a structure that the terminal A is electrically connected to the terminal C of the switch part 101*a* and the terminal B is electrically connected to the power supply line W. An electric potential of the power supply line W is set to be lower than the electric potential Vcom.

In addition, in this embodiment, two PAIRs are disposed in each pixel. A structure of each pair is as described above, but there is a necessity of considering the following point as to a connection of these PAIRs. It is a point that summation of currents supplied from the respective current source circuits of the current source circuit 102*a* and the current source circuit 102*b* is made to be inputted to the light emitting element, in short, a point that the two PAIRs are connected in parallel and further serially connected to the light emitting element. In addition, it is desirable that a direction of current flow of the current source circuit 102*a* is the same as a direction of current flow of the current source circuit 102*b*. In short, it is desirable that added value of a positive current flowing through the current source circuit 102*a* and a positive current flowing through the current source circuit 102*b* flows through the light emitting element. By this configuration, it is possible to carry out the same operation as that of a conversion from a digital signal to an analog signal in the pixel.

Then, an outline of the operation of the pixel will be described. The conductive state or the non conductive state between the terminal C and the terminal D is selected by the digital video signal. The current source circuit is set to have a constant current flowed. A current supplied from the current source circuit is inputted to the light emitting element through the switch part in which the terminal C and the terminal D are turned in the conductive state. In addition, one digital video signal controls one switch part. Accordingly, since a plurality of PAIRs have a plurality of switch parts, a plurality of the switch parts are controlled by the corresponding digital video signals. A value of the current flowing through the light emitting element differs depending upon which switch part out of a plurality of the switch parts is turned ON. In this manner, by changing the current flowing through the light emitting element, gray scale is expressed and the image display is carried out.

Subsequently, the above-described operation of the pixel will be described in more detail. In the description, the PAIR of the switch part 101*a* and the current source circuit 102*a* is picked up as an example, and its operation will be described.

Firstly, an operation of the switch part 101*a* will be described. To the switch part 101*a*, a row selection signal is inputted from the scanning line Ga. A row selection signal is a signal for controlling a timing when the digital video signal is inputted to the pixel. Also, when the scanning line Ga is selected, the digital video signal is inputted to the pixel from the video signal input line Sa. In short, through the first switch 181 which is turned in the ON state, the digital video signal is inputted to the second switch 182. The ON state or the OFF state of the second switch 182 is selected by the digital video signal. Also, since the digital video signal is held in the holding unit 183, the ON state or the OFF state of the second switch 182 is held.

Then, an operation of the current source circuit 102*a* will be described. In particular, the operation of the current source circuit 102*a* on the occasion that the control signal is inputted will be described. By the control signal, a drain current of the current source transistor 112 is determined. A gate voltage of the current source transistor 112 is held by the current source capacitor 111. The current source transistor 112 operates in the saturation region. A drain current of a transistor which operates in the saturation region is maintained to be constant even if a voltage between a drain and a source is changed, provided that a gate voltage is the same. Accordingly, the current source transistor 112 outputs a constant current. In this manner, the current source circuit 102*a* has a constant current determined by the control signal flowed. A constant output current of the current source circuit 102*a* is inputted to the light emitting element. After the setting operation of the pixel is once carried out, the setting operation of the pixel is repeated in response to discharge of the current source capacitor 111.

An operation of each PAIR is as described above. In addition, in the display device of the invention, the digital video signal inputted to the switch part of each PAIR included in the pixel may be either the same or different. Also, the control signal inputted to the current source circuit of each PAIR may be the same, or may be different.

Embodiment 2

This embodiment shows a concrete structural example of the switch part of each PAIR included in a pixel in the display device of the invention. Also, an operation of the pixel which has the switch part will be described.

Figure 3:
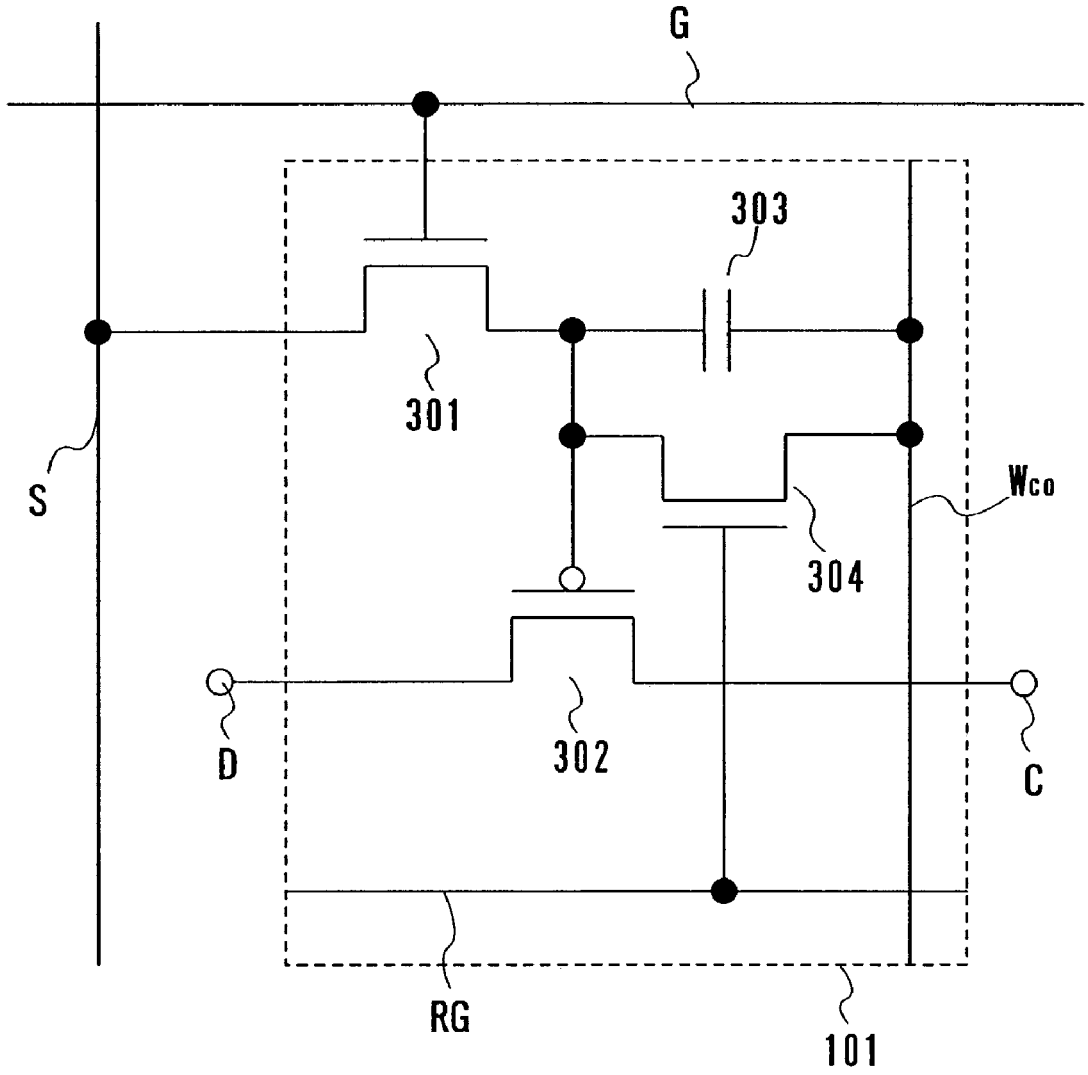
FIG. 3 is a view showing a structure of a switch part of the pixel of the display device of the invention.

A structural example of the switch part is shown in FIG. 3. A switch part 101 has a switching transistor 301, a driving transistor 302, a deleting transistor 304, and a holding capacitor 303. In addition, it is possible to omit the holding capacitor 303 by using a gate capacitance etc. of the driving transistor 302. A transistor which configures the switch part 101 may be a single crystalline transistor, or a polycrystalline transistor, or an amorphous transistor. Also, it may be a SOI transistor. It may be a bipolar transistor. It may be a transistor using an organic material, for example, a carbon nanotube.

A gate electrode of the switching transistor 301 is connected to a scanning line G. One of a source terminal and a drain terminal of the switching transistor 301 is connected to a video signal input line S, and the other is connected to a gate electrode of the driving transistor 302. One of a source terminal and a drain terminal of the driving transistor 302 is connected to the terminal C. The other is connected to the terminal D. One electrode of the holding capacitor 303 is connected to the gate electrode of the driving transistor 302, and the other electrode is connected to a wiring $W_{co}$. In addition, it is fine if the holding capacitor 303 can keep a gate electric potential of the driving transistor 302. Thus, an electrode which is connected to the wiring $W_{co}$ out of the electrodes of the holding capacitor 303 in FIG. 3 may be connected to other wiring in which a voltage is constant for at least a certain period than the wiring $W_{co}$. A gate electrode of the deleting transistor 304 is connected to a deleting signal line RG. One of a source terminal and a drain terminal of the deleting transistor 304 is connected to the gate electrode of the driving transistor 302, and the other is connected to the wiring $W_{co}$. In addition, since it is fine if the driving transistor 302 is turned OFF by having the deleting transistor 304 turned ON, there is no problem when connected to another than the wiring $W_{co}$.

Then, a basic operation of this switch part 101 will be described with reference to FIG. 3. When the switching transistor 301 is turned in the ON state by the row selection signal inputted to the scanning line G in a state that the deleting transistor 304 is not conductive, the digital video signal is inputted from the video signal input line S to the gate electrode of the driving transistor 302. The voltage of the inputted digital video signal is held in the capacitance 303. By the inputted digital video signal, the ON state or the OFF state of the driving transistor 302 is selected, and the conductive state or the non conductive state between the terminal C and the terminal D of the switch part 101 is selected. Next, when the deleting transistor 304 is turned ON, electric charges held in the holding capacitor 303 are discharged, and the driving transistor 302 is turned in the OFF state, and the terminal C and the terminal D of the switch part 101 are turned in the non conductive state. In addition, in the above-described operation, the switching transistor 301, the driving transistor 302 and the deleting transistor 304 work justs as switches. Thus, these transistors operate in the linear region in their ON states.

In addition, the driving transistor 302 may be operated in the saturation region. By operating the driving transistor 302 in the saturation region, it is possible to compensate a saturation region characteristic of the current source transistor 112. Here, the saturation region characteristic is assumed to indicate a characteristic in which a drain current is maintained to be constant voltage between a source and a drain. Also, to compensate the saturation region characteristic means to suppress increase of the drain current as the voltage between the source and the drain increases also in the current source transistor 112 which operates in the saturation region. In addition, in order to obtain the above-described advantages, the driving transistor 302 and the current source transistor 112 have to be of the same polarity.

The above-described advantages for compensating the saturation region characteristic will be hereinafter described. For example, a case that the voltage between the source and the drain of the current source transistor 112 increases will be watched. The current source transistor 112 and the driving transistor 302 are serially connected. Thus, by change of the voltage between the source and the drain of the current source transistor 112, an electric potential of the source terminal of the driving transistor 302 changes. When the voltage between the source and the drain of the current source transistor 112 increases, an absolute value of the voltage between the source and the drain of the driving transistor 302 gets smaller. Then, the I-V curve of the driving transistor 302 changes. A direction of this change is such a direction that the drain current decreases. In this case, the drain current of the current source transistor 112 which is serially connected to the driving transistor 302 is reduced. In the same manner, when the voltage between the source and the drain of the current source transistor decreases, the drain current of the current source transistor increases. By this means, it is possible to obtain the advantage that a current flowing through the current source transistor is maintained to be constant.

In addition, although watching one PAIR of the switch part, its basic operation was described, the same is true on an operation of other switch part. In case that each pixel has a plurality of PAIRs, scanning lines and video signal input lines are disposed depending on respective PAIRs.

Next, a technique of gray scale display will be described. In the display device of the invention, expression of gray scale is carried out by ON-OFF control of the switch part. For example, by setting a ratio of magnitude of the currents to be outputted by a plurality of the current source circuits included in each pixel at $2^0:2^1:2^2:2^3: \ldots$, it is possible to provide the pixels with a role of D/A conversion, and it becomes possible to express multiple gray scale. Here, when enough number of the PAIRs of the switch part and the current source circuit is provided in one pixel, it is possible to sufficiently express the gray scale by only control by them. In that case, since there is no necessity to operate combined with the time gray scale system to be described later, it is not needed to dispose the deleting transistor in each switch part.

Then, combining the above-described gray scale display technique with the time gray scale system, a technique for displaying further multiple gray scale will be described by use of FIGS. 3 and 4.

Figure 4:
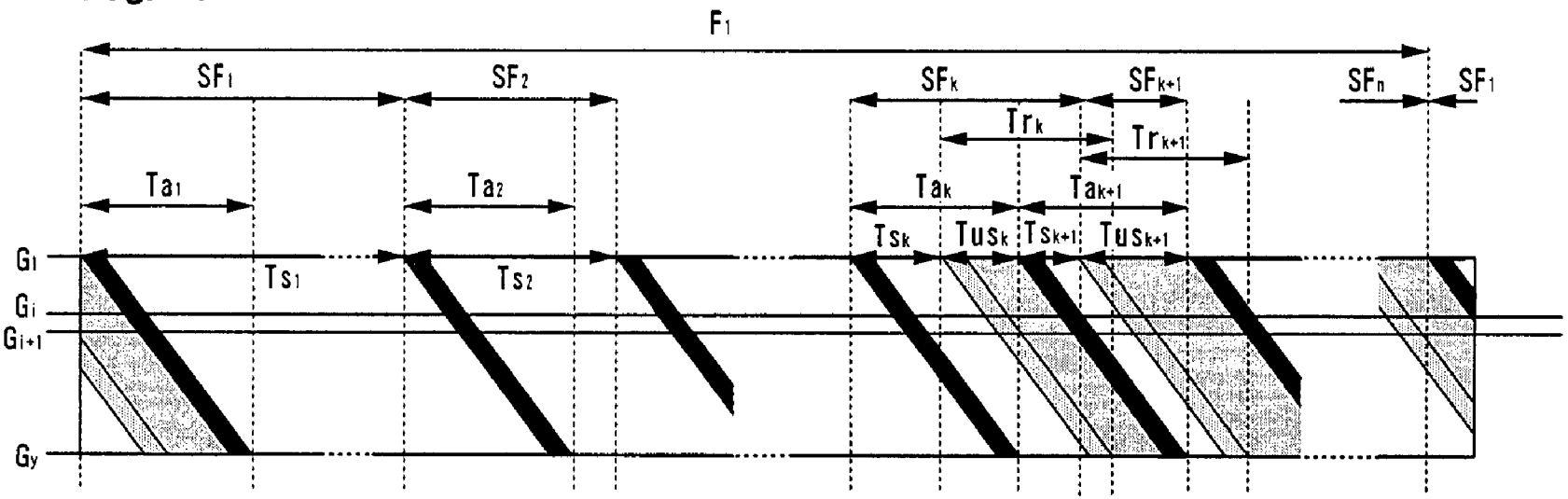
FIG. 4 is a view showing a driving method of the display device of the invention.

As shown in FIG. 4, one frame period $F_1$ is divided into a first sub frame periods $SF_1$ to an n-th sub frame period $SF_n$. In each sub frame period, the scanning line G of each pixel is selected in sequence. In the pixel corresponding to the selected scanning line G, the digital video signal is inputted from the video signal input line S. Here, a period in which the digital video signals are inputted to all pixels included in the display device is represented as an address period Ta. In particular, an address period which corresponds to a k-th (k is a natural number equal to or less than n) sub frame period is represented as $Ta_k$. By the digital video signal inputted in the address period, each pixel is turned in the light emission state or the non light emission state. This period is represented as a display period Ts. In particular, a display period which corresponds to the k-th sub frame period is represented as $Ts_k$. In FIG. 4, in each of the first sub frame period $SF_1$ to the (k−1)-th sub frame period $SF_{k-1}$, the address period and the display period are provided.

Since it is impossible to select the scanning lines G of different pixel rows simultaneously and to input the digital video signal thereto, it is impossible to geminate the address periods. Then, by using the following technique, it becomes possible to make the display period shorter than the address period without geminating the address periods.

After the digital video signal is written into each pixel and a predetermined display period passes off, the deleting signal lines RG are selected in sequence. A signal for selecting the deleting signal line is called as a deleting signal. When the deleting transistor 304 is turned ON by the deleting signal, it is possible to have the pixel rows turned in the non light emission state in sequence. By this means, all deleting signal lines RG are selected, and a period up to time when all pixels are turned in the non light emission state is represented as a reset period Tr. In particular, a reset period which corresponds to the k-th sub frame period is represented as $Tr_k$. Also, a period in which the pixels are uniformly turned in non light emission after the reset period Tr is represented as a non display period Tus. In particular, the non display period which corresponds to the k-th sub frame period is represented as $Tus_k$. By providing the reset period and the non display period, it is possible to have the pixel turned in the non light emission state before a next sub frame period starts. By this means, it is possible to set the display period which is shorter than the address period. In FIG. 4, in sub frame periods from the k-th sub frame period $SF_k$ to the n-th sub frame period $SF_n$, the reset period and the non display period are disposed, and the display periods $Ts_k$ to $Ts_n$ which are shorter than the address periods are set. Here, a length of the display period of each sub frame period can be determined properly.

By this means, the length of the display period in each sub frame period which configures one frame period is set. In this manner, the display device of the invention can realize the multiple gray scale by the combination with the time gray scale system.

Then, as compared to the switch part shown in FIG. 3, a structure which way of allocating the deleting transistor 304 is different, and a structure which is not provided with the deleting transistor 304 will be described. The same reference numerals and signs are given to the same portion as in FIG. 3, and the description thereof will be omitted.

Figure 5A:
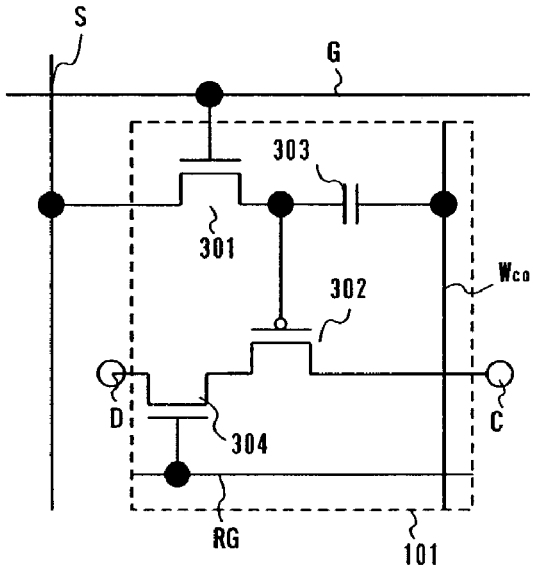
FIGS. 5A to 5D are views showing structures of the switch parts of the pixels of the display device of the invention.
Figure 35:
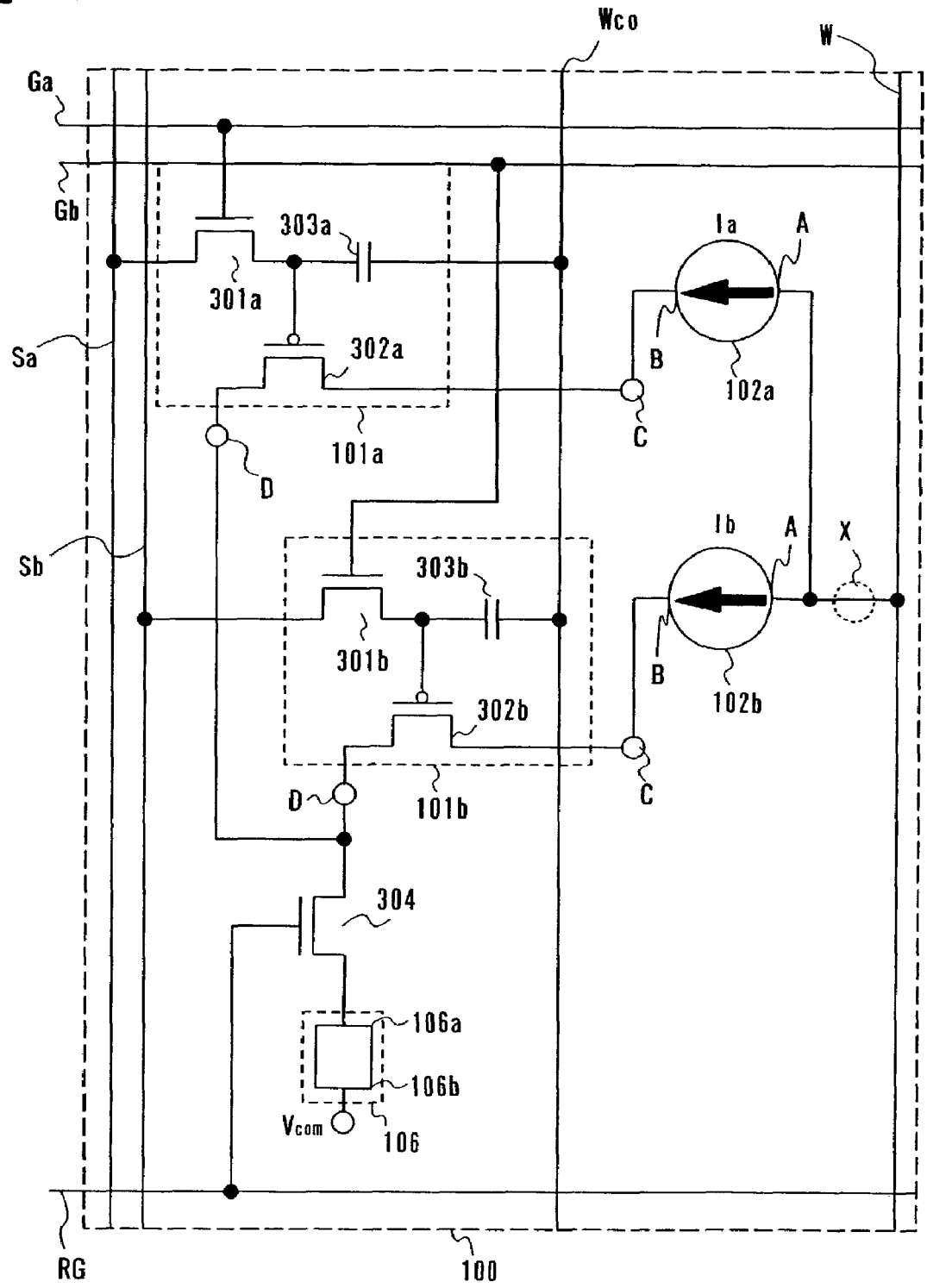
FIG. 35 is a view showing a structure of the pixel of the display device of the invention.

FIG. 5A shows one example of the switch part. In FIG. 5A, it is designed such that the deleting transistor 304 is serially placed on a path through which a current is inputted to the light emitting element, and by turning OFF the deleting transistor 304, the current is prevented from flowing through the light emitting element. In addition, if the deleting transistor 304 is serially placed on the path through which the current is inputted to the light emitting element, the deleting transistor 304 may be placed anywhere. By turning the deleting transistor in the OFF state, it is possible to have the pixels turned uniformly in the non light emission state. By this means, it is possible to set the reset period and the non display period. In addition, in case of the switch part of the structure shown in FIG. 5A, without disposing the deleting transistors 304 to respective switch parts of a plurality of the PAIRs included in the pixel, it is possible to dispose them in one part. By this means, it is possible to suppress the number of transistors in the pixel. FIG. 35 shows a structure of the pixel in case that the deleting transistor 304 is shared by a plurality of the PAIRs. In addition, here, an example of the pixel which has two pairs will be described but the invention is not limited to this. In FIG. 35, the same reference numerals and signs are given to the same portions as in FIGS. 2A and 3. In addition, a portion which corresponds to the switch portion 101*a* is represented by adding "a" after the reference numerals of FIG. 3. Also, a portion which corresponds to the switch portion 101*b* is represented by adding "b" after the reference numerals of FIG. 3. In FIG. 35, by turning OFF the deleting transistor 304, it is possible to simultaneously shut off both of the currents which are outputted from the current source circuit 102*a* and the current source circuit 102*b*.

In addition, the deleting transistor 304 shared by a plurality of the switch parts may be placed on a path for connecting the power supply line W and the current source circuits 102*a* and 102*b*. In short, the power supply line W and the current source circuits 102*a* and 102*b* may be connected through the deleting transistor 304 shared with a plurality of the switch parts. The deleting transistor 304 shared by a plurality of the switch parts may be disposed anywhere, if it is a position where both of the currents which are outputted from the current source circuit 102*a* and the current source circuit 102*b* are simultaneously shut off. For example, the deleting transistor 304 may be placed at a portion of a path X in FIG. 35. In short, it is fine if it is configured such that the power supply line W and the terminal A of the current source circuit 102*a* and the terminal A of the current source circuit 102*b* are connected by the deleting transistor 304.

Figure 5B:
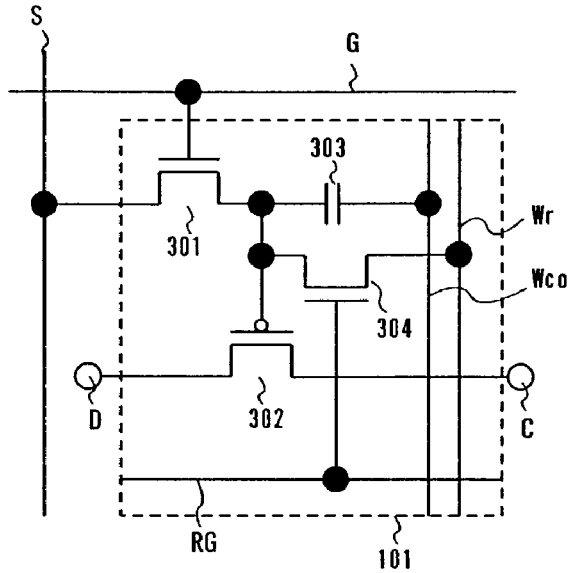

FIG. 5B shows another structure of the switch part. FIG. 5B shows a technique in which, through between the source and drain terminals of the deleting transistor 304, a predetermined voltage is applied to the gate electrode of the driving transistor 302 so that the driving transistor is turned in the OFF state. In this example, one of the source terminal and the drain terminal of the deleting transistor 304 is connected to the gate electrode of the driving transistor, and the other is connected to the wiring Wr. The electric potential of the wiring Wr is determined properly. By this means, it is designed that the driving transistor, to the gate electrode of which the electric potential of the wiring Wr is inputted through the deleting transistor, is turned in the OFF state.

Figure 5C:
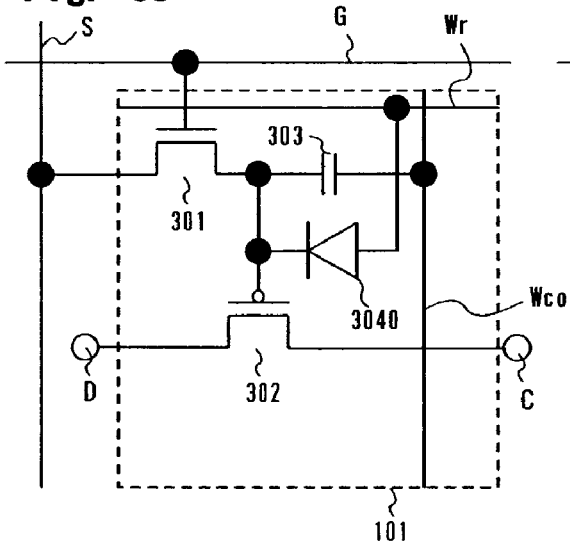

Also, in the structure shown in FIG. 5B, instead of the deleting transistor 304, a diode may be used. This structure is shown in FIG. 5C. The electric potential of the wiring Wr is changed. By this means, an electric potential of an electrode at the side which is not connected to the gate electrode of the driving transistor 302 out of the two electrodes of a diode 3040, is changed. By this means, the gate voltage of the driving transistor is changed and it is possible to have the driving transistor turned in the OFF state. In addition, the diode 3040 may be replaced with a diode-connected (a gate electrode and a drain terminal thereof are electrically connected) transistor. On this occasion, the transistor may be an N-channel type transistor or a P-channel type transistor.

Figure 5D:
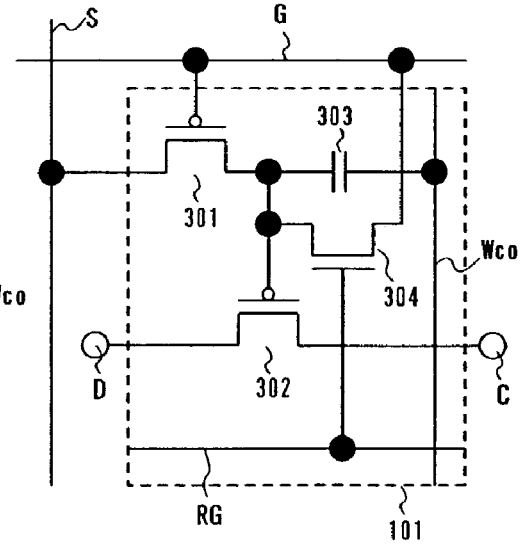

In addition, in lieu of the wiring Wr, the scanning line G may be used. FIG. 5D shows a structure where the scanning line G is used in lieu of the wiring Wr shown in FIG. 5B. But, in this case, there is a necessity to pay attention to a polarity of the switching transistor 301, taking the electric potential of the scanning line G into consideration.

Then, a technique in which the reset period and the non display period are provided without providing the deleting transistor will be described.

Figure 6A:
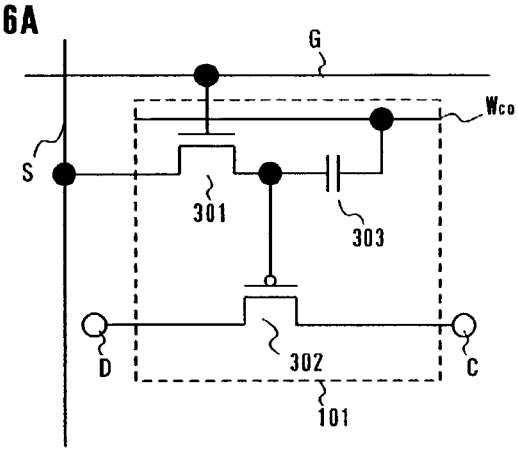
FIGS. 6A and 6B are views showing the structure of the switch part of the pixel

A first technique is a technique in which, by changing an electric potential of an electrode of the holding capacitor 303 at the side which is not connected to the gate electrode of the driving transistor 302, the driving transistor 302 is turned in the non conductive state. This structure is shown in FIG. 6A. The electrode of the holding capacitor 303 at the side which is not connected to the gate electrode of the driving transistor 302 is connected to the wiring $W_{co}$. By changing a signal of the wiring $W_{co}$, the electric potential of one electrode of the holding capacitor 303 is changed. Then, since electric charges in the holding capacitor is stored, an electric potential of the other electrode of the holding capacitor 303 is also changed. By this means, by changing the electric potential of the gate electrode of the driving transistor 302, it is possible to have the driving transistor 302 turned in the OFF state.

A second technique will be described. A period in which one scanning line G is selected is divided into a first half and a second half. It is characterized in that, in the first half (represented as a first half of a gate selection period), the digital video signal is inputted to the video signal input line S, and in the second half (represented as a second half of a gate selection period), the deleting signal is inputted to the video signal input line S. The deleting signal in this technique is assumed to be a signal for having the driving transistor 302 turned in the OFF state, on the occasion of being inputted to the gate electrode of the driving transistor 302. By this means, it becomes possible to set the display period which is shorter than a writing period. Hereinafter, this second technique will be described in detail.

Figure 6B:
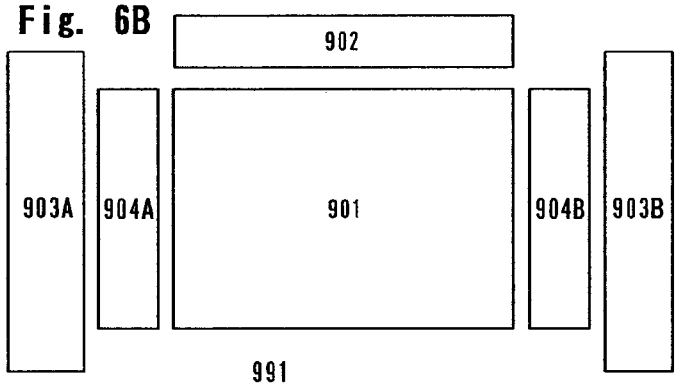

Firstly, a structure of the entire display device on the occasion of using the above-described technique will be described. FIG. 6B is used for the description. The display device has a pixel part 901 which has a plurality of pixels arranged in a matrix shape, a video signal input line driving circuit 902 which inputs a signal to the pixel part 901, a first scanning line driving circuit 903A, a second scanning line driving circuit 903B, a switching circuit 904A and a switching circuit 904B. Each pixel included in the pixel part 901 has a plurality of the switch parts 101 and the current source circuits as shown in FIG. 6A. Here, the first scanning line driving circuit 903A is assumed to be a circuit which outputs a signal to each scanning line G in the first half of the gate selection period. Also, the second scanning line driving circuit 903B is assumed to be a circuit which outputs a signal to each scanning line G in the second half of the gate selection period. By the switching circuit 904A and the switching circuit 904B, a connection of the first scanning line driving circuit 903A and the scanning line G of each pixel, or a connection of the second scanning line driving circuit 903B and the scanning line G of each pixel is selected. The video signal input line driving circuit 902 outputs the video signal in the first half of the gate selection period. On the other hand, it outputs the deleting signal in the gate selection period second half.

Figure 6C:
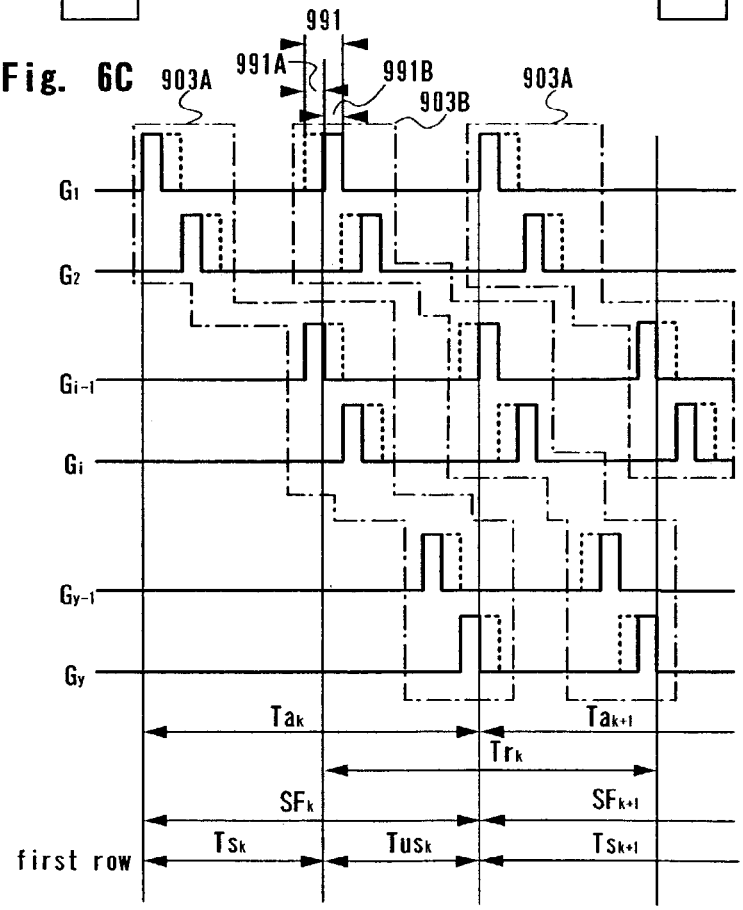
FIG. 6C is a driving method of the display device with the structure shown in FIGS. 6A and 6B of the invention.

Then, a driving method of the display device of the above-described structure will be described. A timing chart of FIG. 6C is used for the description. In addition, the same reference numerals and signs are given to the same portions as FIG. 4, and descriptions thereof will be omitted. In FIG. 6C, a gate selection period 991 is divided into a first half of a gate selection period 991A and a second half of a gate selection period 991B. In 903A which is comparable to the writing period Ta, each scanning line is selected by the first scanning line driving circuit, and the digital video signals are inputted. In 903B which is comparable to the reset period Tr, each scanning line is selected by the second scanning line driving circuit, and the deleting signal is inputted. By this means, it is possible to set the display period Ts which is shorter than the address period Ta.

In addition, in FIG. 6C, although the deleting signal is inputted in the second half of the gate selection period, instead of it, the digital video signal in the next sub frame period may be inputted.

A third technique will be described. The third technique is a technique in which, by changing an electric potential of the counter electrode of the light emitting element, a non display period is provided. In short, the display period is set in such a manner that the electric potential of the counter electrode has a predetermined electric potentials different form that of the power supply line. On the other hand, in the non display period, the electric potential of the counter electrode is set to be substantially the same as that of the power supply line. By this means, in the non display period, regardless of the digital video signal held in the pixel, it is possible to have the pixels turned uniformly in the non light emission state. In addition, in this technique, in the non display period, the digital video signal is inputted to all pixels. That is, the address period is provided in the non display period.

In the pixel having the switch parts of the above-described structure, each wiring can be shared. By this means, it is possible to simplify the structure of the pixel, and also to enlarge an aperture ratio of the pixel. Hereinafter, an example of sharing each wiring will be described. In the description, an example that in the structure in which the switch part having the structure shown in FIG. 3 is applied to the pixel shown in FIG. 2, the wiring is shared, is used. In addition, the following structure can be freely applied to a switch part having the structure shown in FIG. 5 and FIG. 6.

Hereinafter, the sharing of the wiring will be described. Six examples of sharing the wiring will be cited. In addition, FIG. 7 and FIG. 8 are used for the description. In FIG. 7 and FIG. 8, the same reference numerals and signs are given to the same portions as in FIG. 2 and FIG. 3, and the descriptions thereof will be omitted.

Figures 7A, 7B, 7C:
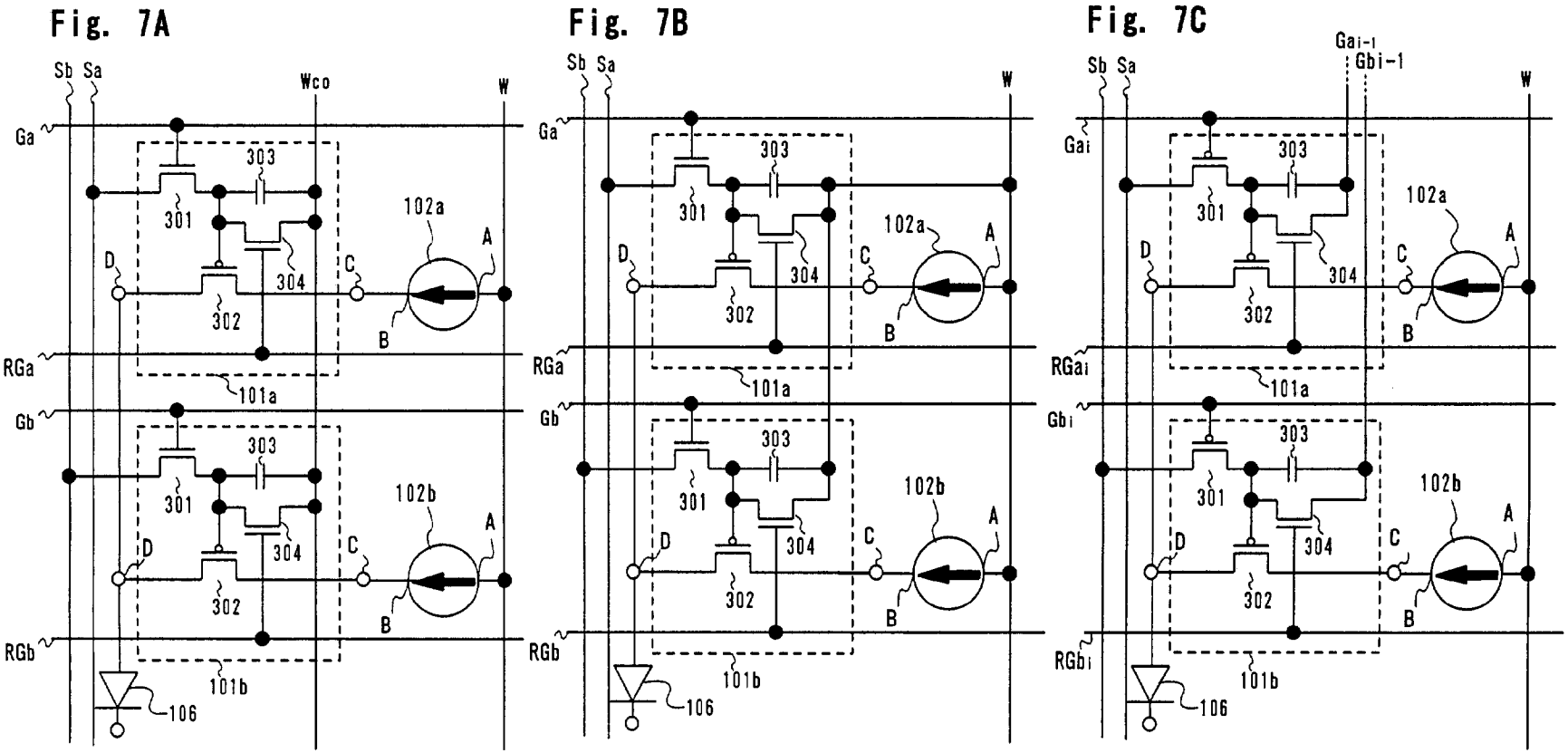
FIGS. 7A to 7C are views showing structures of the pixels of the display device of the invention.
Figure 8A:
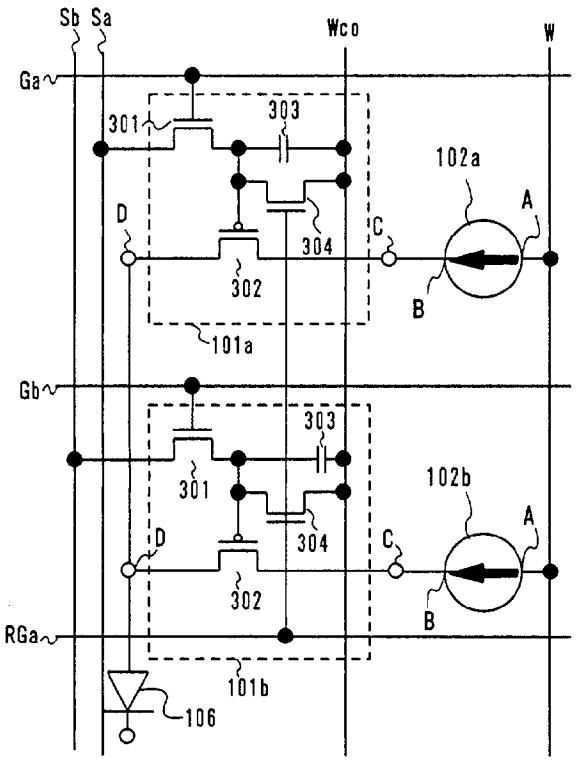
FIGS. 8A to 8C are views showing structures of the pixels of the display device of the invention.
Figure 8B:
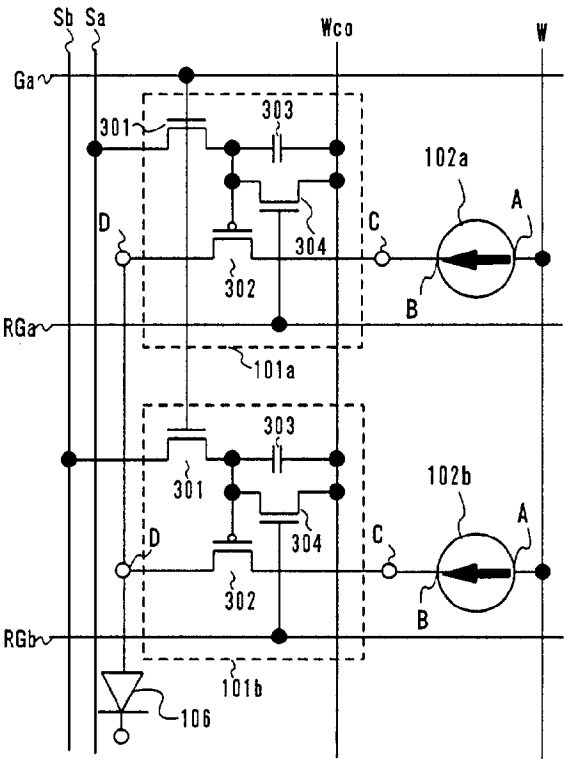
Figure 8C:
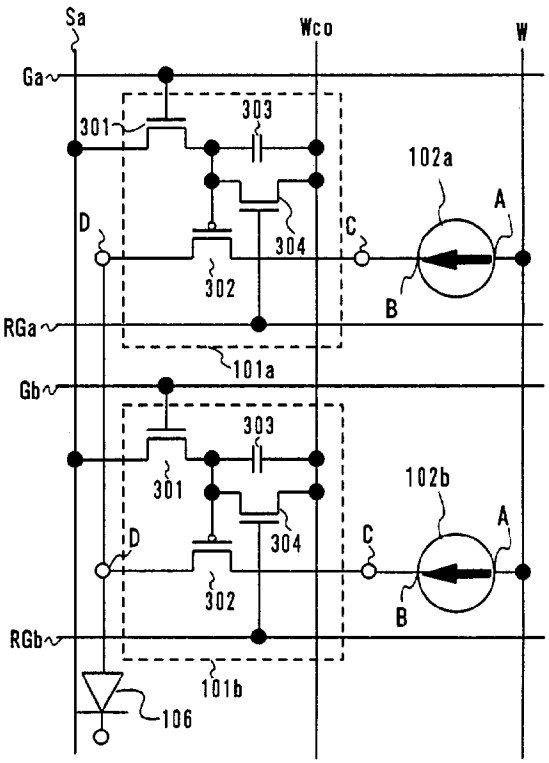

FIG. 7A shows an example of a structure of the pixel in which the wiring $W_{co}$ is shared by a plurality of the switch parts. FIG. 7B shows an example of a structure of the pixel in which the wiring $W_{co}$ and the power supply line W are common. FIG. 7C shows an example of a structure of the pixel using the scanning line in other pixel row in lieu of the wiring $W_{co}$. The structure of FIG. 7C utilizes a fact that the electric potentials of the scanning lines Ga, Gb are maintained to be constant electric potential, during a period in which the writing of the video signal is not carried out. In FIG. 7C, in lieu of the wiring $W_{co}$, the scanning lines $Ga_{i-1}$ and $Gb_{i-1}$ in the one previous pixel row are used. But, in this case, there is a necessity to pay attention on the polarity of the switching transistor 301, taking the electric potentials of the scanning lines Ga, Gb into consideration. FIG. 8A shows an example of a structure of the pixel which shared a signal line RGa and a signal line RGb. This is because the first switch part and the second switch part may be turned OFF at the same time. The shared signal lines are represented by RGa all together. FIG. 8B shows an example of a structure of the pixel in which the scanning line Ga and the scanning line Gb are common. This structure is due to the fact that both the first switch part and the second switch part may be OFF simultaneously. The common scanning line are represented by Ga. FIG. 8C shows an example of a structure of the pixel in which the video signal input line Sa and the video signal input line Sb are common. The common video signal input line is represented by Sa.

It is possible to combine FIGS. 7A to 7C with FIGS. 8A to 8C. In addition, the invention is not limited to this, and the wirings which configure the pixel can be properly common. Also, wirings between the pixels can be properly common.

In addition, it is possible to freely combine this embodiment with the embodiment 1 to be carried out.

Embodiment 3

In this embodiment, a structure and an operation of the current source circuit included in each pixel of the display device of the invention will be described in detail.

The current source circuit of one PAIR out of a plurality of PAIRs included in each pixel will be watched, and a structure thereof will be described in detail. In this embodiment, although five structural examples of the current source circuit will be cited, another structural example may be fine if it is a circuit which operates as a current source. In addition, a transistor which configures the current source circuit may be a single crystalline transistor, a polycrystalline transistor, or an amorphous transistor. Also, it may be a SOI transistor. It may be a bi-polar transistor. It may be a transistor using an organic material, for example, a carbon nanotube.

Firstly, a current source circuit of a first structure will be described by use of FIG. 9A. In addition, in FIG. 9A, the same reference numerals and signs are given to the same portions as in FIG. 2.

The current source circuit of the first structure shown in FIG. 9A has the current source transistor 112, and a current transistor 1405 which is paired with the current source transistor 112 to configures a current mirror circuit. It has a current input transistor 1403, which functions as switch, and a current holding transistor 1404. Here, the current source transistor 112, the current transistor 1405, the current input transistor 1403, and the current holding transistor 1404 may be of the P-channel type or of the N-channel type. However, it is desirable that polarities of the current source transistor 112 and the current transistor 1405 are the same. Here, shown an example in which the current source transistor 112 and the current transistor 1405 are P-channel type transistors. Also, it is desirable that current characteristics of the current source transistor 112 and the current transistor 1405 are the same. It has the current source capacitor 111 which holds the gate voltages of the current source transistor 112 and the current transistor 1405. In addition, by positively using a gate capacitance etc. of a transistor, it is possible to omit the current source capacitor 111. Further, it has a signal line GN which inputs a signal to a gate electrode of the current input transistor 1403 and a signal line GH which inputs a signal to a gate electrode of the current holding transistor 1404. Also, it has a current line CL to which the control signal is inputted.

Figure 36:
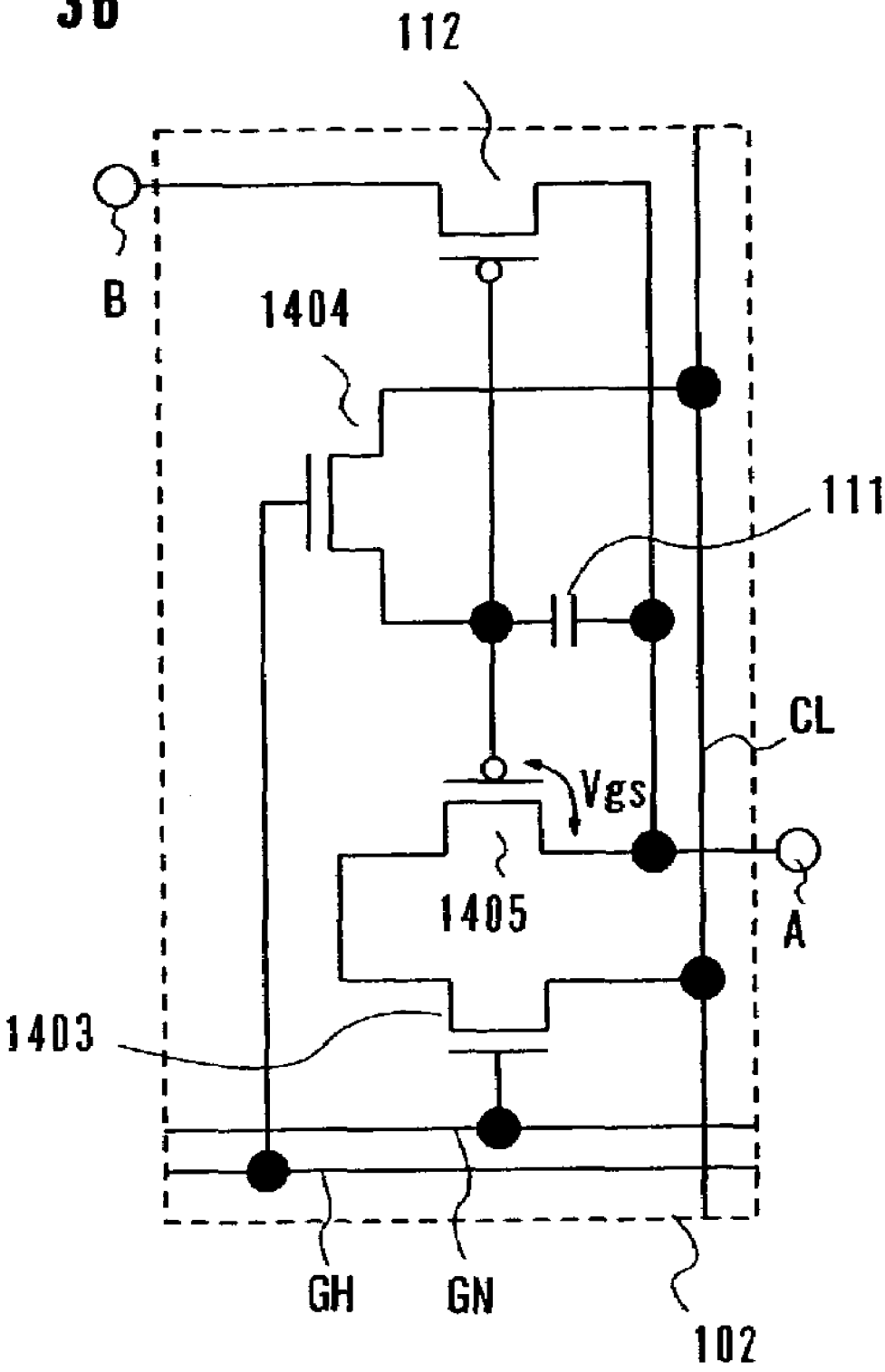
FIG. 36 is a view showing a structure of the current source circuit of the pixel of the display device of the invention.

A connecting relation of these structural components will be described. The gate electrodes of the current source transistor 112 and the current transistor 1405 are connected. The source terminal of the current source transistor 112 is connected to the terminal A and the drain terminal is connected to the terminal B. One electrode of the current source capacitor 111 is connected to the gate electrode of the current source transistor 112, and the other electrode is connected to the terminal A. A source terminal of the current transistor 1405 is connected to the terminal A, and a drain terminal is connected to the current line CL through the current input transistor 1403. Also, a gate electrode and a drain terminal of the current transistor 1405 are connected through the current holding transistor 1404. A source terminal or a drain terminal of the current holding transistor 1404 is connected to the current source capacitor 111 and the drain terminal of the current transistor 1405. However, it may be configured that a side which is one of the source terminal and the drain terminal of the current holding transistor 1404 and is not connected to the current source capacitor 111 is connected to the current line CL. This structure is shown in FIG. 36. In addition, in FIG. 36, the same reference numerals and signs are given to the same portions as in FIG. 9A. With this structure, by adjusting an electric potential of the current line CL when the current holding transistor 1404 is in the OFF state, it is possible to lessen the voltage between the source and drain terminals of the current holding transistor 1404. As a result, it is possible to lessen an OFF current of the current holding transistor 1404. By this means, it is possible to lessen a leakage of an electric charge from the current source capacitor 111.

Figure 33A:
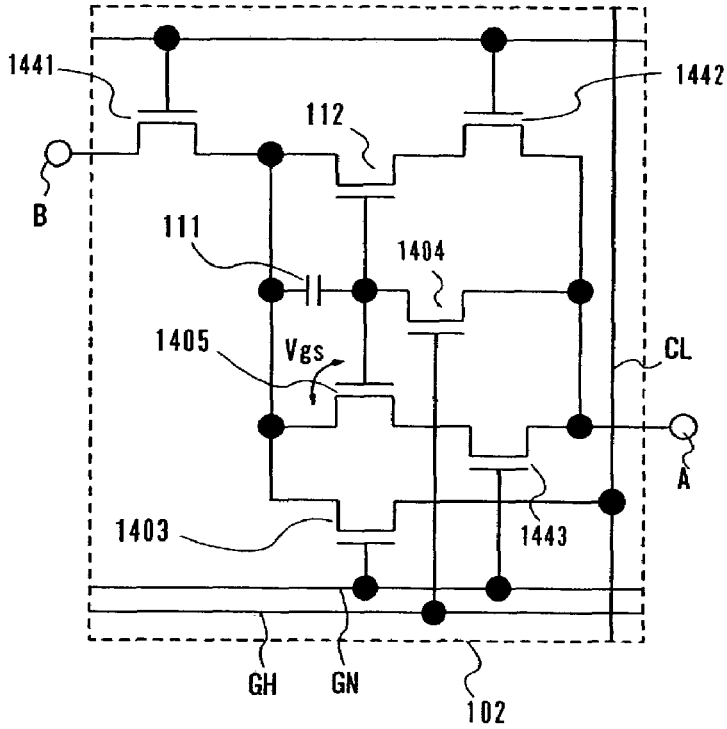
FIGS. 33A and 33B are views showing structures of current source circuits of the pixels of the display device of the invention.

Also, an example in case that the current source transistor 112 and the current transistor 1405 are set to be N-channel type transistors in the structure of the current source circuit shown in FIG. 9A is shown in FIG. 33A. In addition, in contrast to the current source circuit of the structure shown in FIG. 9A, in the current source circuit of the structure shown in FIG. 33A, there is a necessity to dispose transistors 1441 and 1442, in order to prevent the current flowing between the current line CL and the terminal A through the source and the drain of the current transistor 1405 on the occasion of the setting operation of the current source circuit 102 from flowing between the source and the drain of the current source transistor 112 and through the terminal B. Also, there is a necessity to dispose a transistor 1443, in order to prevent a current from flowing between the source and the drain of the current transistor 1405 on the occasion that a constant current is made to flow between the terminal A and the terminal B in the display operation. By this means, the current source circuit 102 can output a current of a predetermined current value accurately.

Also, in the circuit of the structure shown in FIG. 9A, it is possible to configure the circuit structure as shown in FIG. 9B, by changing a location of the current holding transistor 1404. In FIG. 9B, the gate electrode of the current transistor 1405 and one electrode of the current source capacitor 111 are connected through the current holding transistor 1404. In this moment, the gate electrode and the drain terminal of the current transistor 1405 are connected by wiring.

Then, the setting operation of the current source circuit of the above-described first structure will be described. In addition, the setting operation in FIG. 9A is the same as that in FIG. 9B. Here, the circuit shown in FIG. 9A is picked up as an example, and its setting operation will be described. FIGS. 9C to 9F are used for the description. In the current source circuit of the first structure, the setting operation is carried out by going through states of FIGS. 9C to 9F in sequence. In the description, for the purpose of simplicity, the current input transistor 1403 and the current holding transistor 1404 are represented as switches. Here, shown is a case that a control signal for setting the current source circuit 102 is the control current. Also, in the figure, a path through which a current flows is shown by a heavy-line arrow.

In a period TD1 shown in FIG. 9C, the current input transistor 1403 and the current holding transistor 1404 are turned in the ON state. In this stage, the voltage between the source and the gate of the current transistor 1405 is small, and the current transistor 1405 is OFF, and therefore, a current flows from the current line CL through the path shown and electric charges are held in the current source capacitor 111.

In a period TD2 shown in FIG. 9D, by the electric charges held in the current source capacitor 111, the voltage between the gate and the source of the current transistor 1405 becomes more than a threshold voltage. Then, a current flows through between the source and the drain of the current transistor 1405.

When sufficient time passes and a steady state is realized, as in a period TD3 shown in FIG. 9E, a current flowing between the source and the drain of the current transistor 1405 becomes the control current. By this means, the gate voltage on the occasion that the drain current is set at the control current is held in the current source capacitor 111.

In a period TD4 shown in FIG. 9F, the current holding transistor 1404 and the current input transistor 1403 are turned OFF. By this means, the control current is prevented from flowing through the pixel. In addition, it is desirable that a timing that the current holding transistor 1404 is turned OFF, as compared to a timing that the current input transistor 1403 is turned OFF, is earlier or simultaneous. This is because of preventing the electric charges held in the current source capacitor 111 from being discharged. After the period TD4, when a voltage is applied between the source and drain terminals of the current source transistor 112, the drain current corresponding to the control current flows. In short, when a voltage is applied between the terminal A and the terminal B, the current source circuit 102 outputs a current which corresponds to the control current.

Here, a ratio W1/L1 of a channel width and a channel length of the current source transistor 112 may be changed relative to a ratio W2/L2 of a channel width and a channel length of the current transistor 1405. By this means, it is possible to change a current value of a current that the current source circuit 102 outputs, relative to the control current which is inputted to the pixel. For example, each transistor is designed in such a manner that the control current to be inputted to the pixel becomes larger than the current that the current source circuit 102 outputs. By this means, by use of the control current of large current value, the setting operation of the current source circuit 102 is carried out. As a result, it is possible to speed up the setting operation of the current source circuit. Also, it is effective for reduction of influence of noise.

By this means, the current source circuit 102 outputs a predetermined current.

In addition, in the current source circuit of the above-described structure, in case that a signal is inputted to the signal line GH and the current holding transistor is in the ON state, the current line CL has to be set in such a manner that a constant current always flow through it. This is because, in a period in which a current is not inputted to the current line CL, when both of the current holding transistor 1404 and the current input transistor 1403 are turned in the ON state, the electric charges held in the current source capacitor 111 are discharged. On that account, in case that a constant current is selectively inputted to a plurality of the current lines CL corresponding to all pixels and the setting operation of the pixel is carried out, in short, in case that the constant current is not always inputted to the current line CL, the current source circuit of the following structure will be used.

Figure 33B:
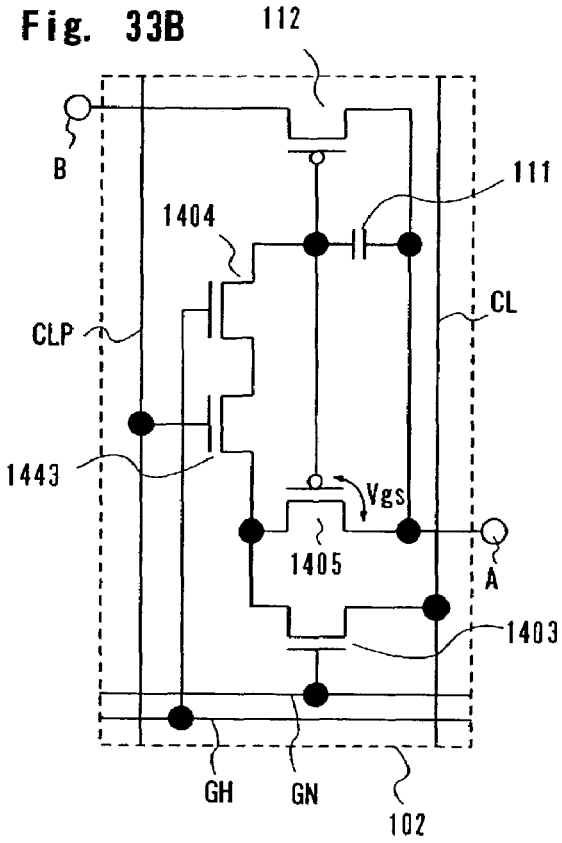

In the current source circuit shown in FIG. 9A and FIG. 9B, added is a switching element for selecting a connection of the gate electrode and the drain terminal of the current source transistor 112. ON or OFF of this switching element is selected by a signal which is different from a signal to be inputted to the signal line GH. FIG. 33B shows one example of the above-described structure. In FIG. 33B, a point sequential transistor 1443 and a point sequential line CLP are disposed. By this means, an arbitrary pixel is selected one by one, and a constant current is made to be inputted at least to the current line CL of the selected pixel, and thereby, the setting operation of the pixel is carried out.

Each signal line of the current source circuit of the first structure can be common. For example, in the structure shown in FIG. 9A, FIG. 9B and FIG. 33, there is no problem in operation if the current input transistor 1403 and the current holding transistor 1404 are switched to be ON or OFF at the same timing. On that account, polarities of the current input transistor 1403 and the current holding transistor 1404 are made to be the same, and the signal line GH and the signal line GN can be common.

Then, a current source circuit of a second structure will be described. In addition, FIG. 10 is referred for the description. In FIG. 10A, the same reference numerals and signs are given to the same portions as in FIG. 2.

Structural components of the current source circuit of the second structure will be described. The current source circuit of the second structure has the current source transistor 112. Also, it has a current input transistor 203 and a current holding transistor 204, and a current stop transistor 205 which function as switches. Here, the current source transistor 112, the current input transistor 203, the current holding transistor 204, and the current stop transistor 205 may be of the P-channel type or of the N-channel type. Here is shown an example that the current source transistor 112 is a P channel type transistor. Further, it has the current source capacitor 111 for holding the gate electrode of the current source transistor 112. In addition, by positively using a gate capacitance etc. of a transistor, it is possible to omit the current source capacitor 111. Further, it has a signal line GS which inputs a signal to a gate electrode of the current stop transistor 205 and a signal line GH which inputs a signal to a gate electrode of the current holding transistor 204 and a signal line GN which inputs a signal to the gate electrode of the current input transistor 203. Also, it has a current line CL to which the control signal is inputted.

A connecting relation of these structural components will be described. The gate electrodes of the current source transistor 112 is connected to one of the electrodes of the current source capacitor 111. The other electrode of the current source capacitor 111 is connected to the terminal A. The source terminal of the current source transistor 112 is connected to the terminal A. The drain terminal of the current source transistor 112 is connected to the terminal B through the current stop transistor 205, and also, connected to the current line CL through the current input transistor 203. The gate electrode and the drain terminal of the current source transistor 112 are connected through the current holding transistor 204.

Figure 34A:
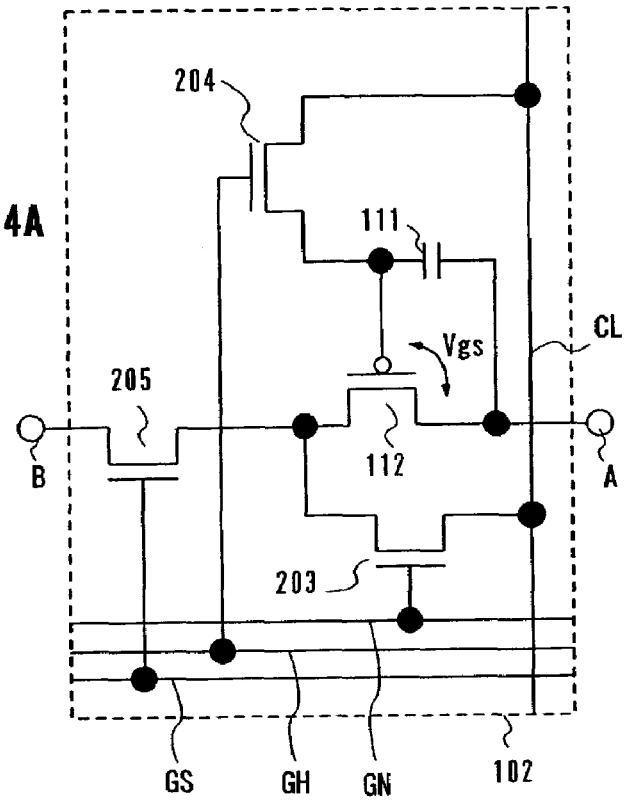
FIGS. 34A and 34B are views showing the structures of the current source circuits of the pixels of the display device of the invention.

In addition, in the structure shown in FIG. 10A, the source terminal or the drain terminal of the current holding transistor 204 is connected to the current source capacitor 111 and the drain terminal of the current source transistor 112. However, it may be configured that a side of the current holding transistor 204 which is not connected to the current source capacitor 111 is connected to the current line CL. The above-described structure is shown in FIG. 34A. With this structure, by adjusting an electric potential of the current line CL when the current holding transistor 204 is in the OFF state, it is possible to lessen the voltage between the source and drain terminals of the current holding transistor 204. As a result, it is possible to lessen the OFF current of the current holding transistor 204. By this means, it is possible to lessen the leakage of the electric charges from the current source capacitor 111.

Then, the setting operation of the current source circuit of the second structure shown in FIG. 10A will be described. FIGS. 10B to 10E are used for the description. In the current source circuit of the second structure, the setting operation is carried out by going through states of FIGS. 10B to 10E in sequence. In the description, for the purpose of simplicity, the current input transistor 203, the current holding transistor 204 and the current stop transistor 205 are represented as switches. Here, shown is a case that a control signal for setting the current source circuit 102 is the control current. Also, in the figure, a path through which a current flows is shown by a heavy-line arrow.

In a period TD1 shown in FIG. 10B, the current input transistor 203 and the current holding transistor 204 are turned in the ON state. Also, the current stop transistor 205 is in the OFF state. By this means, a current flows from the current line CL through the path shown and electric charges are held in the current source capacitor 111.

In a period TD2 shown in FIG. 10C, by the electric charges held, the voltage between the gate and the source of the current source transistor 112 becomes more than a threshold voltage. Then, the drain current flows through the current source transistor 112.

When sufficient time passes and a steady state is realized, as in a period TD3 shown in FIG. 10D, the drain current of the current source transistor 112 is determined as the control current. By this means, the gate voltage of the current source transistor 112 on the occasion that the drain current is set at the control current is held in the current source capacitor 111.

In a period TD4 shown in FIG. 10E, the current input transistor 203 and the current holding transistor 204 are turned in the OFF state. By this means, the control current is prevented from flowing through the pixel. In addition, it is desirable that a timing that the current holding transistor 204 is turned OFF, as compared to a timing that the current input transistor 203 is turned OFF, is earlier or simultaneous. This is because of preventing the electric charges held in the current source capacitor 111 from being discharged. Furthermore, the current stop transistor 205 is turned in the ON state. After the period TD4, when a voltage is applied between the source and drain terminals of the current source transistor 112, the drain current corresponding to the control current flows. In short, when a voltage is applied between the terminal A and the terminal B, the current source circuit 102 has the drain current corresponding to the control circuit flowed. By this means, the current source circuit 102 outputs a predetermined current.

In addition, the current stop transistor 205 is not indispensable. For example, in case that the setting operation is carried out only when at least one of the terminal A and the terminal B is in an opened state, the current stop transistor 205 is not necessary. Concretely, in the current source circuit which carries out the setting operation only in case that the switch part making the pair is in the OFF state, the current stop transistor 205 is not necessary.

Also, in the current source circuit of the above-described structure, in case that a signal is inputted to the signal line GH and the current holding transistor 204 is in the ON state, the current line CL has to be set in such a manner that a constant current always flows through it. This is because, in a period in which a current is not inputted to the current line CL, when both of the current holding transistor 204 and the current input transistor 203 are turned in the ON state, the electric charges held in the current source capacitor 111 are discharged. On that account, in case that a constant current is selectively inputted to a plurality of the current lines CL corresponding to all pixels and the setting operation of the pixel is carried out, in short, in case that the constant current is not always inputted to the current line CL, the current source circuit of the following structure will be used.

Figure 34B:
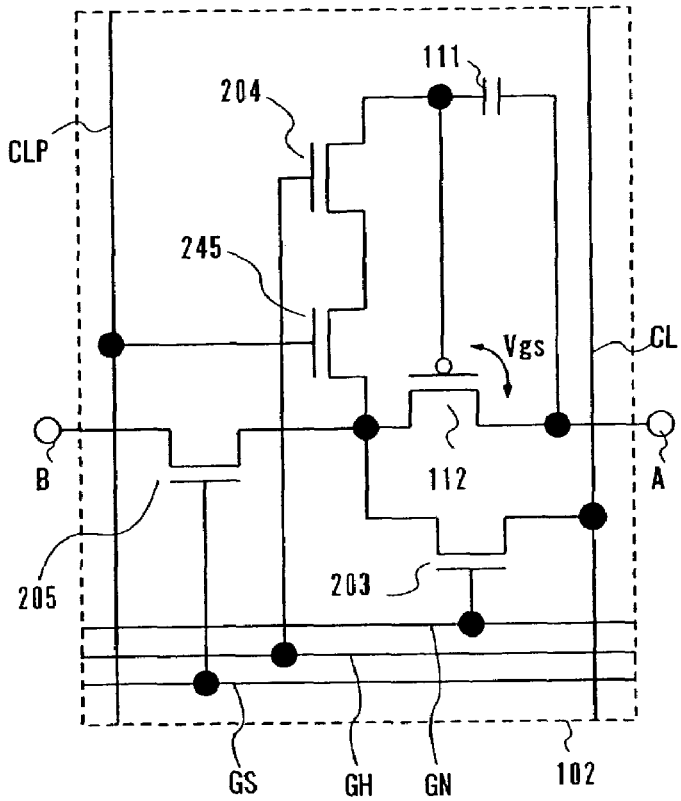

Added is a switching element for selecting a connection of the gate electrode and the drain terminal of the current source transistor 112. ON or OFF of this switching element is selected by a signal which is different from a signal to be inputted to the signal line GH. FIG. 34B shows one example of the above-described structure. In FIG. 34B, a point sequential transistor 245 and a point sequential line CLP are disposed. By this means, an arbitrary pixel is selected one by one, and a constant current is made to be inputted at least to the current line CL of the selected pixel, and thereby, the setting operation of the pixel is carried out.

Each signal line of the current source circuit of the second structure can be shared. For example, there is no problem in operation if the current input transistor 203 and the current holding transistor 204 are switched to be ON or OFF at the same timing. On that account, polarities of the current input transistor 203 and the current holding transistor 204 are made to be the same, and the signal line GH and the signal line GN can be shared. Also, there is no problem in operation if the current stop transistor 205 is turned ON at the same time when the current input transistor 203 is turned OFF. On that account, polarities of the current input transistor 203 and the current stop transistor 205 are made to differ, and the signal line GN and the signal line GS can be shared.

Figure 37:
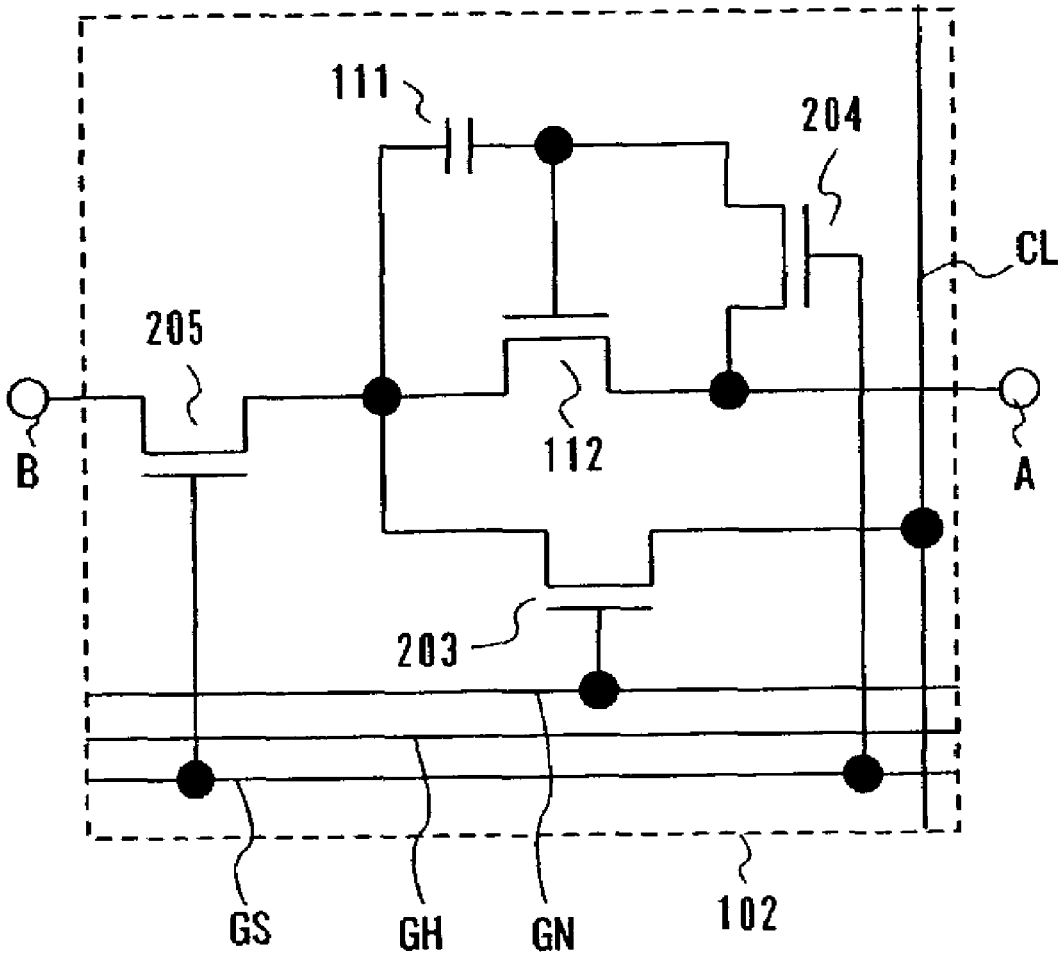
FIG. 37 is a view showing a structure of the current source circuit of the pixel of the display device of the invention.

Also, a structural example in case that the current source transistor 123 is the N channel type transistor is shown in FIG. 37. In addition, the same reference numerals and signs are given to the same portion as in FIG. 10.

Then, a current source circuit of a third structure will be described. In addition, FIG. 11 is referred for the description. In FIG. 11A, the same reference numerals and signs are given to the same portions as in FIG. 2.

Structural components of the current source circuit of the third structure will be described. The current source circuit of the third structure has the current source transistor 112. Also, it has a current input transistor 1483, a current holding transistor 1484, a light emitting transistor 1486, and a current reference transistor 1488 which function as switches. Here, the current source transistor 112, the current input transistor 1483, the current holding transistor 1484, the light emitting transistor 1486, and the current reference transistor 1488 may be of the P-channel type or of the N-channel type. Here is shown an example that the current source transistor 112 is a P channel type transistor. Further, it has the current source capacitor 111 for holding the gate electrode of the current source transistor 112. In addition, by positively using a gate capacitance etc. of a transistor, it is possible to omit the current source capacitor 111. Also, it has a signal line GN which inputs a signal to a gate electrode of the current input transistor 1483, a signal line GH which inputs a signal to a gate electrode of the current holding transistor 1484, a signal line GE which inputs a signal to a gate electrode of the light emitting transistor 1486, and a signal line GC which inputs a signal to a gate electrode of the current reference transistor 1488. Further, it has a current line CL to which the control signal is inputted and a current reference line SCL which is held at a constant electric potential.

A connecting relation of these structural components will be described. The gate electrodes and the source terminal of the current source transistor 112 are connected through the current source capacitor 111. The source terminal of the current source transistor 112 is connected to the terminal A through the light emitting transistor 1486, and also, connected to the current line CL through the current input transistor 1483. The gate electrode and the drain terminal of the current source transistor 112 are connected through the current holding transistor 1484. The drain terminal of the current source transistor 112 is connected to the terminal B, and also, connected to the current reference line SCL through the current reference transistor 1488.

Figure 38:
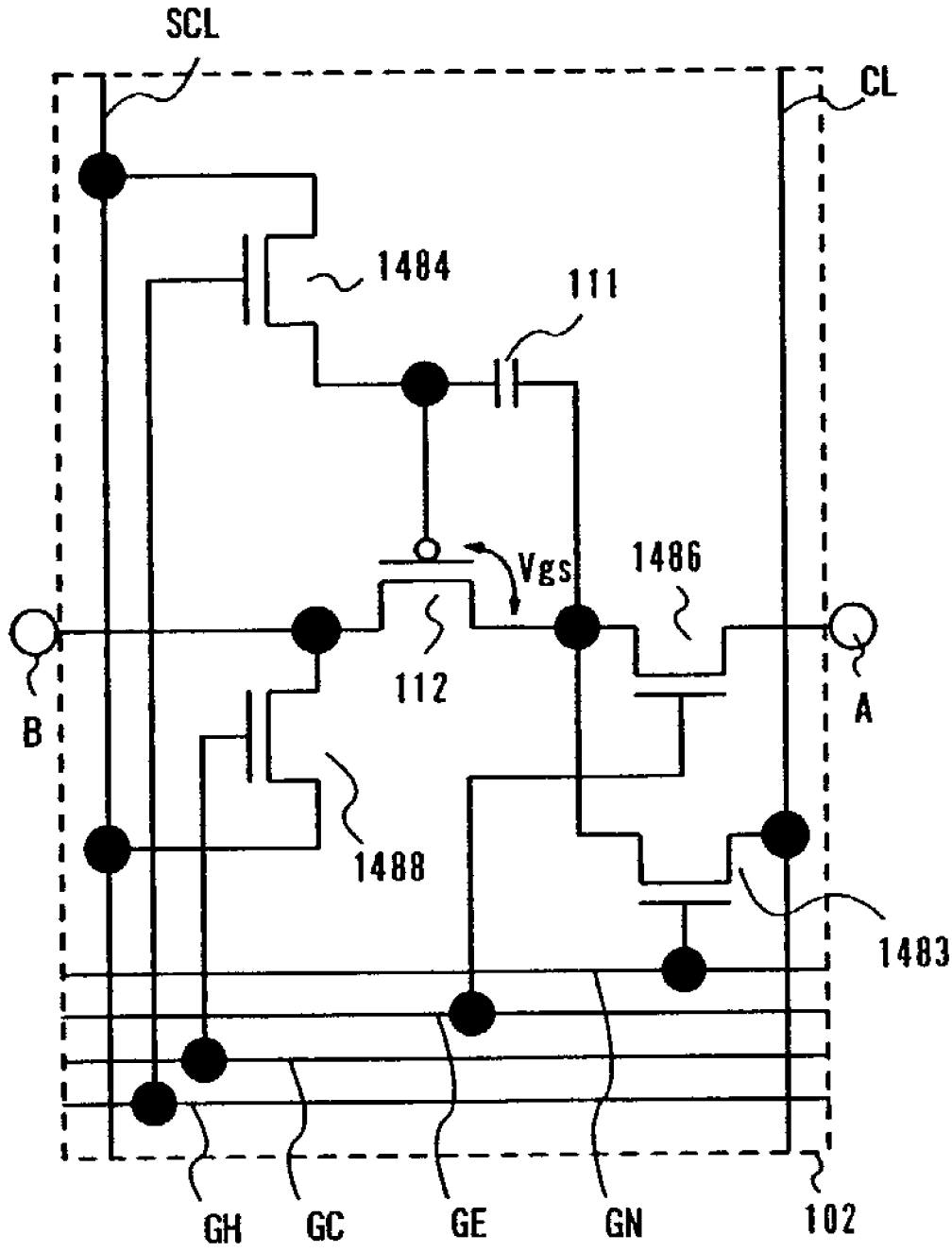
FIG. 38 is a view showing a structure of the current source circuit of the pixel of the display device of the invention.

In addition, a side of the source terminal or the drain terminal of the current holding transistor 1484 which is not connected to the current source capacitor 111 is connected to the drain terminal of the current source transistor 112 but, it may be connected to the current reference line SCL. The above-described structure is shown in FIG. 38. With this structure, by adjusting an electric potential of the current reference line SCL when the current holding transistor 1484 is in the OFF state, it is possible to lessen the voltage between the source and drain terminals of the current holding transistor 1484. As a result, it is possible to lessen the OFF current of the current holding transistor 1484. By this means, it is possible to lessen the leakage of the electric charges from the current source capacitor 111.

Then, the setting operation of the current source circuit of the above-described third structure will be described. FIGS. 11B to 11E are used for the description. In the current source circuit of the third structure, the setting operation is carried out by going through states of FIGS. 11B to 11E in sequence. In the description, for the purpose of simplicity, the current input transistor 1483, the current holding transistor 1484, the light emitting transistor 1486 and the current reference transistor 1488 are represented as switches. Here, shown is a case that a control signal for setting the current source circuit 102 is the control current. Also, in the figure, a path through which a current flows is shown by a heavy-line arrow.

In a period TD1 shown in FIG. 11B, the current input transistor 1483, the current holding transistor 1484 and the current reference transistor 1488 are turned in the ON state. By this means, a current flows from the path shown and electric charges are held in the current source capacitor 111.

In a period TD2 shown in FIG. 11C, by the electric charges held in the current source capacitor 111, the voltage between the gate and the source of the current source transistor 112 becomes more than a threshold voltage. Then, the drain current flows through the current source transistor 112.

When sufficient time passes and a steady state is realized, as in a period TD3 shown in FIG. 11D, the drain current of the current source transistor 112 is determined as the control current. By this means, the gate voltage on the occasion that the drain current is set at the control current is held in the current source capacitor 111.

In a period TD4 shown in FIG. 11E, the current input transistor 1483 and the current holding transistor 1484 are turned OFF. By this means, the control current is prevented from flowing through the pixel. In addition, it is desirable that a timing that the current holding transistor 1484 is turned OFF, as compared to a timing that the current input transistor 1483 is turned OFF, is earlier or simultaneous. This is because of preventing the electric charges held in the current source capacitor 111 from being discharged. Further, the current reference transistor 1488 are turned in the OFF state. After that, the light emitting transistor 1486 is turned in the ON state. After the period TD4, when a voltage is applied between the source and drain terminals of the current source transistor 112, the drain current corresponding to the control current flows through the current source transistor 112. In short, when a voltage is applied between the terminal A and the terminal B, the current source circuit 102 has the drain current corresponding to the control circuit flown. By this means, the current source circuit 102 outputs a predetermined current.

In addition, the current reference transistor 1488 and the current reference line SCL are not indispensable. For example, in the current source circuit which carries out the setting operation only in case that the switch part making the pair is in the ON state, the current reference transistor 1488 and the current reference line SCL are not necessary, since a current does not flow through the current reference line SCL in the periods TD1 to TD3 but simply flows through the terminal B.

Each signal line of the current source circuit of the third structure can be shared. For example, there is no problem in operation if the current input transistor 1483 and the current holding transistor 1484 are switched to be ON or OFF at the same timing. On that account, polarities of the current input transistor 1483 and the current holding transistor 1484 are made to be the same, and the signal line GH and the signal line GN can be shared. Also, there is no problem in operation if the current reference transistor 1488 and the current input transistor 1483 are turned ON or OFF at the same timing. On that account, polarities of the current reference transistor 1488 and the current input transistor 1483 are made to be the same, and the signal line GN and the signal line GC can be shared. Further, there is no problem in operation if, at the same time when the light emitting transistor 1486 is turned in the ON state, the current input transistor 1483 is turned in the OFF state. Then, polarities of the light emitting transistor 1486 and the current input transistor 1483 are made to differ, and the signal line GE and the signal line GN can be shared.

Figure 39A:
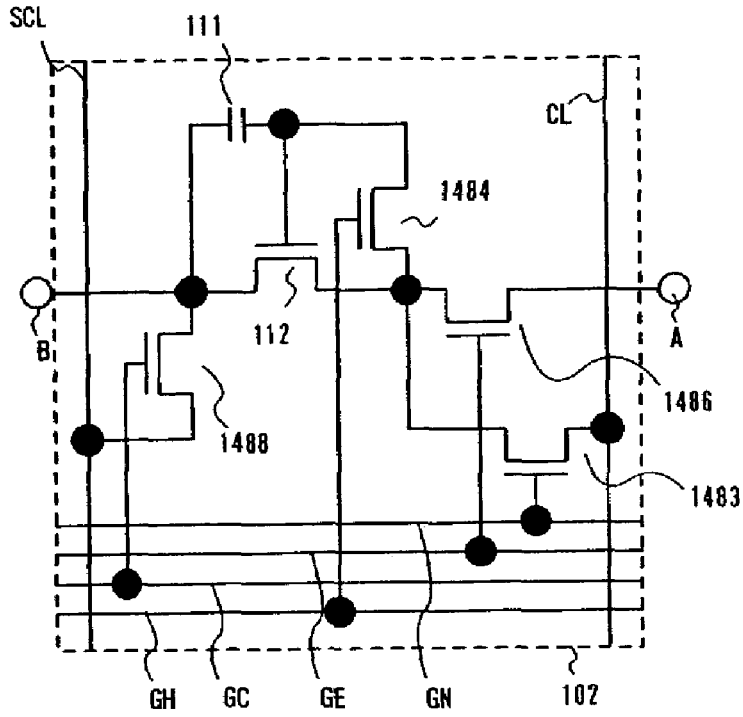
FIGS. 39A and 39B are views showing structures of the current source circuits of the pixels of the display device of the invention.
Figure 39B:
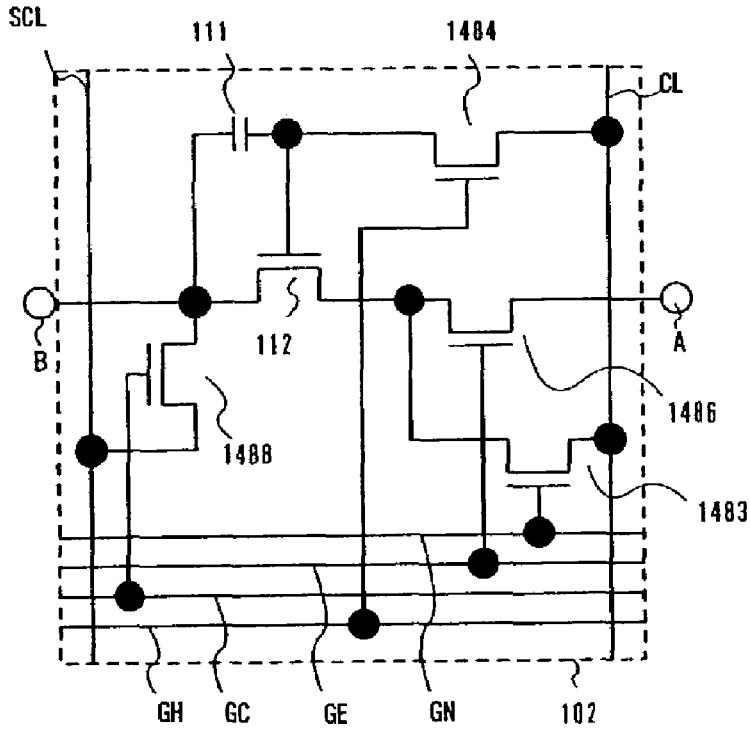

Also, a structural example in case that the current source transistor 112 is the N channel type transistor is shown in FIG. 39A. In addition, the same reference numerals and signs are given to the same portion as in FIG. 11. In addition, in the structure of FIG. 39A, a side of the source terminal or the drain terminal of the current holding transistor 1484 which is not connected to the current source capacitor 111 is connected to the drain terminal of the current source transistor 112 but, it may be connected to the current line CL. The above-described structure is shown in FIG. 39B. With this structure, by adjusting an electric potential of the current line CL when the current holding transistor 1484 is in the OFF state, it is possible to lessen the voltage between the source and drain terminals of the current holding transistor 1484. As a result, it is possible to lessen the OFF current of the current holding transistor 1484. By this means, it is possible to lessen the leakage of the electric charges from the current holding capacitor 111.

Then, the setting operation of the current source circuit of a fourth structure will be described. In addition, FIG. 12 is referred for the description. In FIG. 12A, the same reference numerals and signs are given to the same portions as in FIG. 2.

Structural components of the current source circuit of the fourth structure will be described. The current source circuit of the fourth structure has the current source transistor 112 and a current stop transistor 805. Also, it has a current input transistor 803 and a current holding transistor 804 which function as switches. Here, the current source transistor 112, a current stop transistor 805, the current input transistor 803, and the current holding transistor 804 may be of the P-channel type or of the N-channel type. But, there is a necessity to make the current source transistor 112 and the current stop transistor 805 the same polarity. Here is shown an example that the current source transistor 112 and the current stop transistor 805 are P channel type transistors. Also, it is desirable that current characteristics of the current source transistor 112 and the current stop transistor 805 are the same. Further, it has the current source capacitor 111 for holding the gate electrode of the current source transistor 112. In addition, by positively using a gate capacitance etc. of a transistor, it is possible to omit the current source capacitor 111. Further, it has a signal line GN which inputs a signal to a gate electrode of the current input transistor 803, a signal line GH which inputs a signal to a gate electrode of the current holding transistor 804. Furthermore, it has a current line CL to which the control current is inputted.

A connecting relation of these structural components will be described. The source electrode of the current source transistor 112 is connected to one of the electrodes of the current source capacitor 111. The other electrode of the current source capacitor 111 is connected to the terminal A. The gate electrode and the source terminal of the current source transistor 112 are connected through the current source capacitor 111. The gate electrode of the current source transistor 112 is connected to a gate electrode of the current stop transistor 805, and also, connected to the current line CL through the current holding transistor 804. The drain terminal of the current source transistor 112 is connected to a source terminal of the current stop transistor 805, and also, connected to the current line CL through the current input transistor 803. The drain terminal of the current stop transistor 805 is connected to the terminal B.

In addition, in the structure shown in FIG. 12A, it is possible to configure the circuit structure as shown in FIG. 12B, by changing a location of the current holding transistor 804. In FIG. 12B, the current holding transistor 804 is connected between the gate electrode and the drain terminal of the current source transistor 112.

Then, the setting operation of the current source circuit of the above-described fourth structure will be described. In addition, the setting operation in FIG. 12A is the same as that in FIG. 12B. Here, the circuit shown in FIG. 12A is picked up as an example, and its setting operation will be described. FIGS. 12C to 12F are used for the description. In the current source circuit of the fourth structure, the setting operation is carried out by going through states of FIGS. 12C to 12F in sequence. In the description, for the purpose of simplicity, the current input transistor 803 and the current holding transistor 804 are represented as switches. Here, shown is a case that a control signal for setting the current source circuit is the control current. Also, in the figure, a path through which a current flows is shown by a heavy-line arrow.

In a period TD1 shown in FIG. 12C, the current input transistor 803 and the current holding transistor 804 are turned in the ON state. In addition, on this occasion, the current stop transistor 805 is in the OFF state. This is because, by the current holding transistor 804 and the current input transistor 803 which were turned in the ON state, the electric potentials of the source terminal and the gate electrode of the current stop transistor 805 are maintained to be the same. In short, by using a transistor which is turned in the OFF state when the voltage between the source and the gate is zero as the current stop transistor 805, in the period TD1, the current stop transistor 805 is turned in the OFF state. By this means, a current flows from the path shown and electric charges are held in the current source capacitor 111.

In a period TD2 shown in FIG. 12D, by the electric charges held, the voltage between the gate and the source of the current source transistor 112 becomes more than a threshold voltage. Then, the drain current flows through the current source transistor 112.

When sufficient time passes and a steady state is realized, as in a period TD3 shown in FIG. 12E, the drain current of the current source transistor 112 is determined as the control current. By this means, the gate voltage of the current source transistor 112 on the occasion that the drain current is set at the control current is held in the current source capacitor 111. After that, the current holding transistor 804 is turned in the OFF state. Then, the electric charges held in the current source capacitor 111 are distributed also to the gate electrode of the current stop transistor 805. By this means, at the same time when the current holding transistor 804 is turned in the OFF state, the current stop transistor 805 is automatically turned in the ON state.

In a period TD4 shown in FIG. 12F, the current input transistor 803 are turned OFF. By this means, the control current is prevented from flowing through the pixel. In addition, it is desirable that a timing that the current holding transistor 804 is turned OFF, as compared to a timing that the current input transistor 803 is turned OFF, is earlier or simultaneous. This is because of preventing the electric charges held in the current source capacitor 111 from being discharged. After the period TD4, in case that a voltage is applied between the terminal A and the terminal B, through the current source transistor 112 and the current stop transistor 805, a constant current is outputted. In short, on the occasion that the current source circuit 102 outputs the constant current, the current source transistor 112 and the current stop transistor 805 function like one multi-gate type transistor. On that account, it is possible to lessen a value of the constant current to be outputted, to the control current to be inputted. Accordingly, it is possible to speed up the setting operation of the current source circuit. In addition, there is a necessity that polarities of the current stop transistor 805 and the current source transistor 112 are made to be the same. Also, it is desirable that current characteristics of the current stop transistor 805 and the current source transistor 112 are made to be the same. This is because, in each current source circuit 102 having the fourth structure, in case that the current characteristics of the current stop transistor 805 and the current source transistor 112 are not the same, there occurs variation of the output current of the current source circuit.

In addition, in the current source circuit of the fourth structure, by using not only the current stop transistor 805 but also a transistor which converts the control current, which is inputted, into the corresponding gate voltage (current source transistor 112), a current is outputted from the current source circuit 102. On one hand, in the current source circuit of the first structure, the control current is inputted, and the transistor which converts the inputted control current into the corresponding gate voltage (current transistor) is completely different from the transistor which converts the gate voltage into the drain current (current source transistor). Thus, the fourth structure can more reduce influence which is given to the output current of the current source circuit 102 by variation of a current characteristic of a transistor, than the first structure.

Each signal line of the current source circuit of the fourth structure can be shared. There is no problem in operation if the current input transistor 803 and the current holding transistor 804 are switched to be ON or OFF at the same timing. On that account, polarities of the current input transistor 803 and the current holding transistor 804 are made to be the same, and the signal line GH and the signal line GN can be shared.

Then, a current source circuit of a fifth structure will be described. In addition, FIG. 13 is referred for the description. In FIG. 13A, the same reference numerals and signs are given to the same portions as in FIG. 2.

Structural components of the current source circuit of the fifth structure will be described. The current source circuit of the fifth structure has the current source transistor 112 and a light emitting transistor 886. Also, it has a current input transistor 883, a current holding transistor 884, and a current reference transistor 888 which function as switches. Here, the current source transistor 112, a light emitting transistor 886, the current input transistor 883, the current holding transistor 884, and the current reference transistor 888 may be of the P-channel type or of the N-channel type. But, there is a necessity that polarities of the current source transistor 112 and the light emitting transistor 886 are the same. Here is shown an example that the current source transistor 112 and the light emitting transistor 886 are P channel type transistors. Also, it is desirable that current characteristics of the current source transistor 112 and the light emitting transistor 886 are the same. Further, it has the current source capacitor 111 for holding the gate electrode of the current source transistor 112. In addition, by positively using a gate capacitance etc. of a transistor, it is possible to omit the current source capacitor 111. Also, it has a signal line GN which inputs a signal to a gate electrode of the current input transistor 883, and a signal line GH which inputs a signal to a gate electrode of the current holding transistor 884. Further, it has a current line CL to which the control signal is inputted, and a current reference line SCL which is maintained to be a constant electric potential.

A connecting relation of these structural components will be described. The source terminal of the current source transistor 112 is connected to the terminal B, and also, connected to the current reference line SCL through the current reference transistor 888. The drain terminal of the current source transistor 112 is connected to a source terminal of the light emitting transistor 886, and also, connected to the current line CL through the current input transistor 883. The gate electrode and the source terminal of the current source transistor 112 are connected through the current source capacitor 111. The gate electrode of the current source transistor 112 is connected to a gate electrode of the light emitting transistor 886, and connected to the current line CL through the current holding transistor 884. The drain terminal of the light emitting transistor 886 is connected to the terminal A.

In addition, in the structure shown in FIG. 13A, it is possible to configure the circuit structure as shown in FIG. 13B, by changing a location of the current holding transistor 884. In FIG. 13B, the current holding transistor 884 is connected between the gate electrode and the drain terminal of the current source transistor 112.

Then, the setting operation of the current source circuit of the above-described fifth structure will be described. In addition, the setting operation in FIG. 13A is the same as that in FIG. 13B. Here, the circuit shown in FIG. 13A is picked up as an example, and its setting operation will be described. FIGS. 13C to 13F are used for the description. In the current source circuit of the fifth structure, the setting operation is carried out by going through states of FIGS. 13C to 13F in sequence. In the description, for the purpose of simplicity, the current input transistor 883, the current holding transistor 884, and the current reference transistor 888 are represented as switches. Here, shown is a case that a control signal for setting the current source circuit is the control current. Also, in the figure, a path through which a current flows is shown by a heavy-line arrow.

In a period TD1 shown in FIG. 13C, the current input transistor 883, the current holding transistor 884, and the current reference transistor 888 are in the ON state. In addition, on this occasion, the light emitting transistor 886 is in the OFF state. This is because, by the current holding transistor 884 and the current input transistor 883 which were turned in the ON state, the electric potentials of the source terminal and the gate electrode of the light emitting transistor 886 are maintained to be the same. In short, by using a transistor which is turned in the OFF state when a voltage between a source and a gate is zero as the light emitting transistor 886, in the period TD1, the light emitting transistor 886 is turned in the OFF state. By this means, a current flows from the path shown and electric charges are held in the current source capacitor 111.

In a period TD2 shown in FIG. 13D, by the electric charges held in the current source capacitor 111, the voltage between the gate and the source of the current source transistor 112 becomes more than a threshold voltage. Then, the drain current flows through the current source transistor 112.

When sufficient time passes and a steady state is realized, as in a period TD3 shown in FIG. 13E, the drain current of the current source transistor 112 is determined as the control current. By this means, the gate voltage of the current source transistor 112 on the occasion that the drain current is set at the control current is held in the current source capacitor 111. After that, the current holding transistor 884 is turned in the OFF state. Then, the electric charges held in the current source capacitor 111 are distributed also to the gate electrode of the light emitting transistor 886. By this means, at the same time when the current holding transistor 884 is turned in the OFF state, the light emitting transistor 886 is automatically turned in the ON state.

In a period TD4 shown in FIG. 13F, the current reference transistor 888 and the current input transistor 883 are turned OFF. By this means, the control current is prevented from flowing through the pixel. In addition, it is desirable that a timing that the current holding transistor 884 is turned OFF, as compared to a timing that the current input transistor 883 is turned OFF, is earlier or simultaneous. This is because of preventing the electric charges held in the current source capacitor 111 from being discharged. After the period TD4, in case that a voltage is applied between the terminal A and the terminal B, through the current source transistor 112 and the light emitting transistor 886, a constant current is outputted. In short, on the occasion that the current source circuit 102 outputs the constant current, the current source transistor 112 and the light emitting transistor 886 function like one multi-gate type transistor. On that account, it is possible to lessen a value of the constant current to be outputted, to the control current to be inputted. By this means, it is possible to speed up the setting operation of the current source circuit. In addition, there is a necessity that the current characteristics of the light emitting transistor 886 and the current source transistor 112 are made to be the same. Also, it is desirable that current characteristics of the light emitting transistor 886 and the current source transistor 112 are made to be the same. This is because, in each current source circuit 102 having the fifth structure, in case that polarities of the light emitting transistor 886 and the current source transistor 112 are not the same, there occurs variation of the output current of the current source circuit.

In addition, in the current source circuit of the fifth structure, by a transistor which converts the control current, which is inputted, into the corresponding gate voltage (current source transistor 112), a current is outputted from the current source circuit 102. On one hand, in the current source circuit of the first structure, the control current is inputted, and the transistor which converts the inputted control current into the corresponding gate voltage (current transistor) is completely different from the transistor which converts the gate voltage into the drain current (current source transistor). Thus, it is possible to more reduce influence which is given to the output current of the current source circuit 102 by variation of a current characteristic of a transistor, than in the first structure.

In addition, in case that a current is made to flow through the terminal B in the periods TD1 to TD3 on the occasion of the setting operation, the current reference line SCL and the current reference transistor 888 are not necessary.

Each signal line of the current source circuit of the fifth structure can be shared. For example, there is no problem in operation if the current input transistor 883 and the current holding transistor 884 are switched to be ON or OFF at the same timing. On that account, polarities of the current input transistor 883 and the current holding transistor 884 are made to be the same, and the signal line GH and the signal line GN can be shared. Also, there is no problem in operation if the current reference transistor 888 and the current input transistor 883 are switched to be ON or OFF at the same timing. On that account, polarities of the current reference transistor 888 and the current input transistor 883 are made to be the same, and the signal line GN and the signal line GC can be shared.

Then, the current source circuits of the above-described first structure to the fifth structure will be organized with respect to each feature and with slightly larger framework.

The above-described five current source circuits are, roughly divided, classified into a current mirror type current source circuit, a same transistor type current source circuit, and a multi-gate type current source circuit. These will be described hereinafter.

As the current mirror type current source circuit, cited is the current source circuit of the first structure. In the current mirror type current source circuit, the signal which is inputted to the light emitting element is a current which is formed by increasing or decreasing the control current which is inputted to the pixel, by a predetermined scaling factor. On that account, it is possible to set the control current larger to some extent. Thus, it is possible to speedup the setting operation of the current source circuit of each pixel. However, if current characteristics of a pair of transistors, which configure a current mirror circuit that the current source circuit has, differ, there is a problem that image display is varied.

As the same transistor type current source circuit, cited are the current source circuits of the second structure and the third structure. In the same transistor type current source circuit, the signal which is inputted to the light emitting element is the same as the current value of the control current which is inputted to the pixel. Here, in the same transistor type current source circuit, the transistor to which the control current is inputted is the same as the transistor which outputs a current to the light emitting element. On that account, reduced is image irregularity due to variation of current characteristics of transistors.

As the multi-gate type current source circuit, cited are the current source circuits of the fourth structure and the fifth structure. In the multi-gate type current source circuit, the signal which is imputted to the light emitting element is a current which is formed by increasing or decreasing the control current which is inputted to the pixel, by a predetermined scaling factor. On that account, it is possible to set the control current larger to some extent. Thus, it is possible to speed up the setting operation of the current source circuit of each pixel. Also, a portion of the transistor to which the control current is inputted and the transistor which outputs a current to the light emitting element is shared with each other. On that account, reduced is image irregularity due to variation of current characteristics of transistors, as compared with the current mirror type current source circuit.

Then, in each of the above-described current source circuits in three classifications, a relation of its setting operation and an operation of the switch part which makes the pair will be described.

A relation of the setting operation in case of the current mirror type current source circuit and the operation of the corresponding switch part will be shown hereinafter. In case of the current mirror type current source circuit, even during a period that the control current is inputted, it is possible to output the predetermined constant current. On that account, there is no necessity to carry out the operation of the switch part which makes the pair and the setting operation of the current source circuit in synchronous with each other.

A relation of the setting operation in case of the same transistor type current source circuit and the operation of the corresponding switch part will be shown hereinafter. In case of the same transistor type current source circuit, during a period that the control current is inputted, it is not possible to output the constant current. On that account, there occurs a necessity to carry out the operation of the switch part which makes the pair and the setting operation of the current source circuit in synchronous with each other. For example, only when the switch part is in the OFF state, it is possible to carry out the setting operation of the current source circuit.

A relation of the setting operation in case of the multi-gate type current source circuit and the operation of the corresponding switch part will be shown hereinafter. In case of the multi-gate type current source circuit, during a period that the control current is inputted, it is not possible to output the constant current. On that account, there occurs a necessity to carry out the operation of the switch part which makes the pair and the setting operation of the current source circuit in synchronous with each other. For example, only when the switch part is in the OFF state, it is possible to carry out the setting operation of the current source circuit.

Then, an operation on the occasion of combining with the time gray scale system, in case that the setting operation of the current source circuit is made to be synchronous with the operation of the switch part which makes the pair, will be described in detail.

Here, a case that the setting operation of the current source circuit is carried out only in case that the switch part is in the OFF state will be watched. In addition, since detail explanation of the time gray scale system is the same as the technique shown in the embodiment 2, it will be omitted here. In case of using the time gray scale system, it is the non display period that the switch part is always turned in the OFF state. Thus, in the non display period, it is possible to carry out the setting operation of the current source circuit.

The non display period is initiated by selecting each pixel row in sequence in the reset period. Here, it is possible to carry out the setting operation of each pixel row with the same frequency as frequency for selecting the scanning line in sequence. For example, a case of using the switch of the structure shown in FIG. 3 will be watched. It is possible to select each pixel row and carry out the setting operation of the current source circuit with the same frequency as frequency for selecting the scanning line G and the deleting signal line RG in sequence.

But, there is a case that it is difficult to sufficiently carry out the setting operation of the current source circuit in the selection period of one row length. In that moment, it is fine if the setting operation of the current source circuit is slowly carried out, by using the selection period of a plurality of rows. To carry out the setting operation of the current source circuit slowly means to carry out an operation for storing predetermined electric charges slowly by taking long time into the current source capacitance which the current source circuit has.

As just described, since each row is selected by using the selection period of a plurality of rows, and by using the same frequency as frequency for selecting the deleting signal line RG etc. in the reset period, the rows are to be selected at intervals. Thus, in order to carry out the setting operations of the pixels of all rows, there is a necessity to carry out the setting operations in a plurality of the non display periods.

Then, a structure and a driving method of a display device on the occasion of using the above-described techniques will be described. Firstly, a driving method in case that the setting operation of the pixel of one row is carried out by using the same length period as the period in which a plurality of the scanning lines are selected will be described. FIG. 14 is used for the description. In the figure, as an example, shown is a timing chart for carrying out the setting operation of the pixel of one row during a period in which ten scanning lines are selected.

Figure 14A:
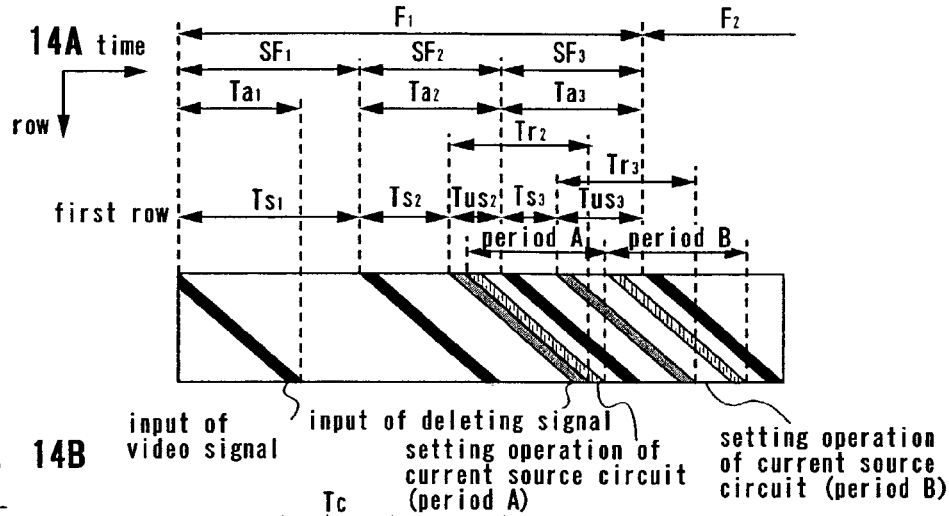
FIGS. 14A and 14B are views showing driving methods of the display device of the invention.

FIG. 14A shows an operation of each row in each frame period. In addition, the same reference numerals and signs are given to the same portions as the timing chart shown in FIG. 4 in the embodiment 2, and the description thereof will be omitted. Here, shown is a case that one frame period is divided into three sub frame periods $SF_2$ and $SF_3$. In addition, it is configured that the non display period Tus is disposed in the sub frame periods $SF_1$ to $SF_3$, respectively. In the non display period Tus, the setting operation of the pixel is carried out (in the figure, the period A and the period B).

Figure 14B:
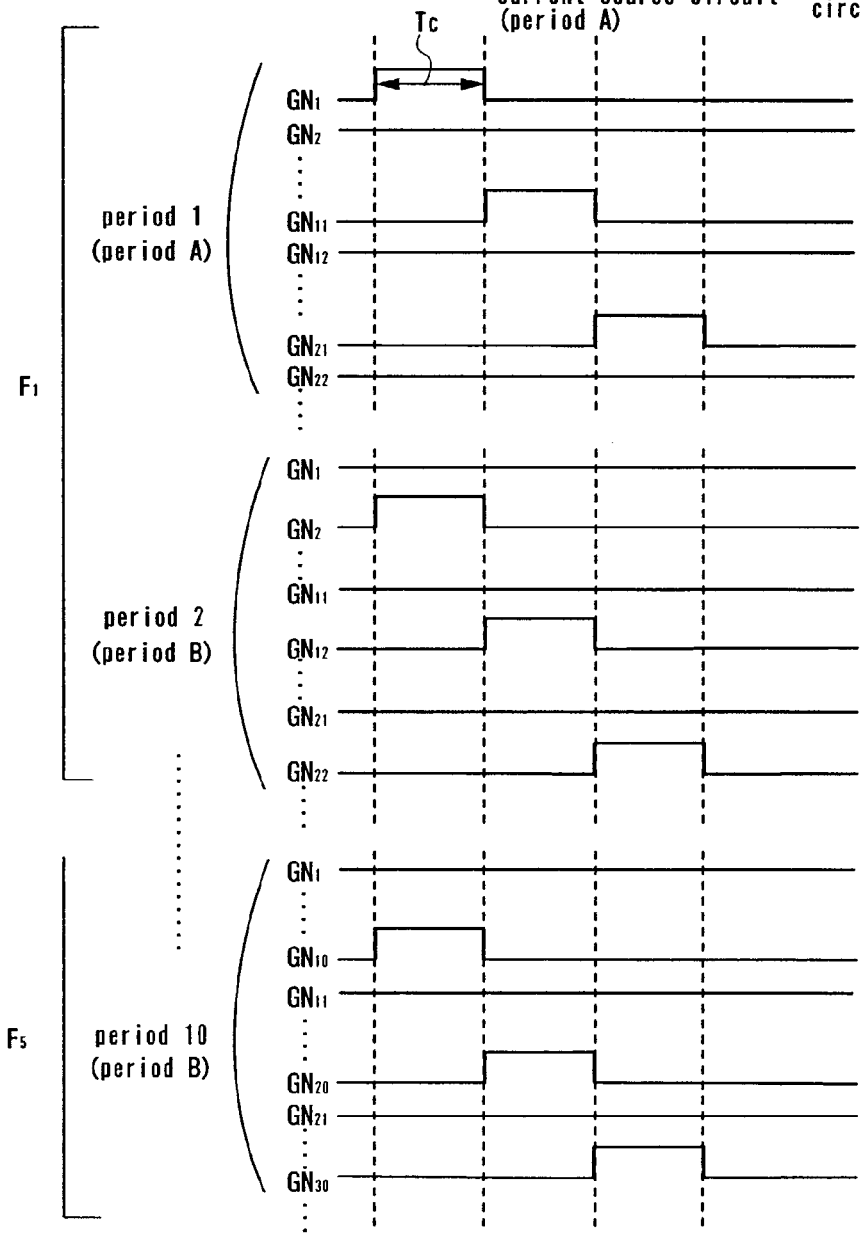

Then, the operation in the period A and the period B will be described in detail. FIG. 14B is used for the description. In addition, in the figure, a period in which the setting operation of the pixel is carried out is shown by the period in which the signal line GN is selected. In general, the signal line GN of the pixel of i (i is a natural number)-th row is shown by $Gn_i$. Firstly, in a period A of a first frame period $F_1$, $GN_1$, $GN_{11}$, $GN_{21}$, . . . are selected at intervals. By this means, carried out is the setting operation of the pixels of a first row, an eleventh row, a twenty first row, . . . (period 1). Then, in a period B of the first frame period $F_1$, $GN_2$, $GN_{12}$, $GN_{22}$, . . . are selected. By this means, carried out is the setting operation of the pixels of a second row, a twelfth row, a twenty second row, . . . (period 2). By repeating the above-described operations during 5 frame periods, the setting operations of all pixels are ordinarily carried out.

Here, a period which can be used for the setting operation of the pixel of one row is represented by Tc. in case of using the above-described driving method, it is possible to set Tc at ten times of the selection period of the scanning line G. By this means, it is possible to lengthen time which is used for the setting operation per one pixel. Also, it is possible to carry out the setting operation of the pixel efficiently and accurately.

In addition, in case that the ordinary setting operation is not enough, it is fine to carry out the setting operation of the pixel gradually by repeating the above-described operation a plurality of times.

Then, a structure of a driving circuit on the occasion of using the above-described driving method will be described by use of FIG. 15. In addition, FIG. 15 shows a driving circuit which inputs a signal to the signal line GN. However, the same is applied to a signal which is inputted to other signal lines that the current source circuit has. Two structural examples of the driving circuit for carrying out the setting operation of the pixel will be cited.

Figure 15B:
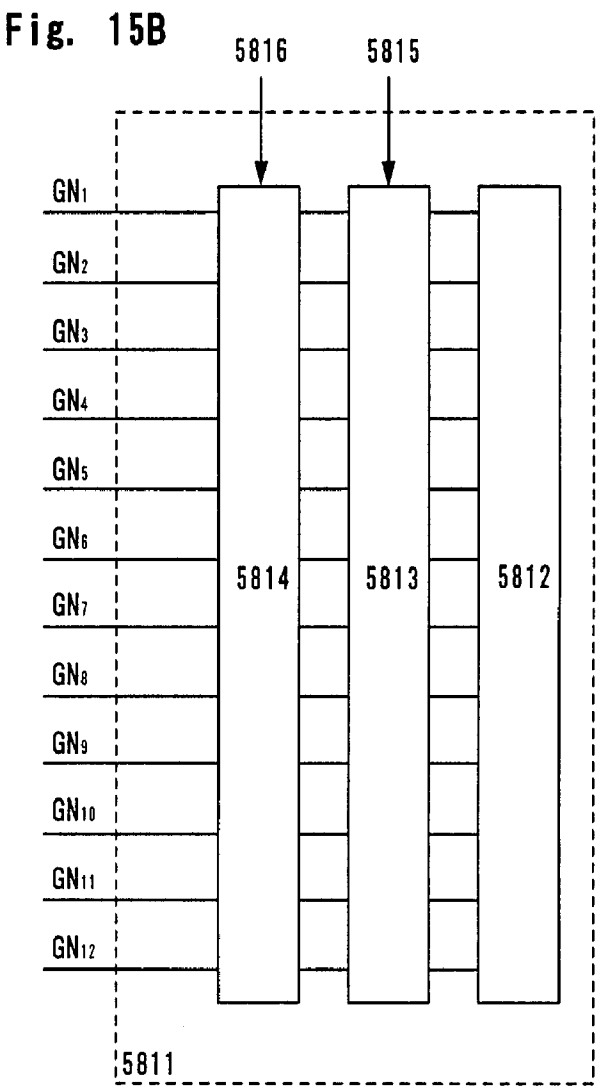
FIGS. 15A and 15B are views showing a structure of a driving circuit of the display device of the invention.
Figure 15A:
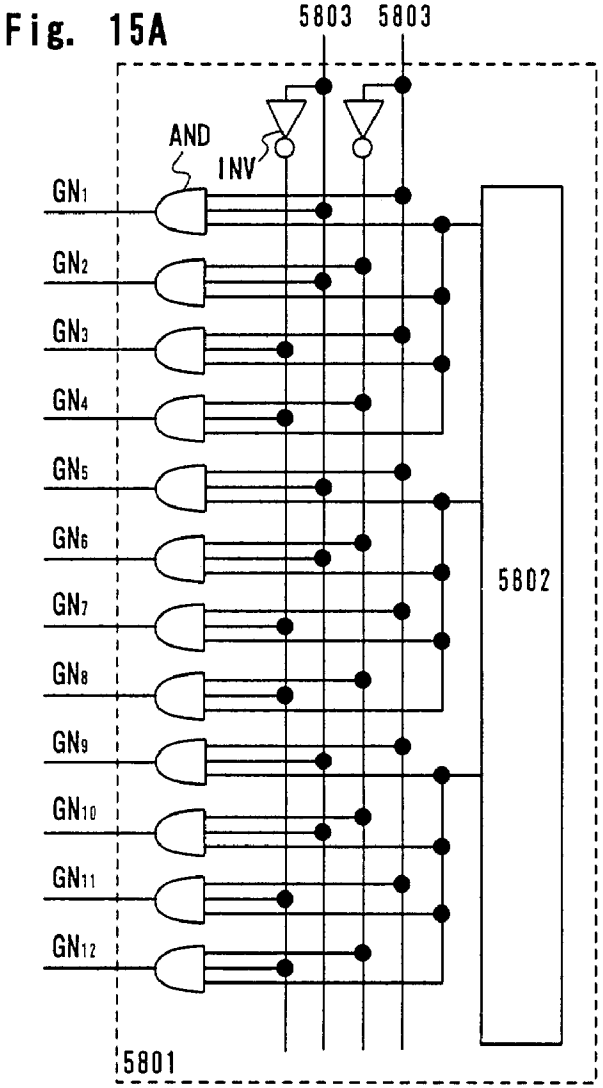

A first example is the driving circuit of such a structure that an output of a shift register is switched by a switching signal to be outputted to the signal line GN. An example of this structure of the driving circuit (setting operation use driving circuit) is shown in FIG. 15A. A setting operation use driving circuit 5801 is configured by a shift register 5802, an AND circuit, an inverter circuit (INV) and so on. In addition, here shown is an example of the driving circuit of such a structure that one signal line GN is selected during a period which is four times of a pulse output period of the shift register 5802.

An operation of the setting operation use driving circuit 5801 will be described. The output of the shift register 5802 is selected by a switching signal 5803 and outputted to the signal line GN through the AND circuit.

A second example is the driving circuit of such a structure that a signal for selecting a specific row is latched by an output of a shift register. An example of the driving circuit of this structure (setting operation use driving circuit) is shown in FIG. 15B. A setting operation use driving circuit 5811 has a shift register 5812, a latch 1 circuit 5813, and a latch 2 circuit 5814.

An operation of the setting operation use driving circuit 5811 will be described. By an output of the shift register 5812, the latch 1 circuit 5813 holds a row selection signal 5815 in sequence. Here, the row selection signal 5815 is a signal for selecting an arbitrary output signal out of the output of the shift register 5812. The signal held in the latch 1 circuit 5813 is transferred to the latch 2 circuit 5814 by a latch signal 5816. By this means, a signal is inputted to a specific signal line GN.

In addition, even in the display period, in case of the current mirror type current source circuit, the setting operation can be carried out. Also, in the same transistor type current source circuit and the multi-gate type current source circuit, may be used such a drive method that the display period is once interrupted to thereby carry out the setting operation of the current source circuit, and after that, the display period is resumed.

It is possible to realize this embodiment by being freely combined with the embodiment 1 and the embodiment 2.

Embodiment 4

In this embodiment, a structure and an operation of each pixel will be described. In addition, a case that each pixel has two pairs is taken as an example. And, a case that structures of two current source circuits of two pairs are selected from and combined with structures of the five current source circuits shown in the embodiment 3 will be described as an example.

A first combination example will be shown. In the first combination example, each of two current source circuits (a first current source circuit and a second current source circuit) that the pixel has is the current source circuit of the second structure shown in FIG. 10A. In addition, since a structure of these current source circuits is the same as in the embodiment 3, detail description will be omitted.

Figure 16:
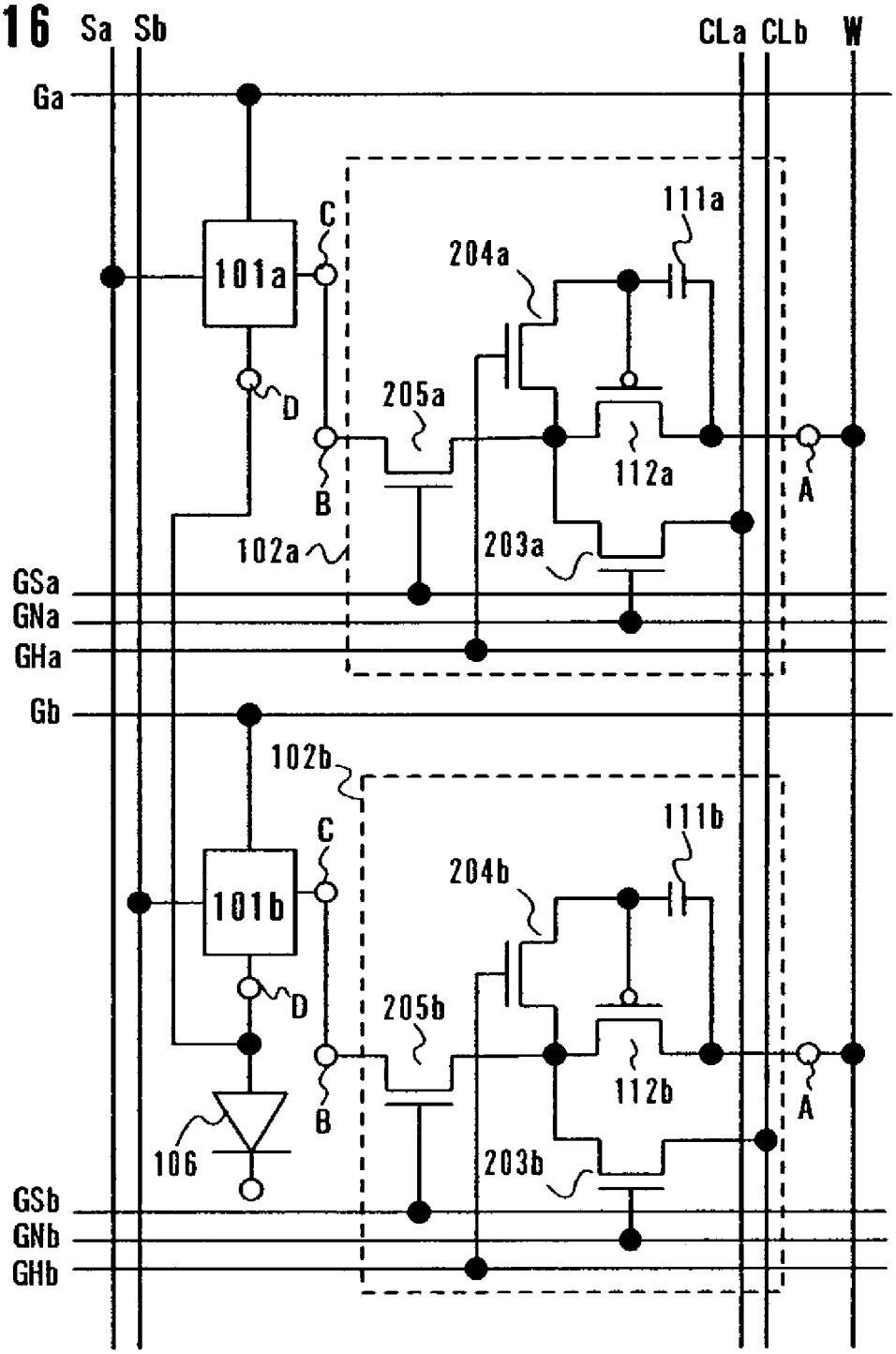
FIG. 16 is a view showing a structure of the pixel of the display device of the invention.

FIG. 16 shows the structure of the pixel of the first combination example. In addition, in FIG. 16, the same reference numerals and signs are given to the same portions as in FIG. 10. In addition, a portion which corresponds to the first current source circuit is shown by adding a after the reference numerals of FIG. 10A, and a portion which corresponds to the second current source circuit is shown by adding a after the reference numerals of FIG. 10A. Also, description of a structure of the switch parts (a first switch part and a second switch part) of the respective pairs will be omitted here by referring to the embodiment 2.

Figure 17B:
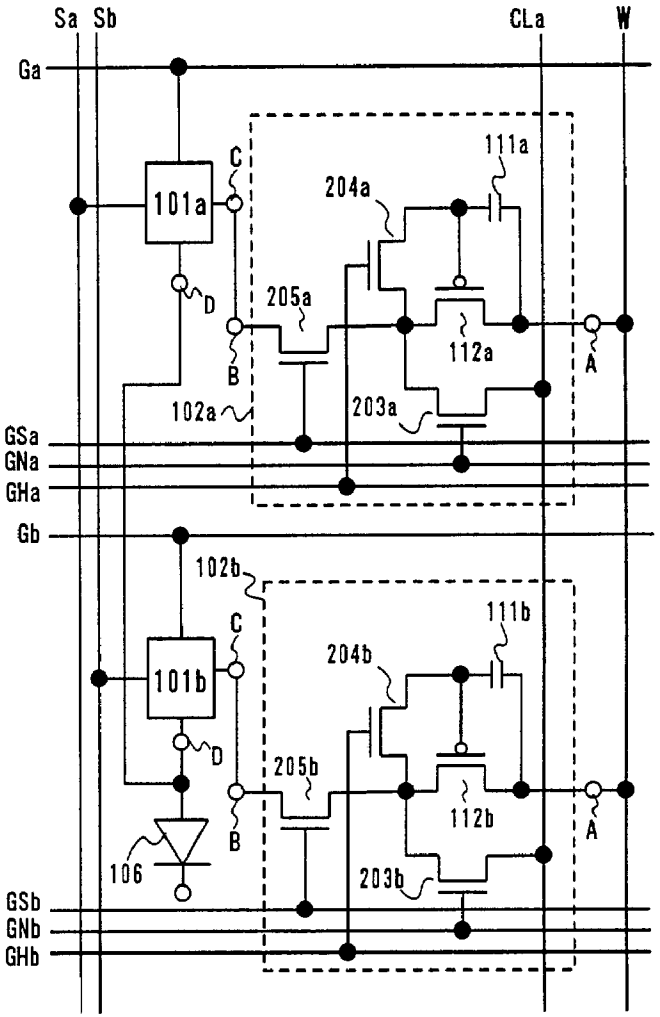
FIGS. 17A and 17B are views showing structures of the pixels of the display device of the invention.
Figure 17A:
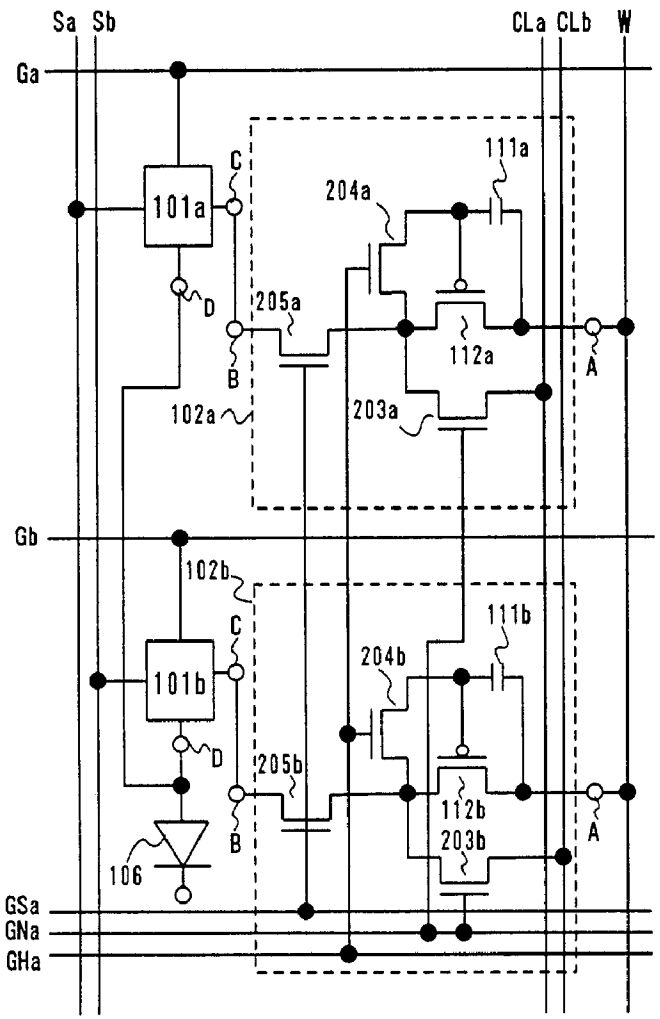

Here, the first current source circuit 102*a* and the second current source circuit 102*b* can share wirings and elements. For example, a signal line GNa and a signal line GNb can be shared. Also, a signal line GHa and a signal line GHb can be shared. Furthermore, a signal line GSa and a signal line GSb can be shared. This structure is shown in FIG. 17A. Also, a current line CLa and a current line CLb can be shared. This structure is shown in FIG. 17B. In addition, structures of FIG. 17A and FIG. 17B can be freely combined.

A way of setting of each current source circuit 102*a* and 102*b* is the same as in the embodiment 3. The current source circuits 102*a* and 102*b* are the same transistor type current source circuit. Thus, it is desirable that its setting operation is carried out in synchronous with the operation of the switch part. Also, current stop transistors 205*a* and 205*b* may be unnecessary depending upon a drive method.

It is possible to realize this embodiment by being freely combined with the embodiment 1 to the embodiment 3.

Embodiment 5

In this embodiment, a structure and an operation of each pixel will be described. In addition, a case that each pixel has two pairs is taken as an example. And, a case that structures of two current source circuits of two pairs are selected from and combined with structures of the five current source circuits shown in the embodiment 3 will be described as an example.

In addition, a second combination example, which is different from the first combination example shown in the embodiment 4, will be described. In the second combination example, one (a first current source circuit) of two current source circuits that the pixel has is the current source circuit of the second structure shown in FIG. 10A. The other current source circuit (a second current source circuit) is the current source circuit of the first structure shown in FIG. 9A. In addition, since a structure of these current source circuits is the same as in the embodiment 3, detail description will be omitted.

Figure 18:
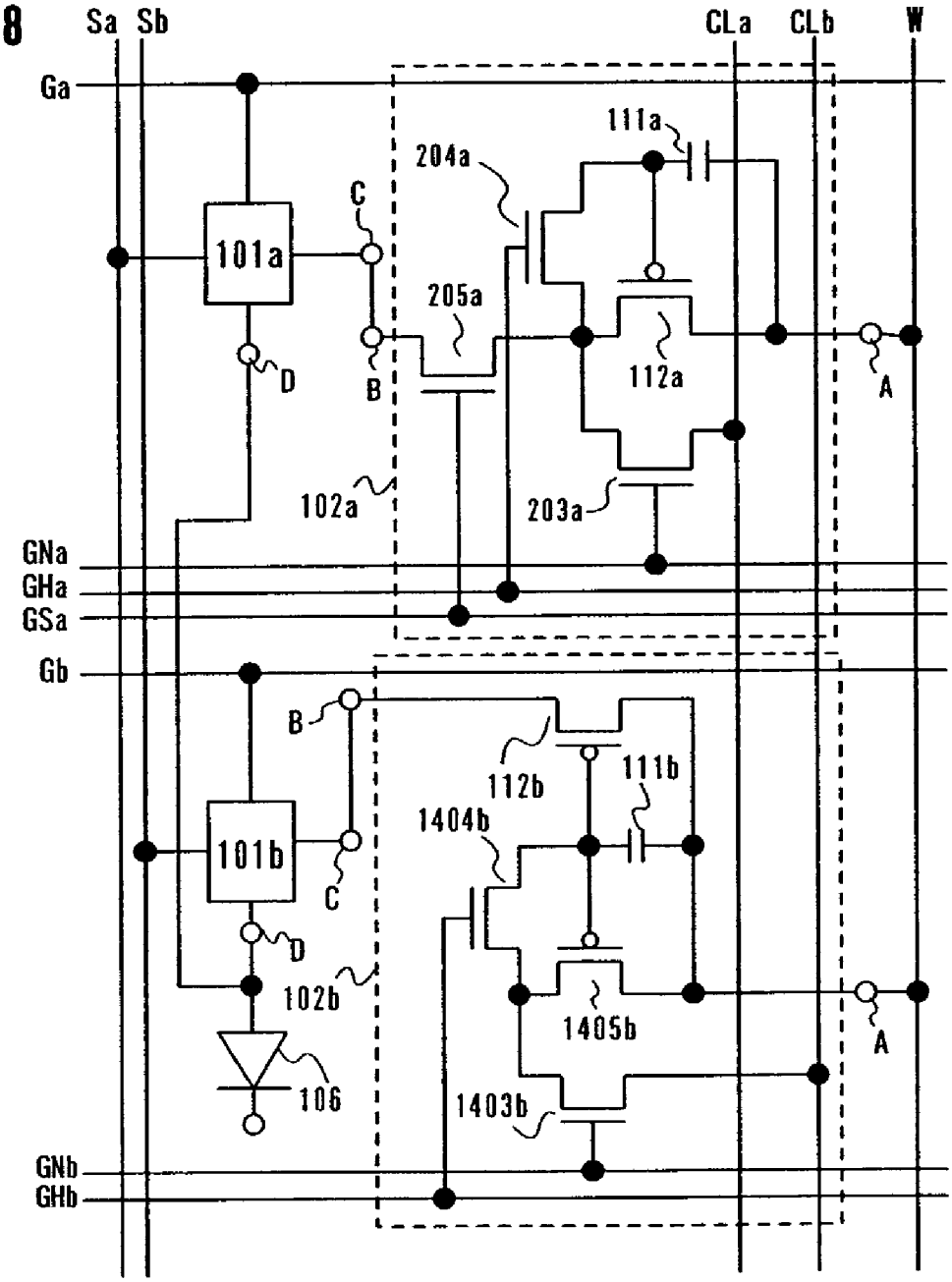
FIG. 18 is a view showing a structure of the pixel of the display device of the invention.

FIG. 18 shows the structure of the pixel of the second combination example. In addition, in FIG. 18, the same reference numerals and signs are given to the same portions as in FIG. 10A and FIG. 9A. In addition, a portion which corresponds to the first current source circuit is shown by adding a after the reference numerals of FIG. 10A, and a portion which corresponds to the second current source circuit is shown by adding b after the reference numerals of FIG. 9A. Also, description of a structure of the switch parts (a first switch part and a second switch part) of the respective pairs will be omitted here by referring to the embodiment 2.

Figure 40:
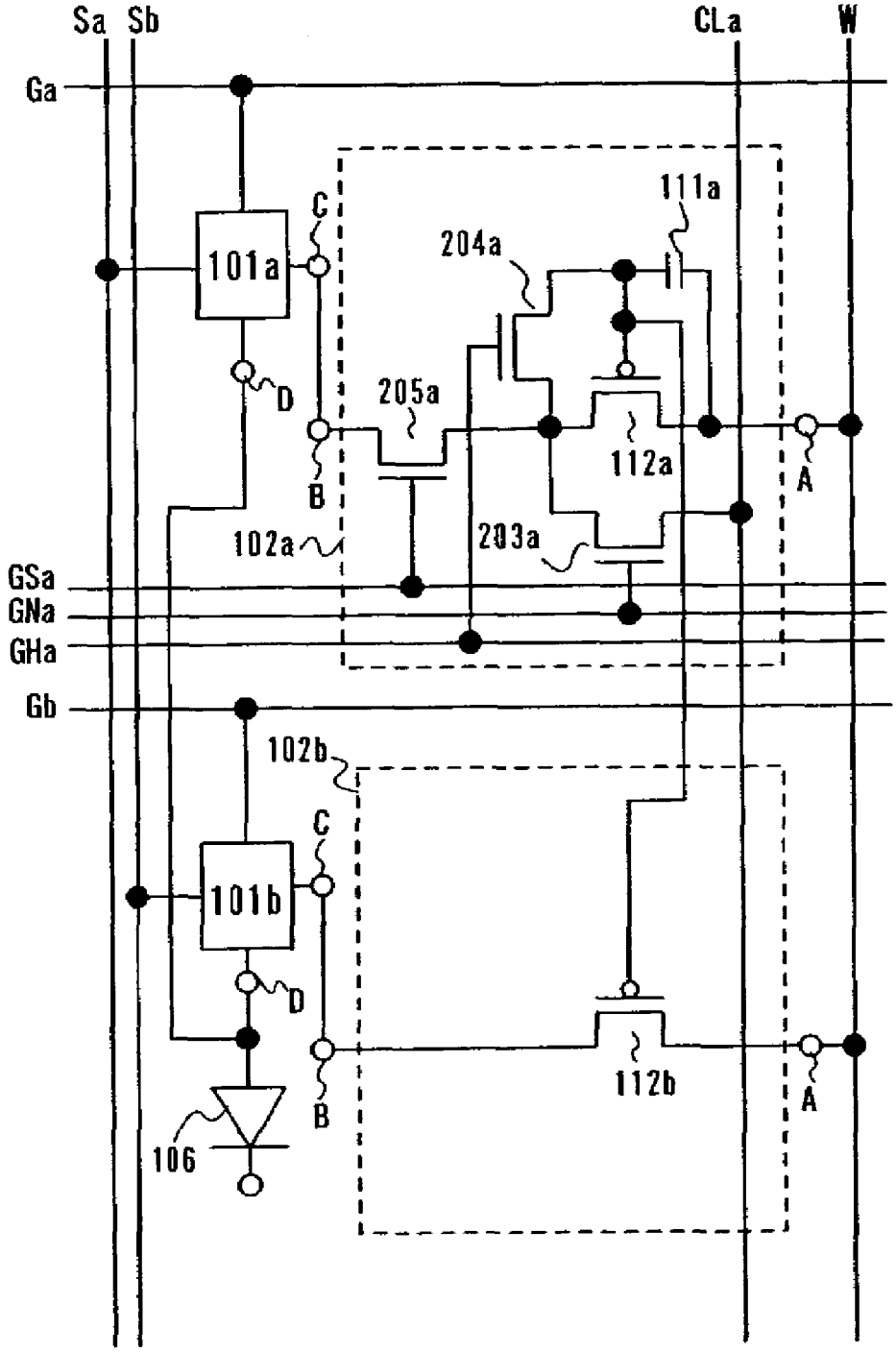
FIG. 40 is a view showing a structure of the pixel of the display device of the invention.

Here, the first current source circuit 102*a* and the second current source circuit 102*b* can share wirings and elements. Also, the first current source circuit 102*a* and the second current source circuit 102*b* can share the current source capacitance. This structure is shown in FIG. 40. In addition, the same reference numerals and signs are given to the same portions as in FIG. 18. In addition, it is possible to share the current transistor 1405*b* between different pixels.

Figure 19A:
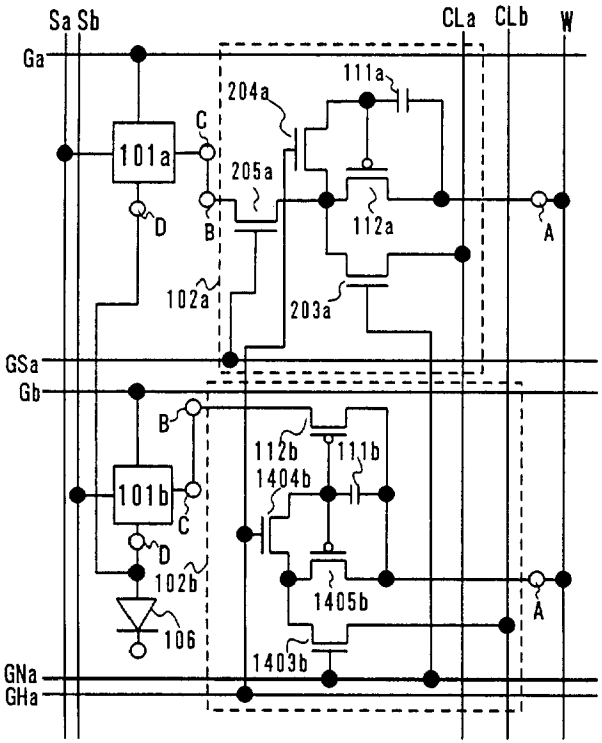
FIGS. 19A to 19C are views showing structures of the pixels of the display device of the invention.
Figure 19B:
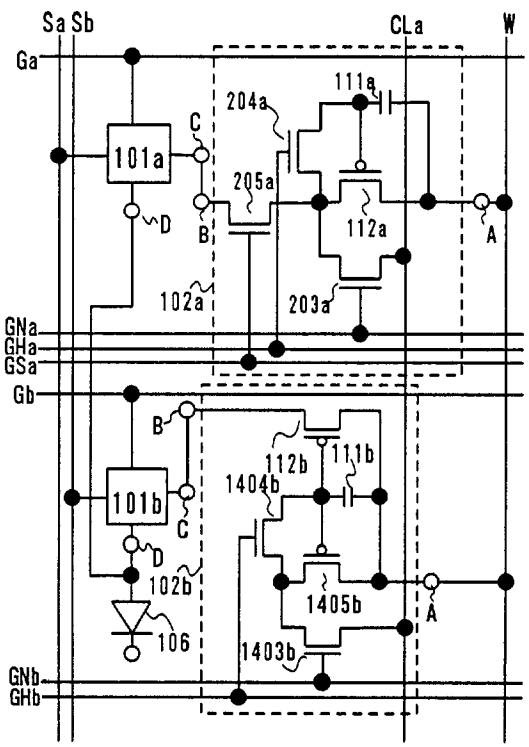
Figure 19C:
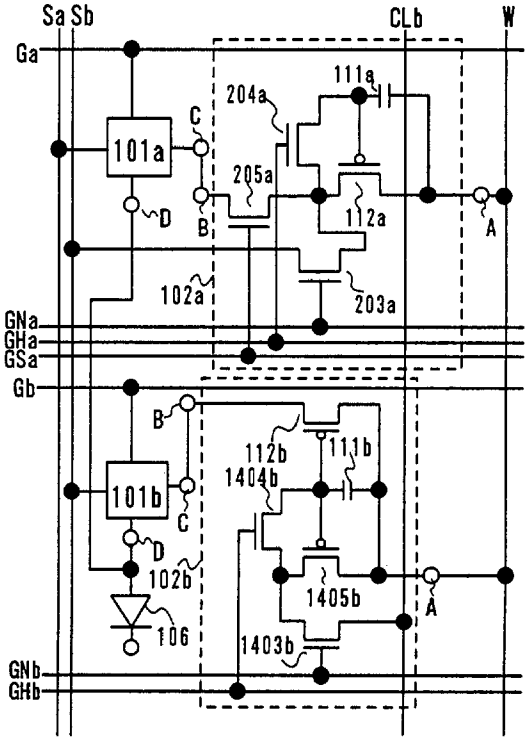

Also, signal lines can be shared. For example, a signal line GNa and a signal line GNb can be shared. Also, a signal line GHa and a signal line GHb can be shared. This structure is shown in FIG. 19A. Also, a current line CLa and a current line CLb can be shared. This structure is shown in FIG. 19B. Also, in lieu of the current line CLa, a signal line Sb can be used. This structure is shown in FIG. 19C. In addition, structures of FIG. 40, FIGS. 19A to 19C can be freely combined.

A way of setting of each current source circuit 102*a* and 102*b* is the same as in the embodiment 3. The current source circuits 102*a* is the same transistor type current source circuit. Thus, it is desirable that its setting operation is carried out in synchronous with the operation of the switch part. Also, current stop transistors 205 may be unnecessary depending upon a drive method. On one hand, the current source circuit 102*b* is the current mirror type current source circuit. Thus, it is possible to carry out its setting operation in asynchronous with the operation of the switch part.

In a pixel structure of this embodiment, in case that current values of currents which are outputted by the same transistor type current source circuit and the current mirror type current source circuit of each pixel are made to differ, it is desirable that an output current of the same transistor type current source circuit is set larger as compared to a current value of an output current of the current mirror type current source circuit. A reason thereof will be hereinafter described.

As described in the embodiment 3, in the same transistor type current source circuit, there is a necessity to input the control current which is of the same current value as the output current, but in the current mirror type current source circuit, it is possible to input the control current which is of the larger current value than the current value of the output current. By using the control current of larger current value, it is possible to realize the setting operation of the current source circuit quickly and accurately because of difficulty of coming under influence etc. of noise. On that account, in case that the output currents of the same current value are tentatively set, the setting operation of the current source circuit in the same transistor type current source circuit gets later than in the current mirror type current source circuit. Then, in the same transistor type current source circuit, it is desirable that the current value of the output current is made larger than that of the current mirror type current source circuit so that the current value of the control current is enlarged, and the setting operation of the current source circuit is carried out quickly and accurately.

Also, as described in the embodiment 3, in the current mirror type current source circuit, as compared to the same transistor type current source circuit, variation of the output current is larger. As to the output current of the current source circuit, the more its current value is, the larger influence of the variation appears. On that account, in case that the output currents of the same current value are tentatively set, variation of the output current becomes larger in the current mirror type current source circuit than in the same transistor type current source circuit. Then, in the current mirror type current source circuit, it is desirable that the current value of the output current is made smaller than that of the same transistor type current source circuit and variation of the output current is made smaller.

By the foregoing, in the pixel structure of this embodiment, in case that current values of currents which are outputted by the same transistor type current source circuit and the current mirror type current source circuit of each pixel respectively are made to differ, it is desirable that the current value of the output current of the same transistor type current source circuit is set larger as compared to the current value of the output current of the current mirror type current source circuit.

Also, in case that the pixel structure of FIG. 40 is used, it is desirable that the output current of the current source circuit 102*a* is set to be larger than the output current of the current source circuit 102*b*. By this means, by enlarging the output current of the current source circuit 102*a* for which the setting operation is carried out, it is possible to carry out the setting operation quickly. Also, in the current source circuit 102*b* in which the drain current of the transistor 112*b*, which is different from the transistor to which the control current is inputted, is set at the output current, it is possible to lessen the influence of variation by setting the output current smaller.

It is possible to realize this embodiment by being freely combined with the embodiment 1 to the embodiment 3.

Embodiment 6

In this embodiment, a structure and an operation of each pixel will be described. In addition, a case that each pixel has two pairs is taken as an example. And, a case that structures of two current source circuits of two pairs are selected from and combined with structures of the five current source circuits shown in the embodiment 3 will be described as an example.

Figure 1:
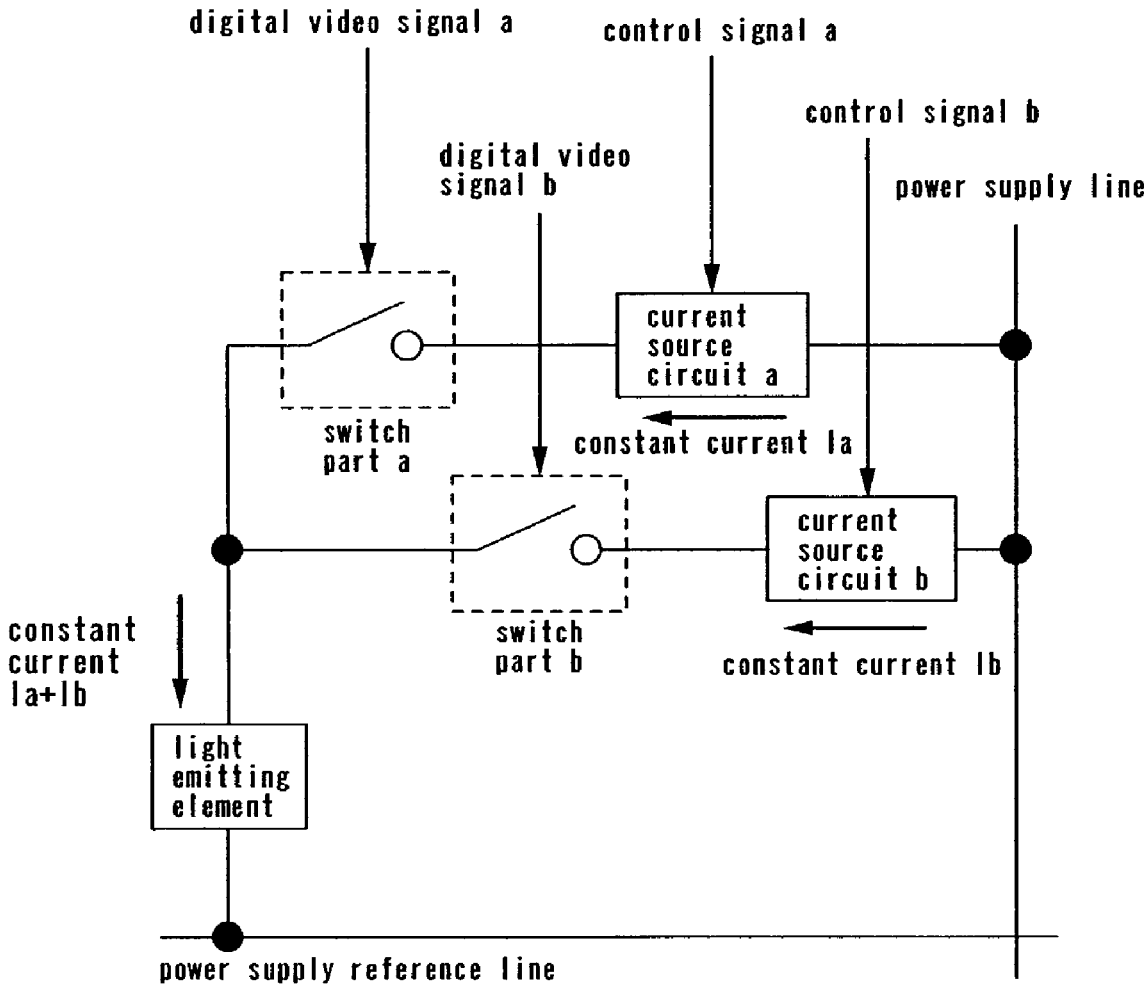
FIG. 1 is a schematic diagram showing a structure of a pixel of a display device of the invention.

In addition, a third combination example, which is different from the first combination example and the second combination example shown in the embodiment 4 and the embodiment 5, will be described. In the third combination example, one (a first current source circuit) of two current source circuit that the pixel has is the current source structure of the second structure shown in FIG. 10A. The other current source circuit (a second current source circuit) is the current source circuit of the third structure shown in FIG. 1A. In addition, since structures of these current source circuits are the same as in the embodiment 3, detail description will be omitted.

Figure 20:
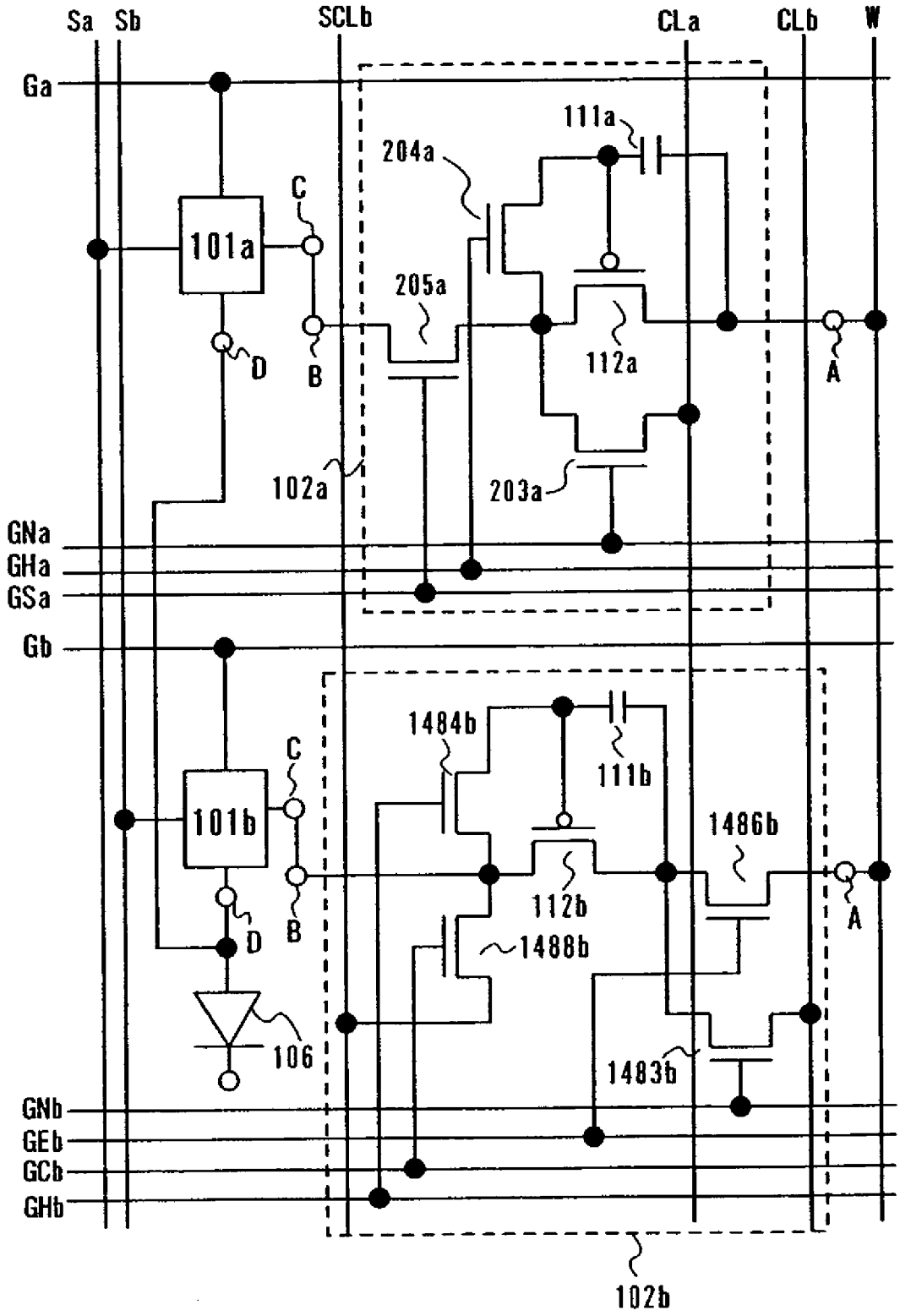
FIG. 20 is a view showing a structure of the pixel of the display device of the invention.

FIG. 20 shows the structure of the pixel of the third combination example. In addition, in FIG. 20, the same reference numerals and signs are given to the same portions as in FIG. 10A and FIG. 11A. In addition, a portion which corresponds to the first current source circuit is shown by adding a after the reference numerals of FIG. 10A, and a portion which corresponds to the second current source circuit is shown by adding b after the reference numerals of FIG. 11A. Also, description of a structure of the switch parts (a first switch part and a second switch part) of the respective pairs will be omitted here by referring to the embodiment 2.

Figure 21B:
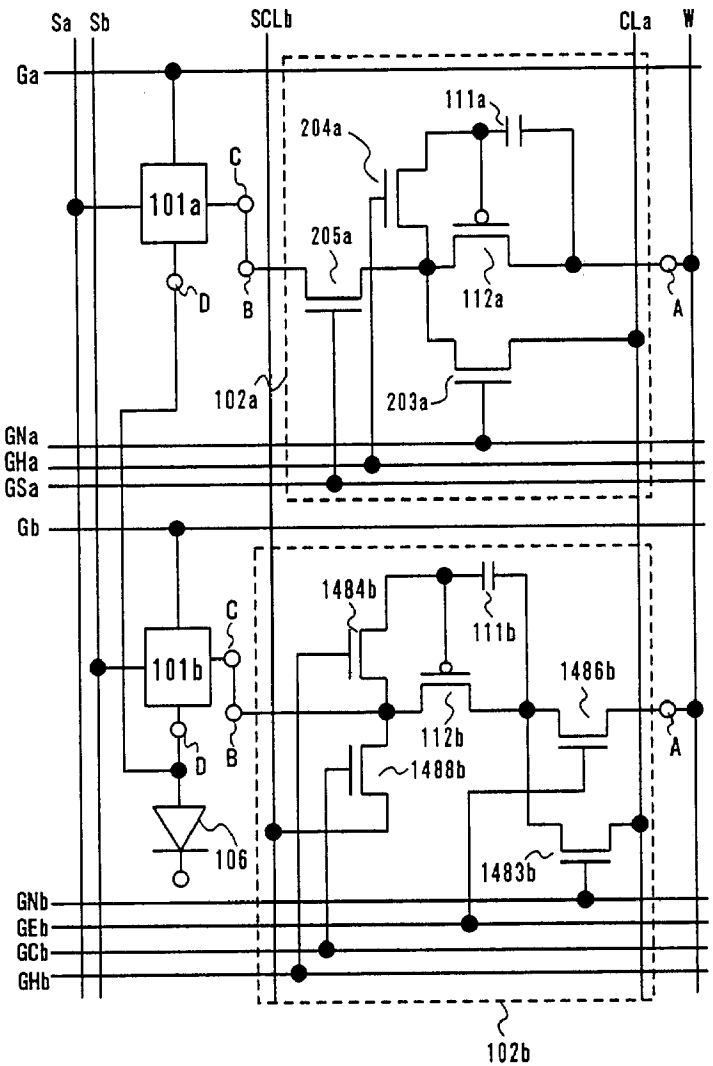
FIGS. 21A and 21B are views showing structures of the pixels of the display device of the invention.
Figure 21A:
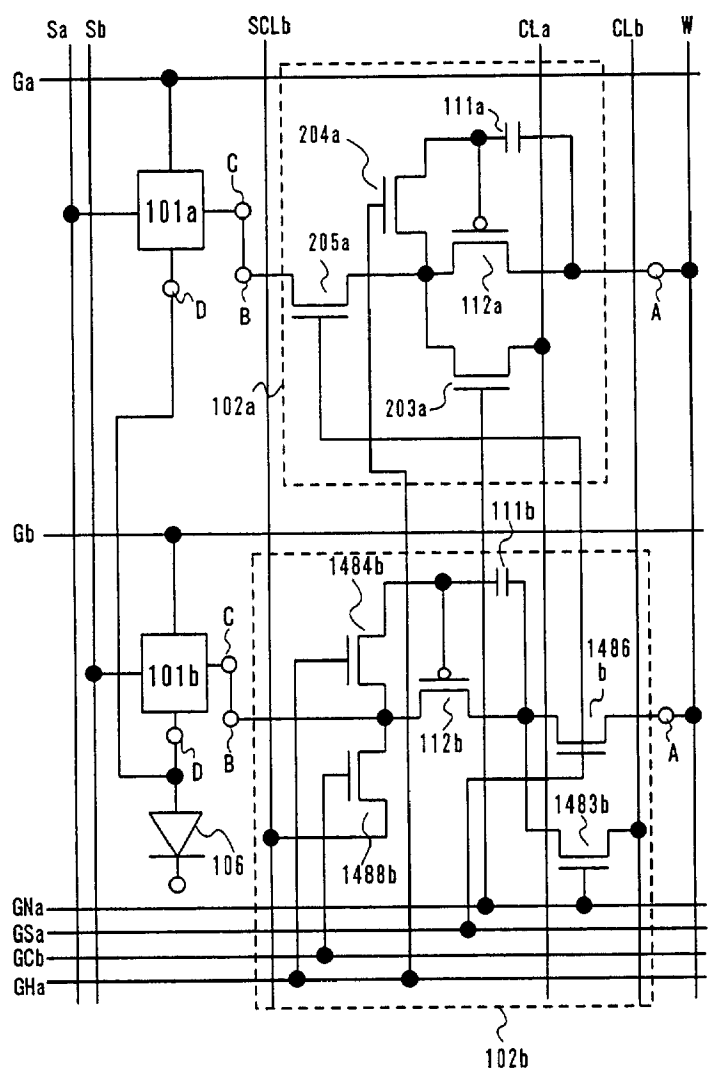

Here, the first current source circuit 102*a* and the second current source circuit 102*b* can share wirings and elements. Also, the first current source circuit 102*a* and the second current source circuit 102*b* can share the current source capacitor 111. This structure can be made to be the same as in FIG. 40. In addition, the same reference numerals and signs are given to the same portions as in FIG. 20. Also, signal lines can be shared. For example, a signal line GNa and a signal line GNb can be shared. Also, a signal line GHa and a signal line GHb can be shared. Furthermore, a signal line GSa and a signal line GEb can be shared. This structure is shown in FIG. 21A. Also, a current line CLa and a current line CLb can be shared. This structure is shown in FIG. 21B. In addition, structures of FIG. 40, FIGS. 21A and 21B can be freely combined.

A way of setting of each current source circuit 102*a* and 102*b* is the same as in the embodiment 3. The current source circuits 102*a* and the current source circuit 102*b* are the same transistor type current source circuit. Thus, it is desirable that its setting operation is carried out in synchronous with the operation of the switch part. Also, current stop transistors 205*a* may be unnecessary depending upon a drive method.

It is possible to realize this embodiment by being freely combined with the embodiment 1 to the embodiment 3.

Embodiment 7

In this embodiment, a structure and an operation of each pixel will be described. In addition, a case that each pixel has two pairs is taken as an example. And, a case that structures of two current source circuits of two pairs are selected from and combined with structures of the five current source circuits shown in the embodiment 3 will be described as an example.

In addition, a fourth combination example, which is different from the first combination example to the third combination example shown in the embodiment 4 to the embodiment 6, will be described. In the fourth combination example, one (a first current source circuit) of two current source circuits that the pixel has is the current source structure of the second structure shown in FIG. 10A. The other current source circuit (a second current source circuit) is the current source circuit of the fourth structure shown in FIG. 12A. In addition, since a structure of these current source circuits is the same as in the embodiment 3, detail description will be omitted.

Figure 22:
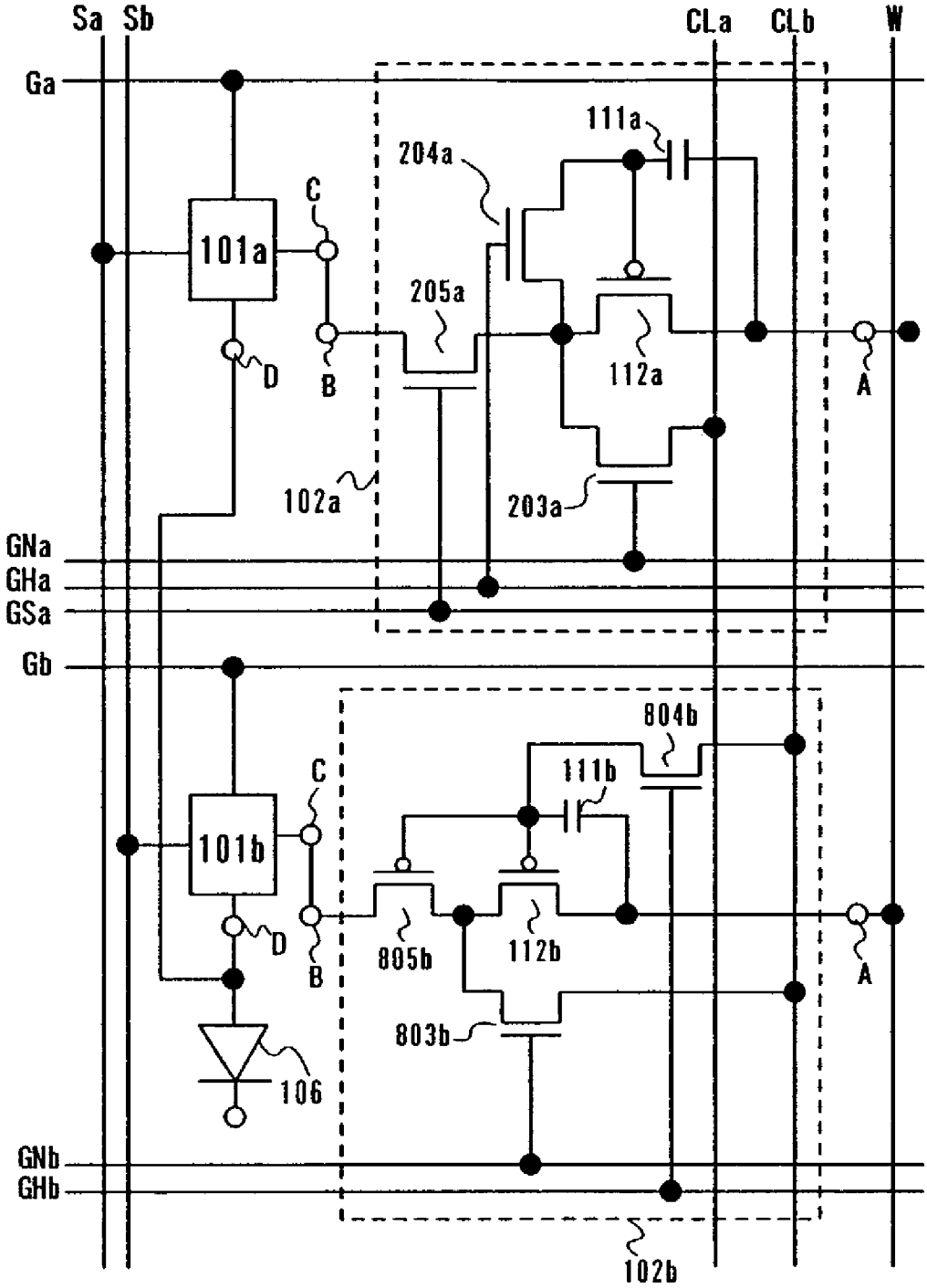
FIG. 22 is a view showing a structure of the pixel of the display device of the invention.

FIG. 22 shows the structure of the pixel of the fourth combination example. In addition, in FIG. 22, the same reference numerals and signs are given to the same portions as in FIG. 10A and FIG. 12A. In addition, a portion which corresponds to the first current source circuit is shown by adding a after the reference numerals of FIG. 10A, and a portion which corresponds to the second current source circuit is shown by adding b after the reference numerals of FIG. 12A. Also, description of a structure of the switch parts (a first switch part and a second switch part) of the respective pairs will be omitted here by referring to the embodiment 2.

Figure 23A:
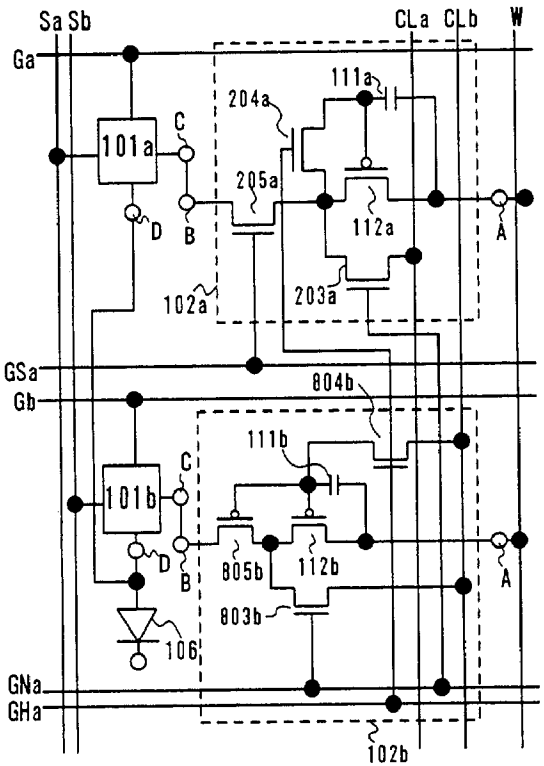
FIGS. 23A to 23C are views showing structures of the pixels of the display device of the invention.
Figure 23B:
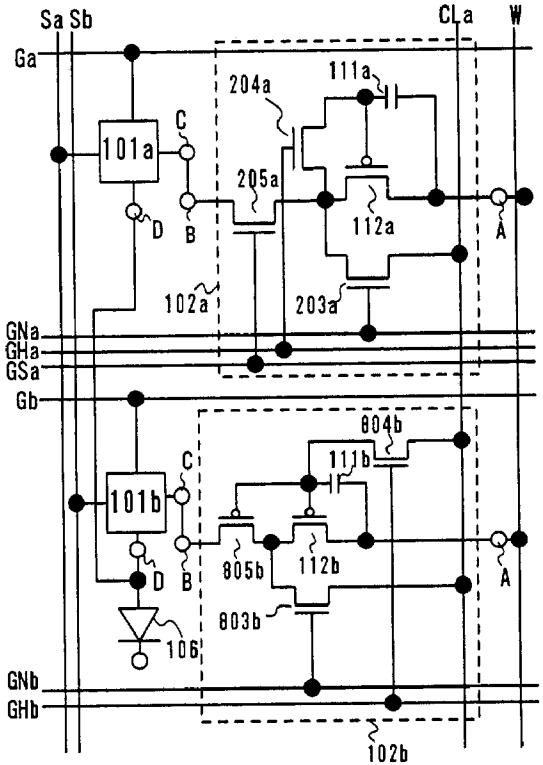
Figure 23C:
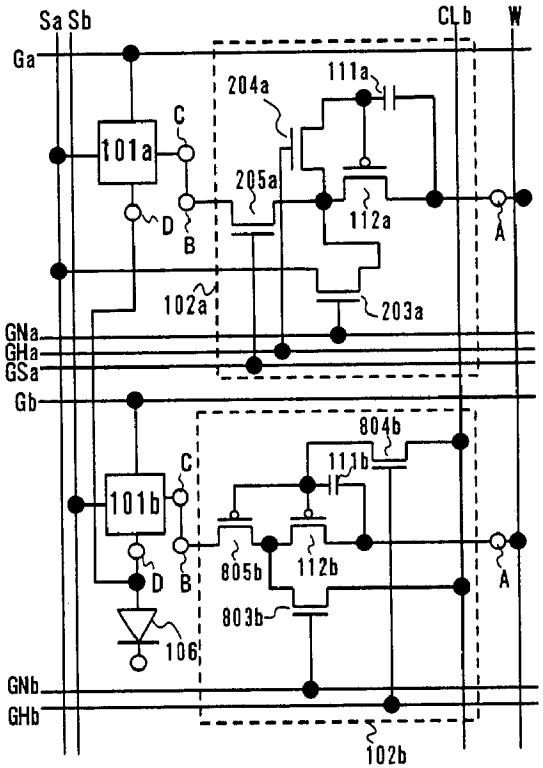

Here, the first current source circuit 102*a* and the second current source circuit 102*b* can share wirings and elements. For example, signal lines can be shared. For example, a signal line GNa and a signal line GNb can be shared. Also, a signal line GHa and a signal line GHb can be shared. This structure is shown in FIG. 23A. Also, a current line CLa and a current line CLb can be shared. This structure is shown in FIG. 23B. Also, in lieu of the current line CLa, a signal line Sa can be used. This structure is shown in FIG. 23C. In addition, structures of FIGS. 23A to 23C can be freely combined.

A way of setting of each current source circuit 102*a* and 102*b* is the same as in the embodiment 3. The current source circuit 102*a* is the same transistor type current source circuit. Thus, it is desirable that its setting operation is carried out in synchronous with the operation of the switch part. Also, the current source circuit 102*b* is the multi-gate type current source circuit. Thus, it is desirable that its setting operation is carried out in synchronous with the operation of the switch part. Also, current stop transistors 205 a may be unnecessary depending upon a drive method.

In a pixel structure of this embodiment, in case that current values of currents which are outputted by the same transistor type current source circuit and the multi-gate type current source circuit of each pixel are made to differ, it is desirable that an output current of the same transistor type current source circuit is set larger as compared to a current value of an output current of the multi-gate type current source circuit. A reason thereof will be hereinafter described.

As described in the embodiment 3, in the same transistor type current source circuit, there is a necessity to input the control current which is of the same current value as the output current, but in the multi-gate type current source circuit, it is possible to input the control current which is of the larger current value than the current value of the output current. By using the control current of larger current value, it is possible to realize the setting operation of the current source circuit quickly and accurately because of difficulty of coming under influence etc. of noise. On that account, in case that the output currents of the same current value are tentatively set, the setting operation of the current source circuit in the same transistor type current source circuit gets later than in the multi-gate type current source circuit. Then, in the same transistor type current source circuit, it is desirable that the current value of the output current is made larger than that of the multi-gate type current source circuit so that the current value of the control current is enlarged, and the setting operation of the current source circuit is carried out quickly and accurately.

Also, as described in the embodiment 3, in the multi-gate type current source circuit, as compared to the same transistor type current source circuit, variation of the output current is larger. As to the output current of the current source circuit, the more its current value is, the larger influence of the variation appears. On that account, in case that the output currents of the same current value are tentatively set, variation of the output current becomes larger in the multi-gate type current source circuit than in the same transistor type current source circuit. Then, in the multi-gate type current source circuit, it is desirable that the current value of the output current is made smaller than that of the same transistor type current source circuit and variation of the output current is made smaller.

By the foregoing, in the pixel structure of this embodiment, in case that current values of currents which are outputted by the same transistor type current source circuit and the multi-gate type current source circuit of each pixel respectively are made to differ, it is desirable that the current value of the output current of the same transistor type current source circuit is set larger as compared to the current value of the output current of the multi-gate type current source circuit.

It is possible to realize this embodiment by being freely combined with the embodiment 1 to the embodiment 3.

Embodiment 8

In this embodiment, a structure and an operation of each pixel will be described. In addition, a case that each pixel has two pairs is taken as an example. And, a case that structures of two current source circuits of two pairs are selected from and combined with structures of the five current source circuits shown in the embodiment 3 will be described as an example.

In addition, a fifth combination example, which is different from the first combination example to the fourth combination example shown in the embodiment 4 to the embodiment 7, will be described. In the fifth combination example, one (a first current source circuit) of two current source circuits that the pixel has is the current source structure of the second structure shown in FIG. 10A. The other current source circuit (a second current source circuit) is the current source circuit of the fifth structure shown in FIG. 13A. In addition, since a structure of these current source circuits is the same as in the embodiment 3, detail description will be omitted.

Figure 24:
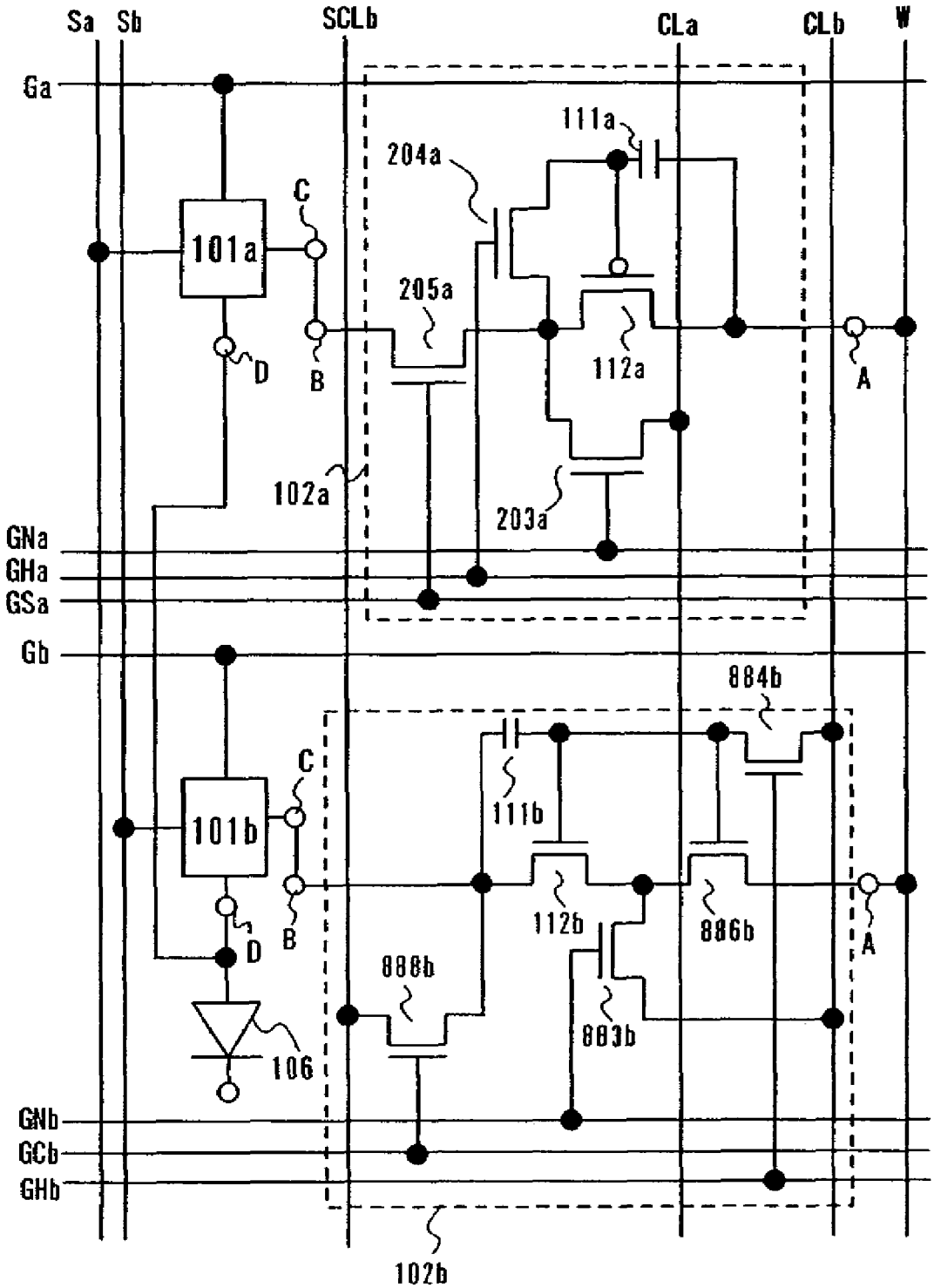
FIG. 24 is a view showing a structure of the pixel of the display device of the invention.

FIG. 24 shows the structure of the pixel of the fifth combination example. In addition, in FIG, 24, the same reference numerals and signs are given to the same portions as in FIG. 10A and FIG. 13A. In addition, a portion which corresponds to the first current source circuit is shown by adding a after the reference numerals of FIG. 10A, and a portion which corresponds to the second current source circuit is shown by adding b after the reference numerals of FIG. 13A. Also, description of a structure of the switch parts (a first switch part and a second switch part) of the respective pairs will be omitted here by referring to the embodiment 2.

Figure 25B:
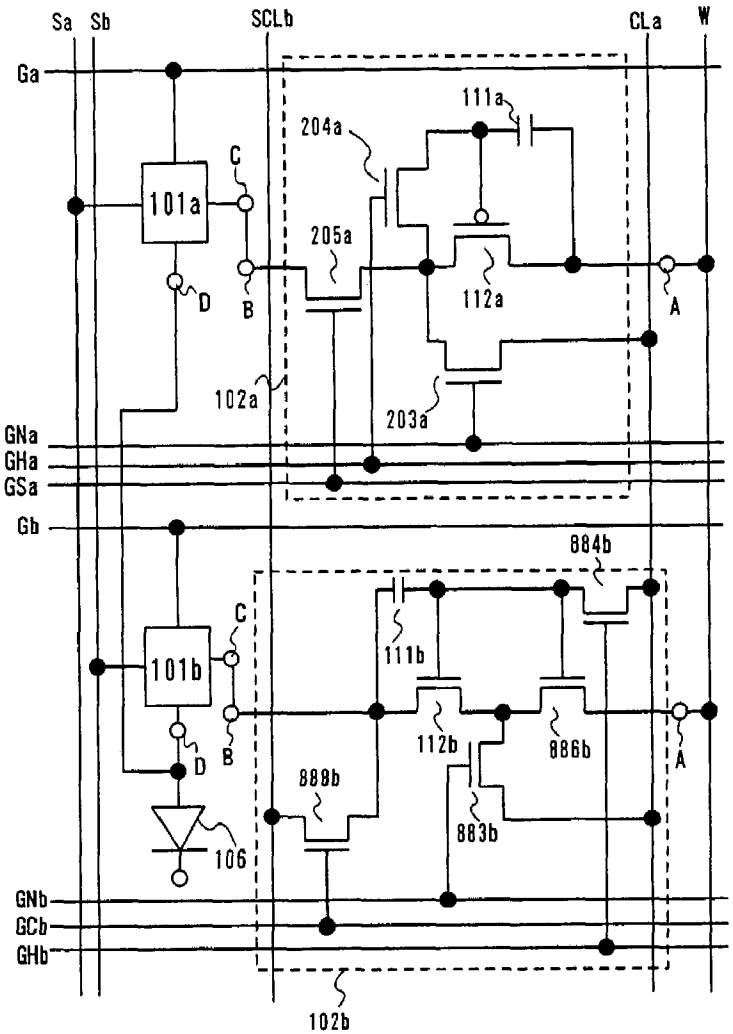
FIGS. 25A and 25B are views showing structures of the pixels of the display device of the invention.
Figure 25A:
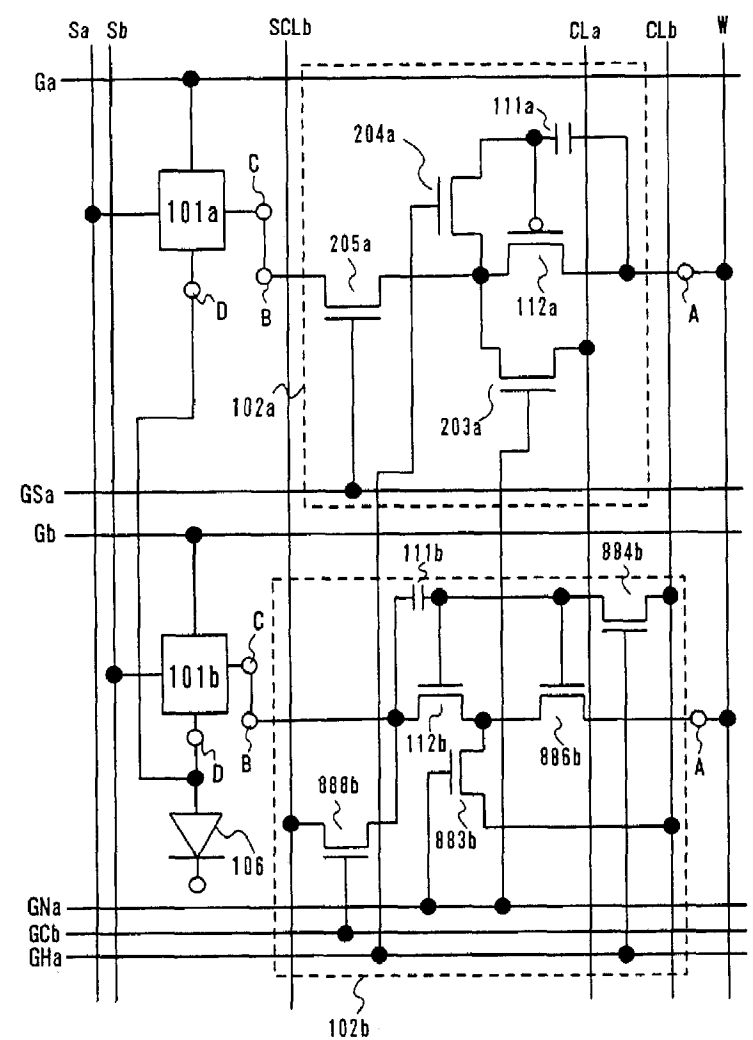
Figure 26:
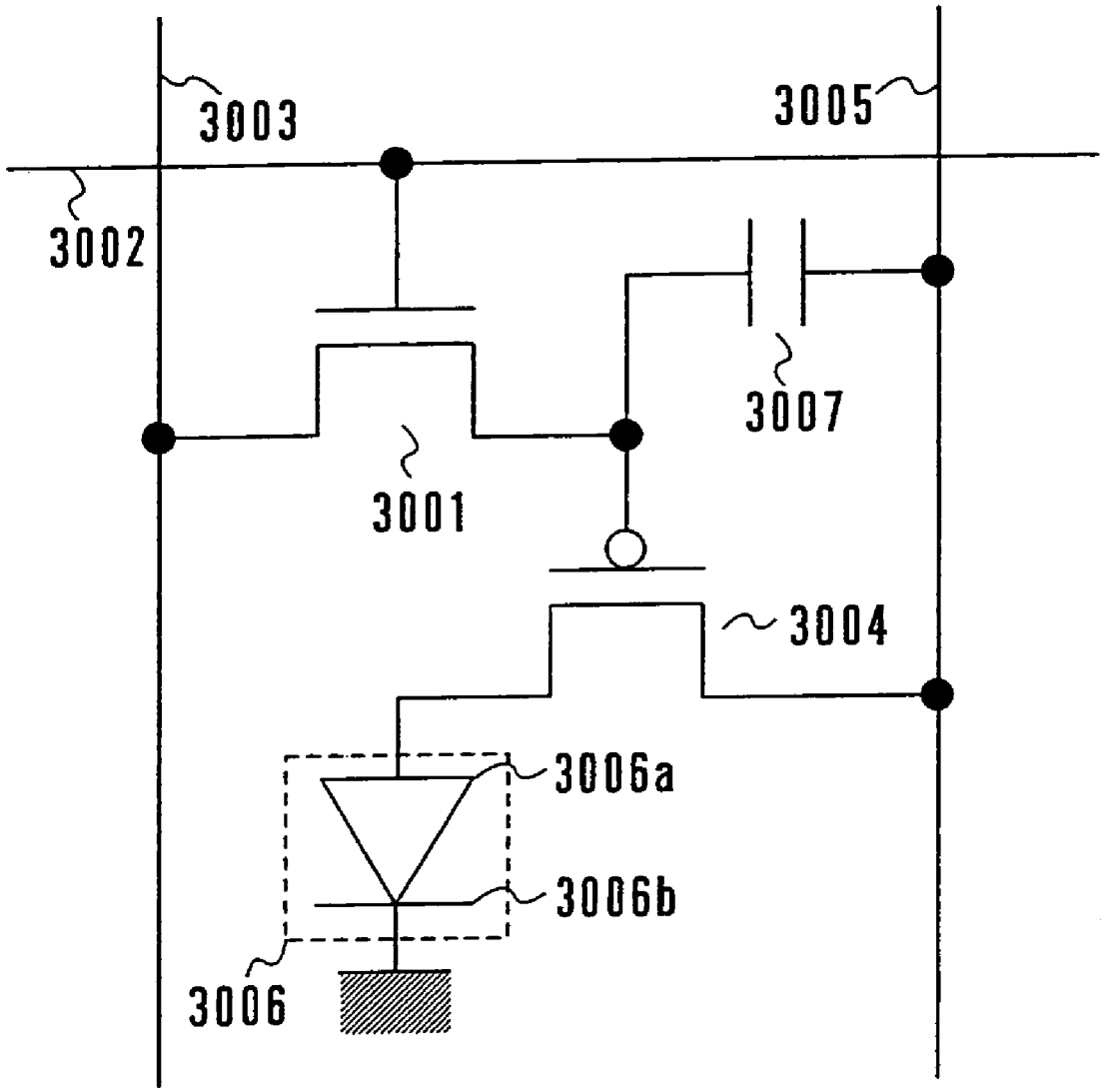
FIG. 26 is a view showing a structure of a pixel of a conventional display device.
Figure 27B:
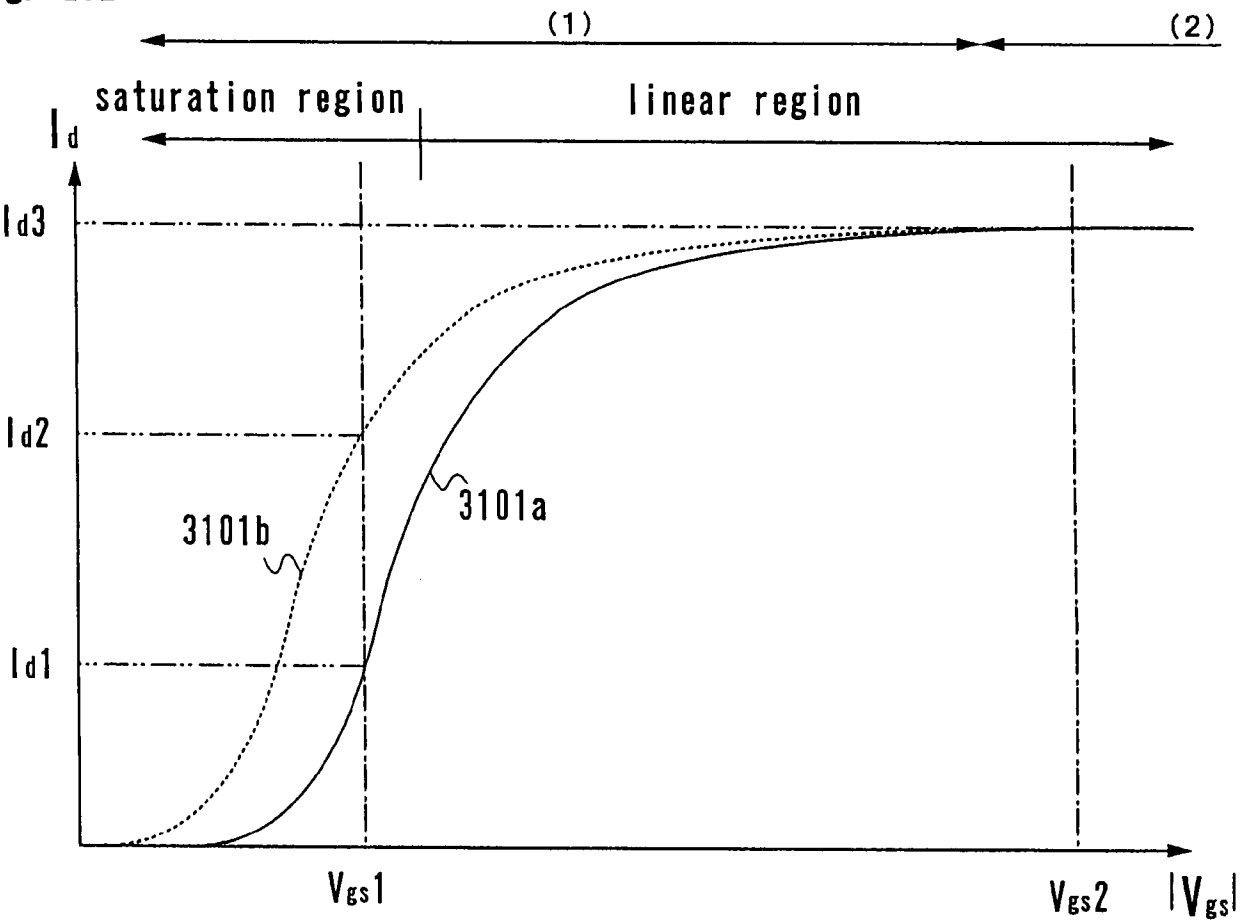
FIGS. 27A and 27B are views showing an operation region of a driving TFT of the conventional display device.
Figure 27A:
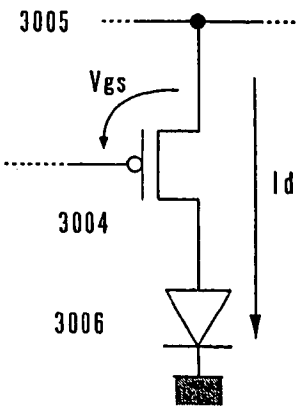
PRIOR ART Fig. 27A
Figure 28:
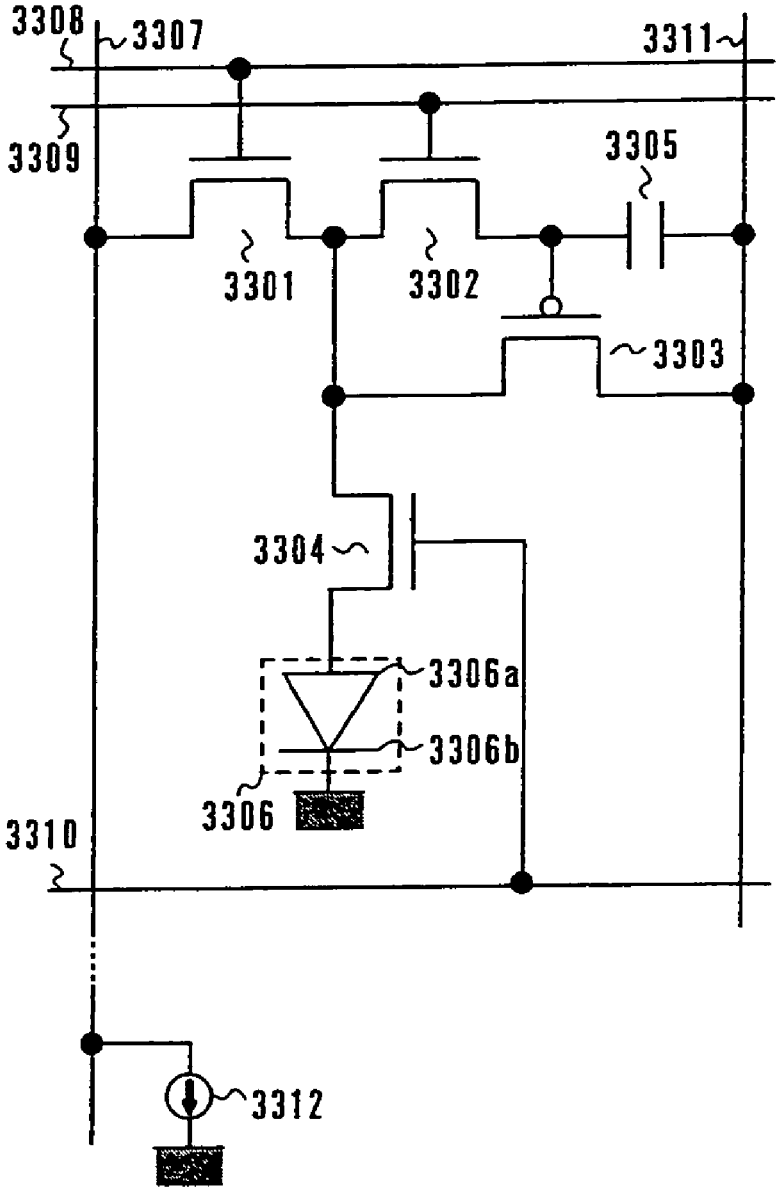
FIG. 28 is a view showing a structure of a pixel of the conventional display device.
Figure 30A:
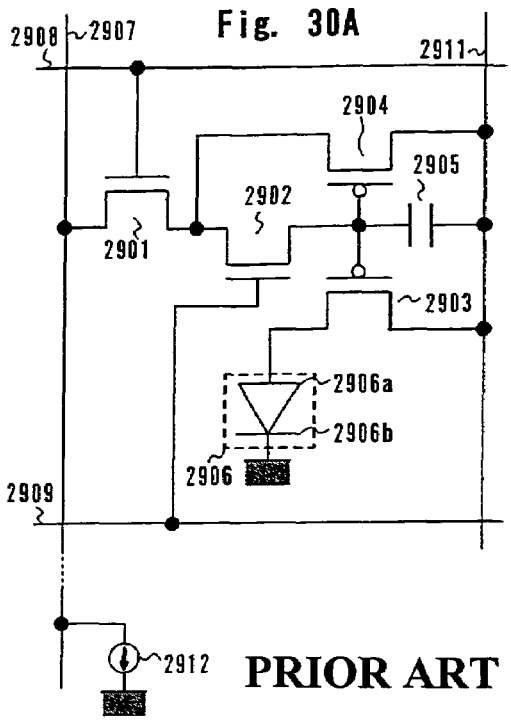
FIGS. 30A to 30D are views showing the structure and the operation of the pixel of the conventional display device.
Figure 30B:
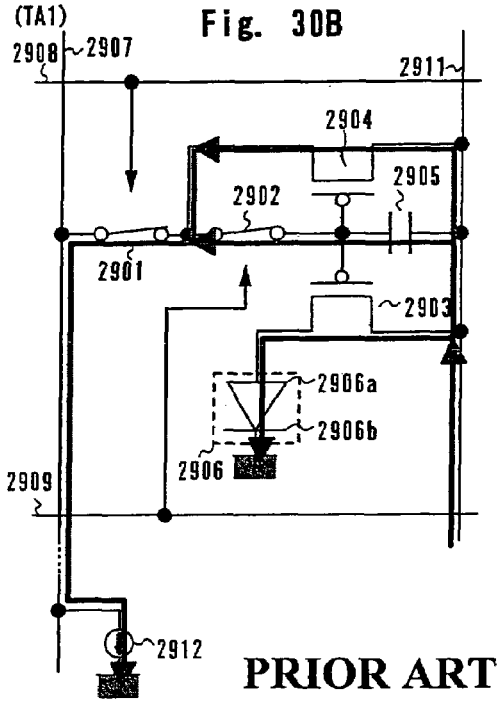
PRIOR ART Fig. 30B
Figure 30C:
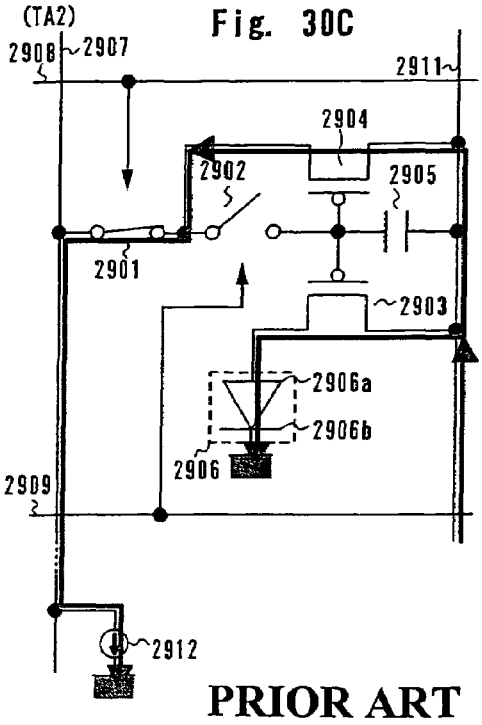
PRIOR ART Fig. 30C
Figure 30D:
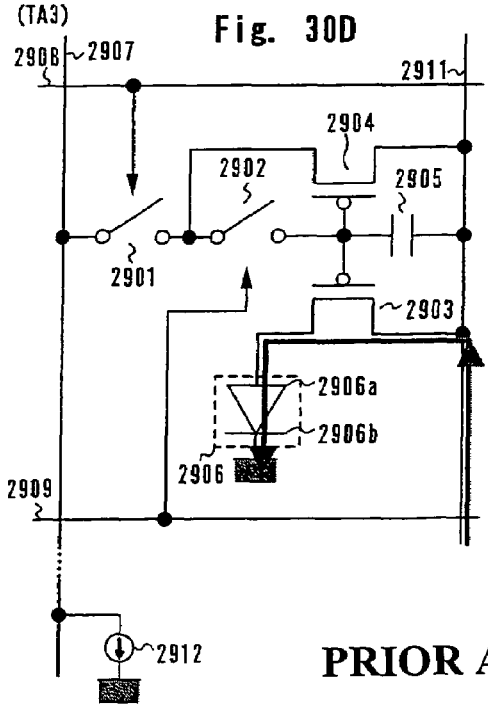
PRIOR ART Fig. 30D
Figure 31A:
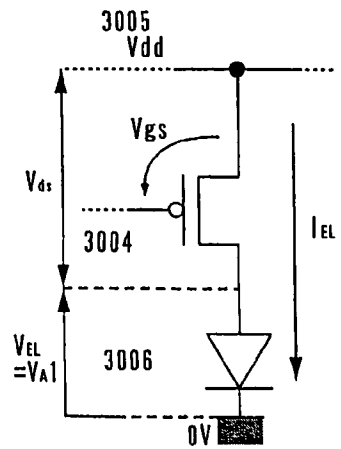
FIGS. 31A and 31B are views showing the operation region of the driving TFT of the conventional display device.
Figure 31B:
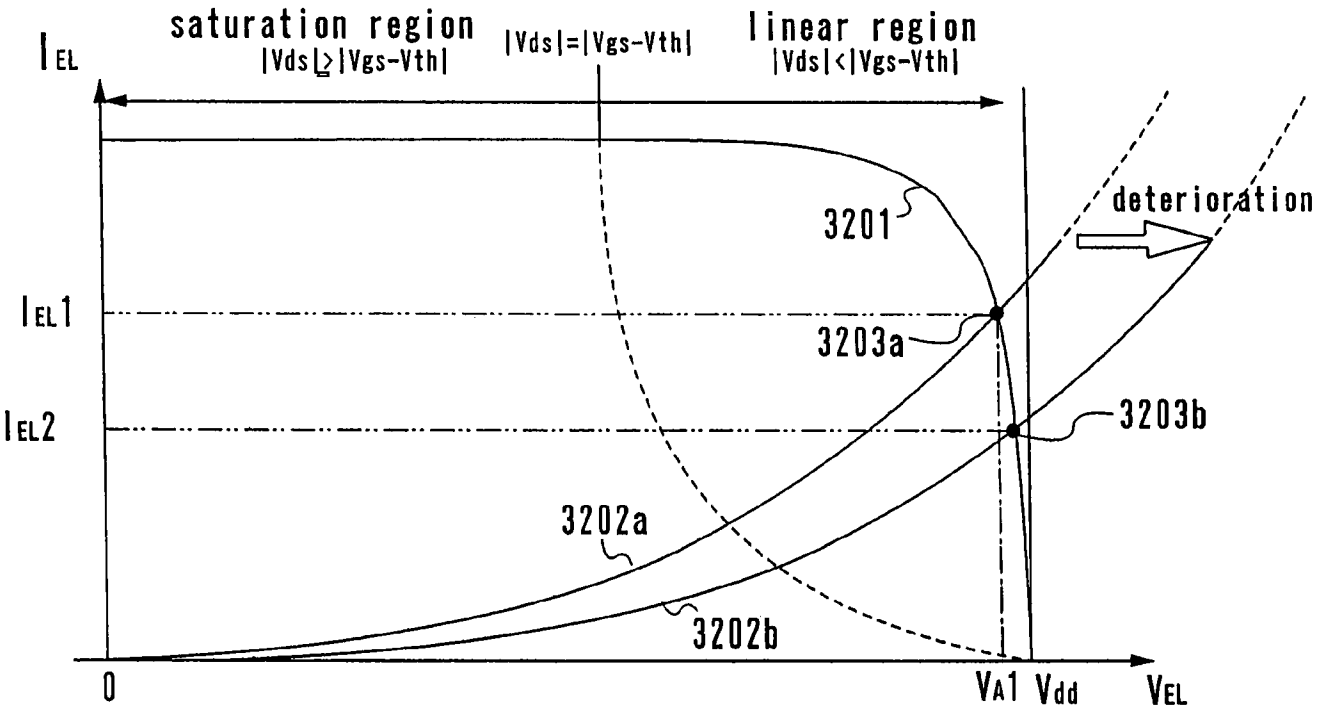
PRIOR ART Fig. 31B
Figure 32A:
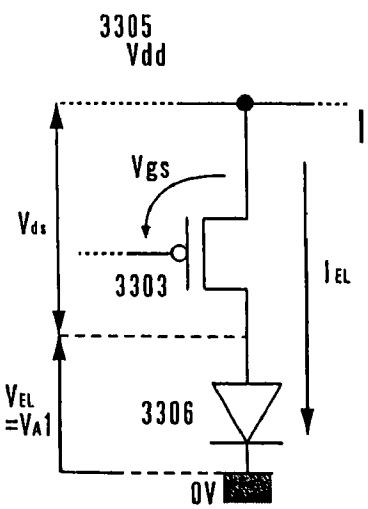
FIGS. 32A and 32B are views showing the operation region of the driving TFT of the conventional display device.
Figure 32B:
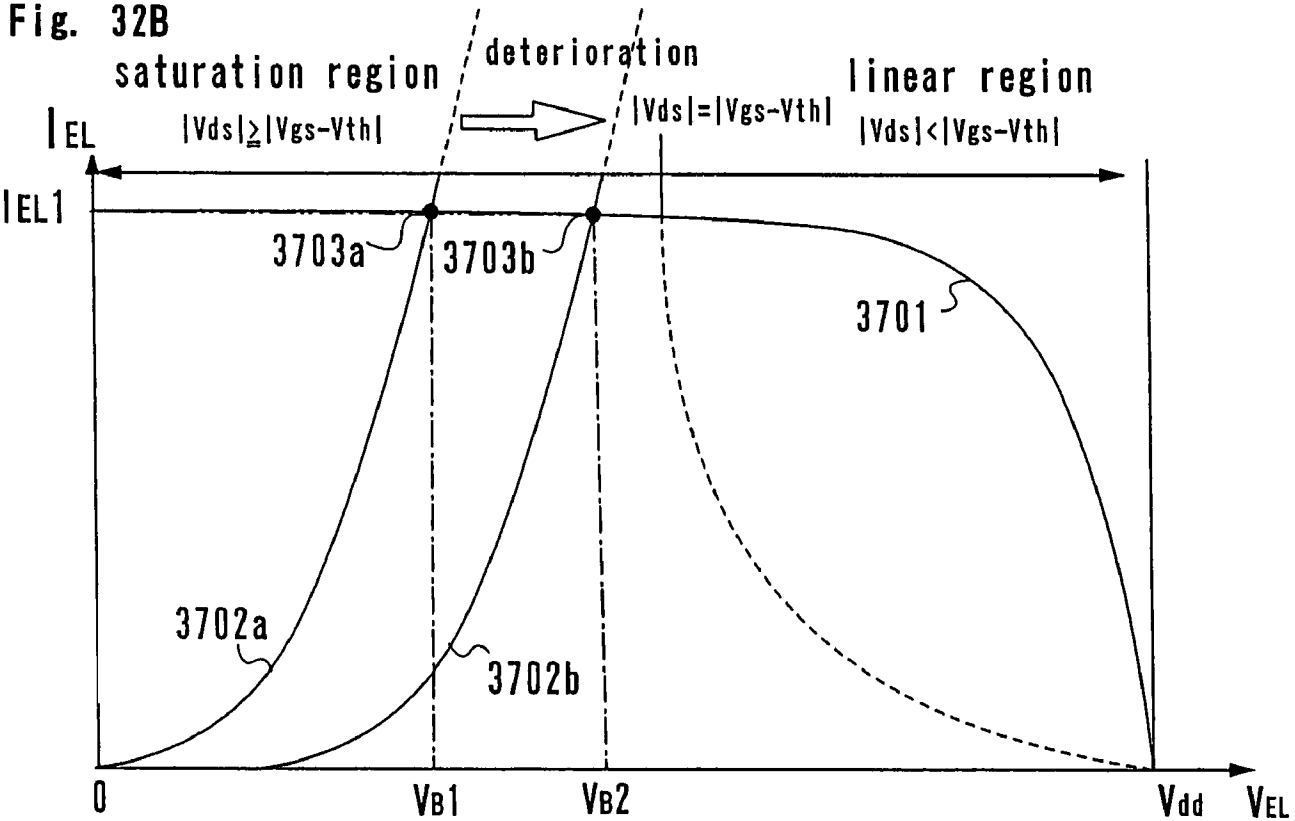
PRIOR ART Fig. 32B

Here, the first current source circuit 102*a* and the second current source circuit 102*b* can share wirings and elements. For example, signal lines can be shared. For example, a signal line GNa and a signal line GNb can be shared. Also, a signal line GHa and a signal line GHb can be shared. This structure is shown in FIG. 25A. Also, a current line CLa and a current line CLb can be shared. This structure is shown in FIG. 25B. In addition, structures of FIGS. 25A and 25B can be freely combined.

A way of setting of each current source circuit 102*a* and 102*b* is the same as in the embodiment 3. The current source circuit 102*a* is the same transistor type current source circuit. Thus, it is desirable that its setting operation is carried out in synchronous with the operation of the switch part. Also, the current source circuit 102*b* is the multi-gate type current source circuit. Thus, it is desirable that its setting operation is carried out in synchronous with the operation of the switch part. Also, current stop transistor 205*a* may be unnecessary depending upon a drive method.

In a pixel structure of this embodiment, in case that current values of currents which are outputted by the same transistor type current source circuit and the multi-gate type current source circuit of each pixel are made to differ, it is desirable that a current value of an output current of the same transistor type current source circuit is set larger as compared to a current value of an output current of the multi-gate type current source circuit. A reason thereof will be hereinafter described.

It is possible to realize this embodiment by being freely combined with the embodiment 1 to the embodiment 3.

Embodiment 9

In this embodiment, shown are four concrete examples in case that, in the pixel structure of the invention, gray scale is expressed by being combined with the time gray scale system. In addition, since a basic explanation relating to the time gray scale system is carried out in the embodiment 2, the explanation will be omitted here. In this embodiment, a case of expressing 64 gray scale will be shown as an example.

A first example is shown. By appropriately determining the output currents of a plurality of the current source circuits that each pixel has, the current value (I) of the current flowing through the light emitting element is changed with a ratio of 1:2. In this moment, one frame period is divided into two sub frame periods, and a ratio of a length (T) of the display period of each sub frame period is set to become 1:4:16. By this means, as shown in a table 1, by the combination of the current (represented by a current I) flowing through the light emitting element and the length (represented by a period T) of the display period, it is possible to express 64 gray scale.

TABLE 1

| | period T | | |
|---|---|---|---|
| current I | 1 | 4 | 16 |
| 1 | 1 | 4 | 16 |
| 2 | 2 | 8 | 32 |

A second example is shown. By appropriately determining the output currents of a plurality of the current source circuits that each pixel has, the current value (I) of the current flowing through the light emitting element is changed with a ratio of 1:4. In this moment, one frame period is divided into two sub frame periods, and a ratio of a length (T) of the display period of each sub frame period is set to become 1:2:16. By this means, as shown in a table 2, by the combination of the current I flowing through the light emitting element and the period T, it is possible to express 64 gray scale.

TABLE 2

| | period T | | |
|---|---|---|---|
| current I | 1 | 2 | 16 |
| 1 | 1 | 2 | 16 |
| 4 | 4 | 8 | 64 |

A third example is shown. By appropriately determining the output currents of a plurality of pairs of source circuits that each pixel has, the current value (I) of the current flowing through the light emitting element is changed with a ratio of 1:2:4. In this moment, one frame period is divided into three sub frame periods, and a ratio of a length (T) of the display period of each sub frame period is set to become 1:8. By this means, as shown in a table 3, by the combination of the current I flowing through the light emitting element and the period T, it is possible to express 64 gray scale.

TABLE 3

| | period T | |
|---|---|---|
| current I | 1 | 8 |
| 1 | 1 | 8 |
| 2 | 2 | 16 |
| 4 | 4 | 32 |

A fourth example is shown. By appropriately determining the output currents of a plurality of the current source circuits that each pixel has, the current value (I) of the current flowing through the light emitting element is changed with a ratio of 1:4:16. In this moment, one frame period is divided into three sub frame periods, and a ratio of a length (T) of the display period of each sub frame period is set to become 1:2. By this means, as shown in a table 4, by the combination of the current I flowing through the light emitting element and the period T, it is possible to express 64 gray scale.

TABLE 4

| | period T | |
|---|---|---|
| current I | 1 | 2 |
| 1 | 1 | 2 |
| 4 | 4 | 8 |
| 16 | 16 | 32 |

In addition, it is possible to realize this embodiment by being freely combined with the embodiment 1 to the embodiment 8.

Embodiment 10

In the embodiment 1 to the embodiment 9, shown was the structure in which each pixel has a plurality of the current source circuits and the switch parts. However, it may be a structure that each pixel has one pair of the current source circuit and the switch part.

In case that there is one pair in each pixel, it is possible to express 2 gray scale. In addition, by combined with other gray scale display method, it is possible to realize multiple gray scale. For example, it is possible to carry out gray scale display by combined with the time gray scale system.

It is possible to realize this embodiment by being freely combined with the embodiment 1 to the embodiment 9.

Embodiment 11

It may be a structure that each pixel has three and more current source circuits. For example, in the first combination example to the fifth combination example shown in the embodiment 4 to the embodiment 8, it is possible to add a circuit arbitrarily selected from the current source circuits of the five structures shown in the embodiment 3.

It is possible to realize this embodiment by being freely combined with the embodiment 1 to the embodiment 10.

Embodiment 12

In this embodiment, a structure of a driving circuit which inputs the control signal to each pixel in the display device of the invention will be described.

If varied is the control current which is inputted to each pixel, the current value of the current that the current source circuit of each pixel outputs will be also varied. On that account, there occurs a necessity of a driving circuit of a structure that approximately a constant control current is outputted to each current line. An example of such driving circuit will be hereinafter shown.

For example, it is possible to use a signal line driving circuit of a structure shown in Patent Application No. 2001-333462, Patent Application No. 2001-333466, Patent Application No. 2001-333470, Patent Application No. 2001-335917 or Patent Application No. 2001-335918. In short, by setting the output current of the signal line driving circuit at the control current, it is possible to input it to each pixel.

In the display device of the invention, by applying the above-described signal line driving circuit, it is possible to input approximately a constant control current to each pixel. By this means, it is possible to further reduce variation of luminance of an image.

It is possible to realize this embodiment by being freely combined with the embodiment 1 to the embodiment 11.

Embodiment 13

In this embodiment, a display system to which the invention is applied will be described.

Here, the display system includes a memory which stores video signals which are inputted to the display device, a circuit which outputs a control signal (a clock pulse, a start pulse, etc.) which is inputted to each driving circuit of the display device, a controller which controls them, and so on.

Figure 41:
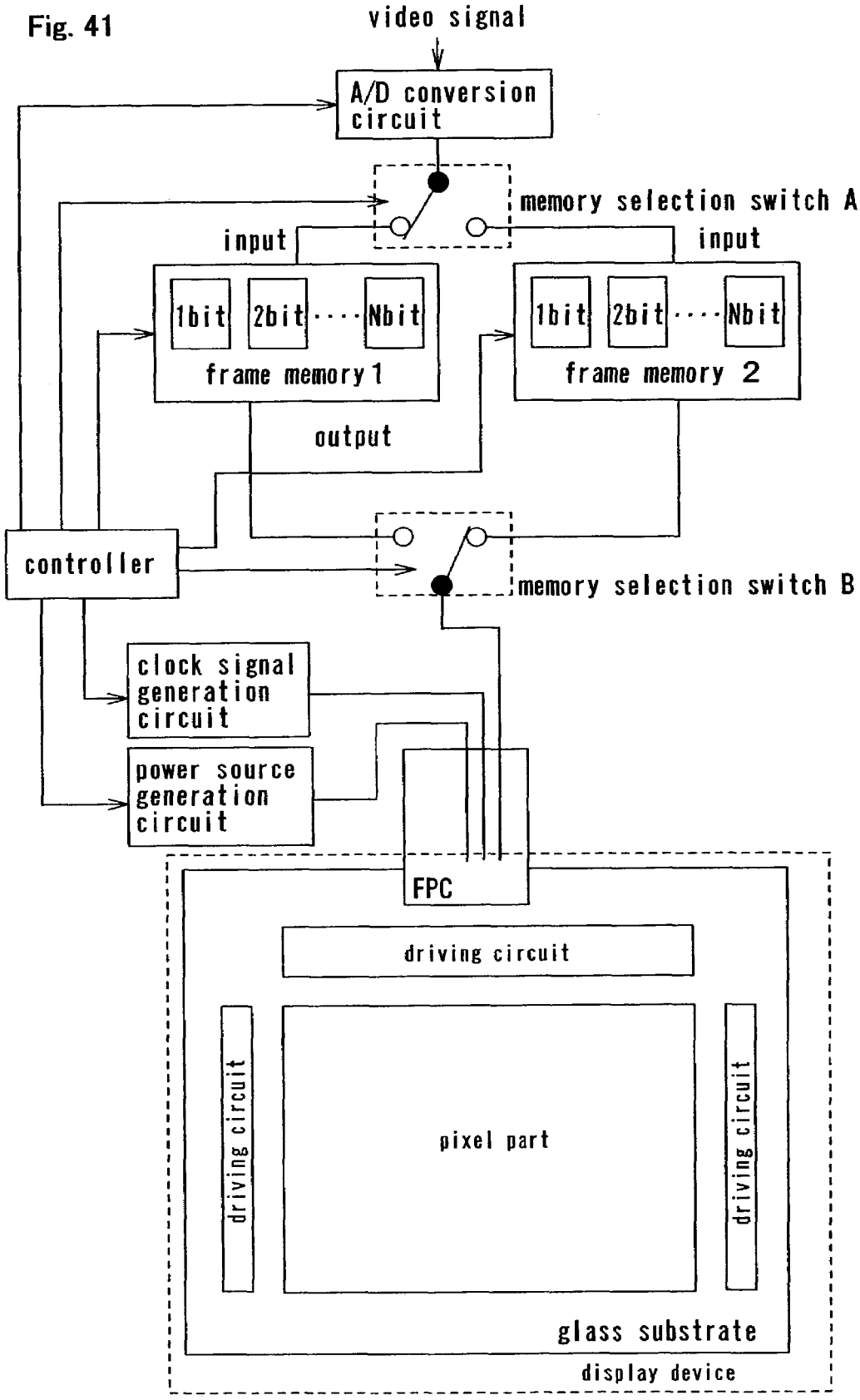
FIG. 41 is a schematic diagram showing a structure of a display system of the invention.

An example of the display system is shown in FIG. 41. The display system has, besides the display device, an A/D conversion circuit, a memory selection switch A, a memory selection switch B, a frame memory 1, a frame memory 2, a controller, a clock signal generation circuit, and a power source generation circuit.

An operation of the display system will be described. The A/D conversion circuit converts the video signal which was inputted to the display system into a digital video signal. The frame memory A or the frame memory B stores the digital video signal. Here, by separately using the frame memory A or the frame memory B with respect to each period (with respect to one frame period, with respect to each sub frame period), it is possible to take an extra room in writing a signal to the memory and in reading out a signal from the memory. The separated use of the frame memory A and the frame memory B can be realized by switching the memory selection switch A and the memory selection switch B by the controller. Also, the clock generation circuit generates a clock signal etc. by a signal from the controller. The power source generation circuit generates a predetermined power source signal from the controller. The signal which was read out from the memory, the clock signal, the power source and so on are inputted to the display device through FPC.

In addition, the display system to which the invention was applied is not limited to the structure shown in FIG. 41. In a display system of well known every structure, it is possible to apply the invention to it.

It is possible to realize this embodiment by being freely combined with the embodiment 1 to the embodiment 12.

Embodiment 14

The invention can be applied to various electronic devices. In short, it is possible to apply the structural components of the invention to a portion which the various electronic devices have and which carries out image display.

An one example of the electronic device of the invention, cited are a video camera, a digital camera, a goggle type display (a head mount display), a navigation system, an audio reproduction device (a car audio set, an audio component set and so on), a notebook type personal computer, a game machine, a portable information terminal (a mobile computer, a portable telephone, a portable type game machine or an electronic book, and so on), an image reproduction device having a recording medium (to be more precise, an device which reproduces a recording medium such as DVD etc., and has a display which can display its image), and so on.

In addition, it is possible to apply the invention to various electronic devices but not limit to the above-described electronic device.

It is possible to realize this embodiment by being freely combined with the embodiment 1 to the embodiment 13.

Embodiment 15

In the display device of the invention, the current source transistor operates in the saturation region. Then, in this embodiment, an optimum scope of a channel length of the current source transistor by which power consumption of the display device can be suppressed, and yet, linearity of the operation of the current source transistor in the saturation region can be maintained will be described.

The current source transistor, which the display device of the invention has, operates in the saturation region, and its drain current Id is represented by the following formula 1. In addition, it is assumed that Vgs is a gate voltage, and μ is mobility, and $C_o$ is a gate capacitance per unit area, and W is a channel width, and L is a channel length, and Vth is a threshold value, and the drain current is Id.

$$Id=\mu CoW/L(Vgs-Vth)^2/2 \quad (1)$$

From the formula 1, it is understood that, in case that values of μ, Co, Vth, and W are fixed, Id is determied by values of L and Vgs, without depending upon a value of Vds.

Meanwhile, power consumption is comparable to product of a current and a voltage. Also, since Id is proportion to luminance of the light emitting element, when the luminance is determined, the value of Id is fixed. Thus, in case that reduction of power consumption is taken into consideration, it is understood that |Vgs| is desired to be lower, and therefore, L is desired to be of a smaller value.

However, when the value of L gets smaller, the linearity of the saturation region is getting not to be maintained gradually due to Early effect or Kink effect. In short, the operation of the current source transistor is getting not to follow the above-described formula 1, and the value of Id is getting gradually to depend upon Vds. Since the value of Vds is increased based upon decrease of $V_{EL}$ due to deterioration of the light emitting element, as a chain thereof, the value of Id becomes apt to be swayed by the deterioration of the light emitting element.

In short, it is not desirable that the value of L is too small, taking the linearity of the saturation region into consideration, but if too large, it is not possible to suppress the power consumption. It is most desirable that the value of L is made to be small within a scope that the linearity of the saturation region can be maintained.

Figure 42:
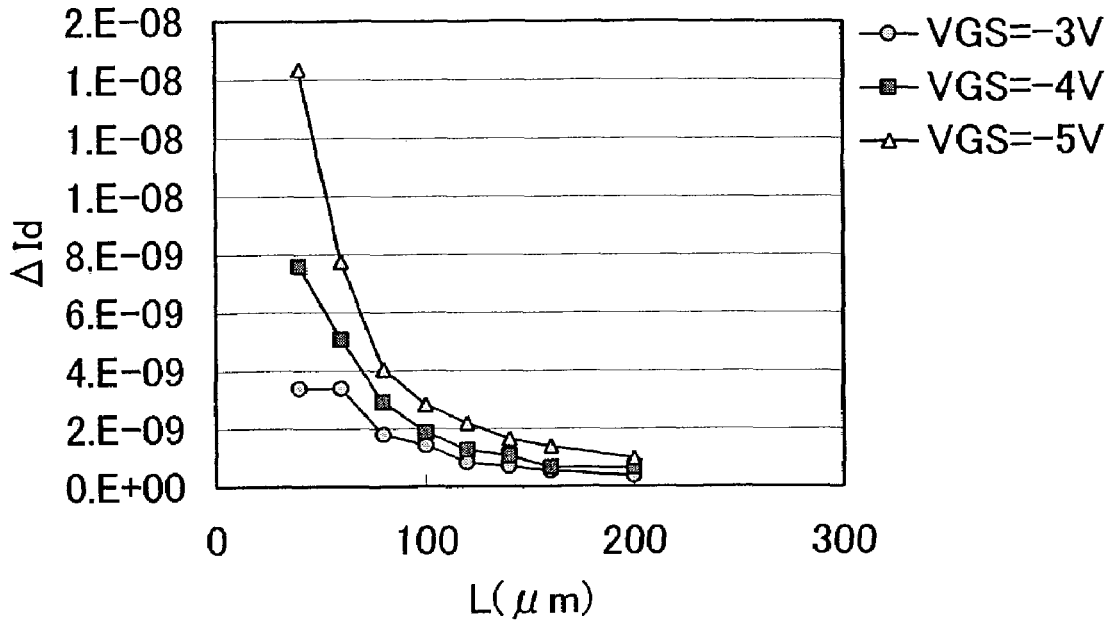
FIG. 42 is a graph showing a relation of a channel length L and $\Delta I_d$.

FIG. 42 shows a relation of L and ΔId in a P channel type TFT at the time of W=4 μm and Vds=10 v. ΔId is a value which differentiates Id by L, and comparable to an inclination of Id to L. Thus, the smaller the value of ΔId is, it means that the linearity of Id in the saturation region is maintained. And, as shown in FIG. 42, it is understood that, as L is enlarged, the value of ΔId is getting drastically smaller from an area that L is approximately 100 μm. Thus, in order to maintain the linearity of the saturation region, it is understood that L is desirable to be the value of approximately 100 μm and more than that.

And, taking the power consumption into consideration, since it is desirable that L is smaller, in order to satisfy both conditions, it is most desirable that L is 100±10 μm. In short, by setting the scope of L at 90 μm≦L≦110 μm, the power consumption of the display apparatus having the current source transistor can be suppressed, and yet, the linearity of the current source transistor in the saturation region can be maintained.

It is possible to realize this embodiment by being freely combined with the embodiment 1 to the embodiment 14.

Embodiment 16

In this embodiment, shown is a structural example of the pixel using a driving method for further reducing the luminance variation which was described in SUMMARY OF THE INVENTION, i.e., a driving method for separately using a plurality of the current source circuits which were set at the same output current on the occasion of expressing the same gray scale.

The pixel shown in this embodiment is of a structure which has a plurality of current source circuits, and in which a switch part making pairs with a plurality of the current source circuits is shared. One digital video signal is inputted to each pixel, and image display is carried out by selectively using a plurality of the current source circuits. By this means, it is possible to reduce the number of elements that each pixel has, and to enlarge an open area ratio. In addition, a plurality of the current source circuits which shared the switch part are set in such a manner that they output the same constant current each other. And, on the occasion of expressing the same gray scale, the current source circuits which output the same constant current are separately used. By this means, even if the output currents of the current source circuits are tentatively varied, the current flowing through the light emitting element is temporarily averaged. On that account, it is possible to visually reduce the variation of the luminance due to variation of the output currents of the current source circuits between respective pixels.

FIG. 43 shows the structure of the pixel in this embodiment. In addition, the same reference numerals and signs are given to the same portions as in FIG. 7 and FIG. 8.

Figure 43B:
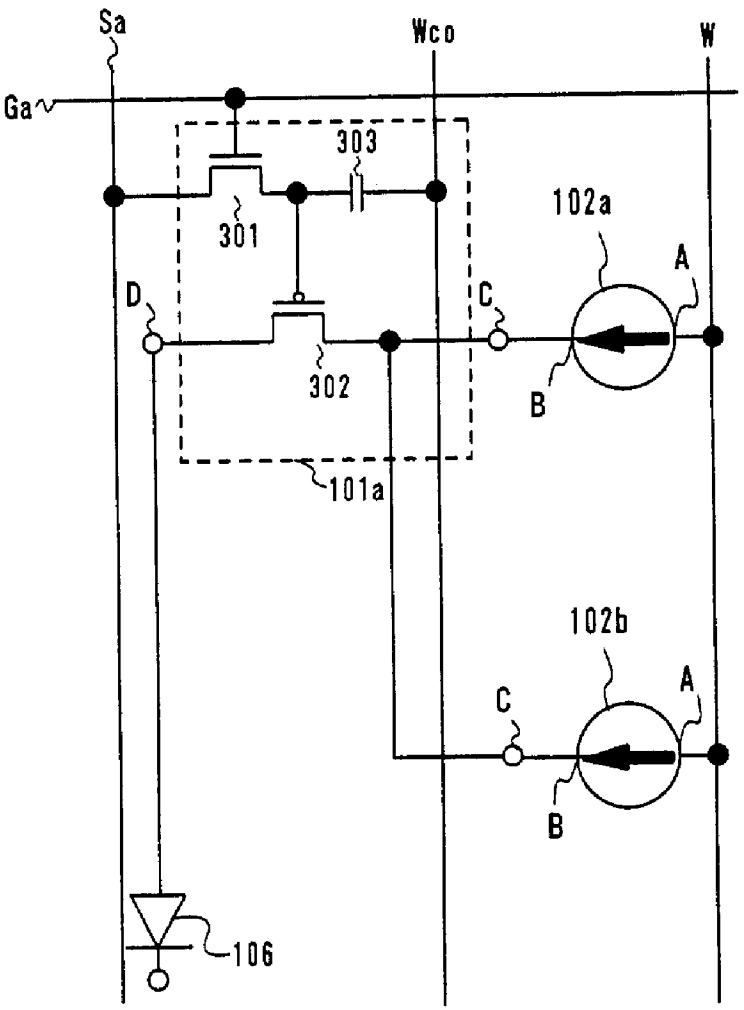
FIGS. 43A and 43B are views showing structures of the pixels of the display device of the invention.
Figure 43A:
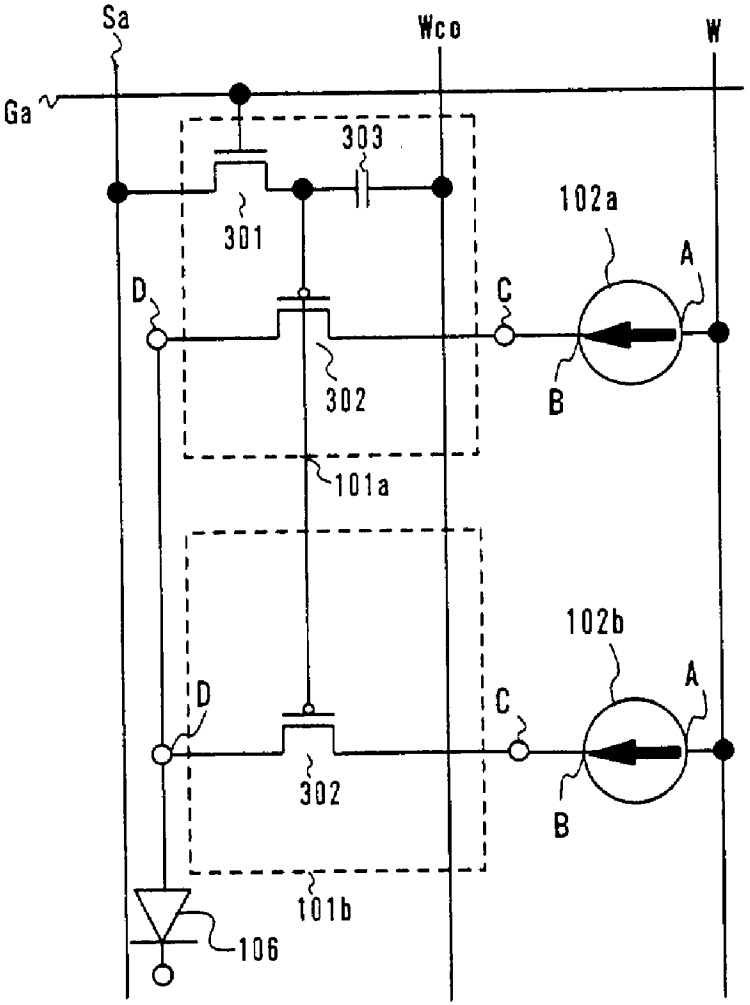

FIG. 43A is of a structure that, in the switch parts 101*a* and 101*b* corresponding to the current source circuits 102*a* and 102*b*, the switching transistor 301 is shared. Also, FIG. 43B is of a structure that, in the switch parts 101*a* and 101*b* corresponding to the current source circuits, the switching transistor 301 and the driving transistor 302 are shared. In addition, although not shown in FIG. 43, the deleting transistor 304 which was shown in the embodiment 2 may be disposed. A way of a connection of the deleting transistor 304 in the pixel can be made to be the same as in the embodiment 2.

As the current source circuits 102*a* and 102*b*, the current source circuits of the first structure to the fifth structure shown in the embodiment 3 can be freely applied. But, in the structure that the switch part making a pair with a plurality of the current source circuits is shared as in this embodiment, it is necessary for the current source circuits 102*a* and 102*b* themselves to have a function for selecting the conductive state or the non conductive state between the terminal A and the terminal B. A reason thereof is that, it is not possible to select the current source circuit which supplies a current to the light emitting element, out of a plurality of the current source circuits 102*a* and 102*b*, by one switch part which was disposed to a plurality of the current source circuits.

For example, in the embodiment 3, as to the current source circuits of the second structure to the fifth structure shown in FIGS. 10, 11, 12, 13 and so on, the current source circuit 102 itself has the function for selecting the conductive state or the non conductive state between the terminal A and the terminal B. That is, in the current source circuit of such structure, on the occasion of the setting operation of the current source circuit, it is possible to turn in the non conductive state between the terminal A and the terminal B, and on the occasion of carrying out the image display, it is possible to turn in the conductive state between the terminal A and the terminal B. On one hand, in the embodiment 3, as to the current source circuit of the first structure shown in FIG. 9 etc., the current source circuit 102 itself does not have the function for selecting the conductive state or the non conductive state between the terminal A and the terminal B. That is, in the current source circuit of such structure, on the occasion of the setting operation of the current source circuit and on the occasion of carrying out the image display, it is in the conductive state between the terminal A and the terminal B. Thus, in case that the current source circuit as shown in FIG. 9 is used as the current source circuit of the pixel of this embodiment as shown in FIG. 43, there is a necessity to dispose a unit for controlling the conductive and non conductive states between the terminal A and the terminal B of the respective current source circuits by a signal which is different from the digital video signal.

In the pixel of the structure of this embodiment, during a period that the setting operation of one current source circuit out of a plurality of the current source circuits which shared the switch part is carried out, it is possible to carry out the display operation by using another current source circuit. On that account, in the pixel structure of this embodiment, even if used is the current source circuit of the second structure to the fifth structure which can not carry out the setting operation of the current source circuit and the current output at the same time, it is possible to carry out the setting operation of the current source circuit and the display operation at the same time.

It is possible to realize this embodiment by being freely combined with the embodiment 1 to the embodiment 15.

Embodiment 17

In this embodiment, shown is an example that the structure of the switch part shown in FIG. 3 is applied to the pixel of the structure shown in FIG. 10A in the embodiment 4.

Figure 44B:
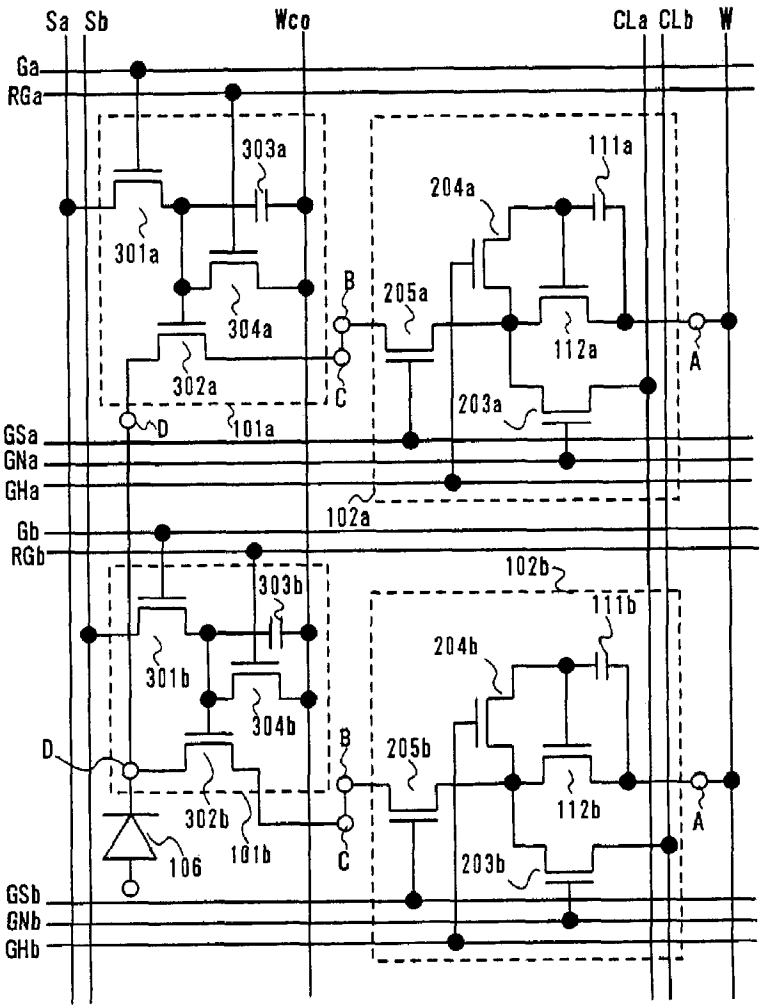
FIGS. 44A and 44B are views showing structures of the pixels of the display device of the invention.
Figure 44A:
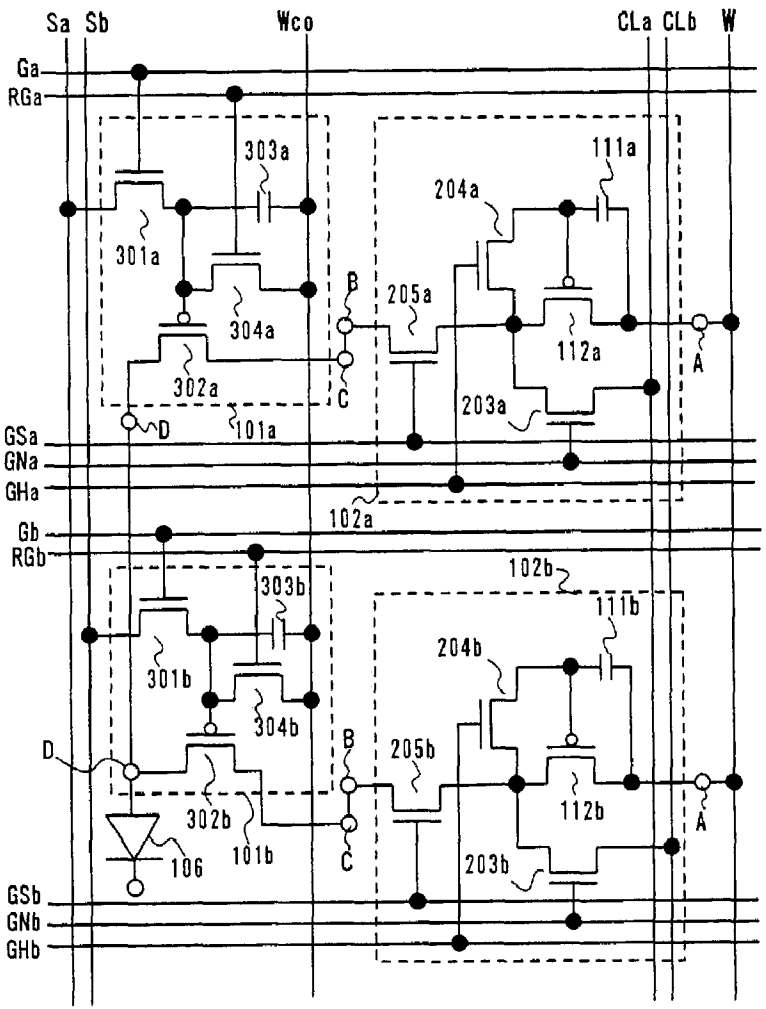

The pixel structure of this embodiment is shown in FIG. 44A. In addition, the same reference numerals and signs are given to the same portions as in FIG. 3 and FIG. 10A, and the description thereof will be omitted. Also, the pixel of such a structure that the anode and the cathode of the light emitting element in FIG. 44A was reversed is shown in FIG. 44B.

It is possible to realize this embodiment by being freely combined with the embodiment 1 to the embodiment 16.

In the display device of the invention, since the current flowing through the light emitting element can be maintained to be the predetermined constant current on the occasion of carrying out the image display, it is possible to have it emitted light with constant luminance regardless of the change of the current characteristic due to deterioration etc. of the light emitting element. Also, by selecting the ON state or the OFF state of the switch part by the digital video signal, the light emission state or the non light emission state of each pixel is selected. On that account, it is possible to speed up writing of the video signal to the pixel. Furthermore, in the pixel in which the non light emission state was selected by the video signal, since the current which is inputted to the light emitting element is completely blocked by the switch part, it is possible to realize accurate gray scale expression.

In the conventional current writing type analog system pixel structure, there was the necessity to lessen the current which is inputted to the pixel according to the luminance. On that account, there was the problem that the influence of noise is large. On one hand, in the pixel structure of the display device of the invention, if the current value of the constant current flowing through the current source circuit is set larger to some extend, it is possible to reduce the influence of noise.

Also, it is possible to have the light emitting element emitted light with constant luminance regardless of change of the current characteristic due to deterioration etc., and a speed of writing a signal to each pixel is fast, and it is possible to express accurate gray scale, and it is possible to provide the display device with low cost and smaller size and the driving method thereof.

What is claimed is:

1. A display device comprising:
a pixel comprising:
a light emitting element;
a plurality of current source circuits;
a power source line electrically connected to the plurality of current source circuits; and
a plurality of switches each of which is electrically connected between the light emitting element and each of the plurality of current source circuits,
wherein the plurality of current source circuits are configured to generate output currents corresponding to values of a plurality of control currents supplied to the plurality of current source circuits, and
wherein each of the plurality of switches is configured to control whether each of the output currents from the plurality of current source circuits is input to the light emitting element depending on a digital signal.

2. The display device according to claim 1, wherein current values of the output currents of the plurality of current source circuits are set so as to be different from each other.

3. The display device according to claim 1, wherein current values of the control currents which are input to the plurality of current source circuits are set so as to be different from each other.

4. A display device comprising:
a pixel comprising:
at least one light emitting element;
a first current source circuit electrically connected to the light emitting element through a first switch; and
a second current source circuit electrically connected to the light emitting element through a second switch; and
a power source line,
wherein said first and second current source circuits are electrically connected between the light emitting element and the power source line,
wherein a first control signal is input to the first current source circuit, and a second control signal is input to the second current source circuit, and
wherein a first signal is input to the first switch, and a second signal is input to the second switch.

5. The display device according to claim 4, wherein current values of the output currents of the first and second current source circuits are set so as to be different from each other.

6. The display device according to claim 4, wherein the control signals which are input to the first and second current source circuits are set so as to be different from each other.

7. A display device comprising:
a pixel comprising:
a plurality of current source circuits; and
a plurality of switches,
wherein the plurality of current source circuits are configured to generate output currents corresponding to values of a plurality of control currents supplied to the plurality of current source circuits,
wherein each of the plurality of switches is configured to control whether each of the output currents from the plurality of current source circuits is input to a light emitting element depending on a digital signal,
wherein each of the plurality of current source circuits comprises:
a first transistor;
a second transistor for selectively inputting the control current as a drain current of the first transistor;
a capacitor for holding a gate voltage of the first transistor;
a third transistor for selecting a connection of a gate and a drain of the first transistor; and
a fourth transistor for setting the output current at a drain current of the first transistor which corresponds to the held gate voltage.

8. The display device according to claim 7, wherein current values of the output currents of the plurality of current source circuits are set so as to be different from each other.

9. The display device according to claim 7, wherein current values of the control currents which are input to the plurality of current source circuits are set so as to be different from each other.

10. A display device comprising:
a pixel comprising:
at least one light emitting element;
a first current source circuit electrically connected to the light emitting element through a first switch;
a second current source circuit electrically connected to the light emitting element through a second switch;
a power source line wherein said first and second current source circuits are electrically connected between the light emitting element and the power source line in parallel,
wherein each of the first and second current source circuits comprises:
a first terminal and a second terminal;
a first transistor and a second transistor electrically connected between the first and second terminals in series, wherein the first transistor comprises a source region and a drain region, wherein a first one of the source region and the drain region is electrically connected to the first terminal and wherein a second one of the source region and the drain region is electrically connected to the second transistor;

a third transistor electrically connected between the power source line and the second one of the source region and the drain region of the first transistor;

a fourth transistor electrically connected between a gate of the first transistor and the second one of the source region and the drain region of the first transistor;

a capacitor electrically connected between the gate of the first transistor and the first one of the source region and the drain region of the first transistor.

11. The display device according to claim 10, wherein current values of the output currents of the first and second current source circuits are set so as to be different from each other.

12. The display device according to claim 10, wherein the control signals which are input to the first and second current source circuits are set so as to be different from each other.

13. A display device comprising:

a pixel comprising:

a plurality of current source circuits; and a plurality of switches, wherein the plurality of current source circuits are configured to generate output currents corresponding to values of a plurality of control currents supplied to the plurality of current source circuits, wherein each of the plurality of switches is configured to control whether each of the output currents from the plurality of current source circuits is input to a light emitting element depending on a digital signal, wherein one of the plurality of current source circuits comprises:

a first transistor;

a second transistor selectively inputting the control current as a drain current of the first transistor;

a first capacitor for holding a gate voltage of the first transistor;

a third transistor for selecting a connection of a gate and a drain of the first transistor; and a fourth transistor for setting the output current at a drain current, of the first transistor which corresponds to the held gate voltage of the first transistor, and wherein another one of the plurality of current source circuits comprises:

a fifth transistor and a sixth transistor;

a seventh transistor for selectively inputting the control current as a drain current of the fifth transistor;

a second capacitor for holding a gate voltage of the fifth transistor;

an eighth transistor for selecting a connection of a gate and a drain of the fifth transistor, wherein the output current flows as a drain current of the sixth transistor, wherein a gate voltage of the sixth transistor is the held gate voltage of the fifth transistor.

14. The display device according to claim 13, wherein current values of the output currents of the plurality of current source circuits are set so as to be different from each other.

15. The display device according to claim 13, wherein current values of the control currents which are input to the plurality of current source circuits are set so as to be different from each other.

16. A display device comprising:

a pixel comprising:

a plurality of current source circuits; and a plurality of switches, wherein the plurality of current source circuits are configured to generate output currents corresponding to values of a plurality of control currents supplied to the plurality of current source circuits, wherein each of the plurality of switches is configured to control whether each of the output currents from the plurality of current source circuits is input to a light emitting element depending on a digital signal, wherein one of the plurality of current source circuits comprises:

a first transistor;

a second transistor for selectively inputting the control current as a drain current of the first transistor;

a first capacitor for holding a gate voltage of the first transistor;

a third transistor for selecting a connection of a gate and a drain of the first transistor; and a fourth transistor for setting the output current at a drain current of the first transistor which corresponds to the held gate voltage of the first transistor, and wherein another one of the plurality of current source circuits comprises:

a fifth transistor and a sixth transistor which is electrically connected to the fifth transistor in series;

a seventh transistor for selectively inputting the control current as a drain current of the fifth transistor;

a second capacitor for holding a gate voltage of the fifth transistor;

an eighth transistor for selecting a connection of a gate and a drain of the fifth transistor; and wherein the output current flows as a drain current of the sixth transistor, wherein a gate voltage of the sixth transistor is a part of the held gate voltage of the fifth transistor.

17. The display device according to claim 16, wherein current values of the output currents of the plurality of current source circuits are set so as to be different from each other.

18. The display device according to claim 16, wherein current values of the control currents which are input to the plurality of current source circuits are set so as to be different from each other.

19. A driving method of a display device comprising a pixel comprising a light emitting element, a plurality of current source circuits, a power supply line electrically connected to the plurality of current source circuits and a plurality of switches each of which is electrically connected between the light emitting element and each of the plurality of current source circuits, comprising:

supplying a plurality of control currents to each of the plurality of current source circuits;

setting output currents of the plurality of current source circuits to correspond to values of the plurality of control currents; and turning each of the plurality of switches on or off for controlling whether each of the output currents from the plurality of current source circuits is input to the light emitting element, by a digital signal.

20. The driving method of the display device according to claim 19, wherein the step of setting the output currents of the plurality of current source circuits and the step of turning each of the plurality of switches on or off are carried out simultaneously.

21. The driving method of the display device according to claim 19, wherein the step of setting the output currents of the plurality of current source circuits is carried out when the step of turning each of the plurality of switches on or off is not carried out.

22. The driving method of the display device according to claim 19, wherein a current value of the control current to be input is equal to a current value of the output current in each of the plurality of current source circuits.

23. The driving method of the display device according to claim 19, wherein current values of the output currents of each of the plurality of current source circuits are set so as to be different from each other.

24. The driving method of the display device according to claim 19, wherein current values of the control currents which are input to each of the plurality of current source circuits are set so as to be different from each other.

* * * * *